US008543032B2

(12) United States Patent
Silva et al.

(10) Patent No.: US 8,543,032 B2
(45) Date of Patent: Sep. 24, 2013

(54) DEVICES AND METHODS FOR REMANUFACTURING PRINTER CARTRIDGES

(75) Inventors: Gary Silva, Reseda, CA (US); Tigran Ohanyan, Van Nuys, CA (US); Denny Holmes, Los Angeles, CA (US)

(73) Assignee: Mitsubishi Kagaku Imaging Corp., San Fernando, CA (US)

( * ) Notice: Subject to any disclaimer, the term of this patent is extended or adjusted under 35 U.S.C. 154(b) by 268 days.

(21) Appl. No.: 13/068,183

(22) Filed: May 4, 2011

(65) Prior Publication Data

US 2011/0274460 A1 Nov. 10, 2011

Related U.S. Application Data

(60) Provisional application No. 61/343,961, filed on May 5, 2010.

(51) Int. Cl.
*G03G 15/00* (2006.01)

(52) U.S. Cl.
USPC ..... 399/109

(58) Field of Classification Search
USPC ..... 399/109, 116, 117
See application file for complete search history.

(56) References Cited

U.S. PATENT DOCUMENTS

| | | | | |
|---|---|---|---|---|
| 6,490,426 | B1 * | 12/2002 | Zaman | 399/117 |
| 8,121,521 | B2 * | 2/2012 | Bateman, III | 399/117 |
| 8,249,483 | B2 * | 8/2012 | Holmes et al. | 399/109 |
| 2008/0112724 | A1 * | 5/2008 | Ohanyan | 399/109 |
| 2008/0112725 | A1 * | 5/2008 | Ohanyan | 399/109 |
| 2009/0060566 | A1 * | 3/2009 | Ohanyan | 399/109 |
| 2009/0208244 | A1 * | 8/2009 | Ohanyan | 399/109 |
| 2010/0067943 | A1 * | 3/2010 | Zogg et al. | 399/109 |

* cited by examiner

*Primary Examiner* — Sandra Brase

(57) ABSTRACT

There is provided a device and method for remanufacturing a printer cartridge. The printer cartridge has an organic photoconductor (OPC) drum having a drum axle and a hub assembly attached to the drum axle, and the hub assembly is in a locked position in the printer cartridge. The device has a first portion having an end configured to engage the hub assembly and unlock and lock the hub assembly. The device further has a second portion connected to the first portion, the second portion having an end configured to extract the hub assembly from the printer cartridge when the hub assembly is in an unlocked position.

20 Claims, 50 Drawing Sheets

DEVICES AND METHODS FOR REMANUFACTURING PRINTER CARTRIDGES

CROSS REFERENCE TO RELATED APPLICATION

This application claims the benefit of U.S. Provisional Patent Application Ser. No. 61/343,961, filed May 5, 2010, which is incorporated herein by reference in its entirety.

BACKGROUND a. Field of the Invention

The invention relates to devices and methods for remanufacturing printer cartridges, and in particular, to devices and methods for remanufacturing printer cartridges by replacing organic photoconductor (OPC) drums in the printer cartridges.

b. Background Art

Printer cartridges, such as toner cartridges, are used in various electrophotographic imaging devices, such as laser printers, copiers, facsimile machines, and multifunction imaging devices. Once original equipment manufacturer (OEM) printer cartridges are used, they are often recycled and remanufactured. The process of remanufacturing a printer cartridge may include cleaning the cartridge, repairing damaged parts, replacing worn parts, reassembling with new parts, and replenishing the cartridge with toner. The process of remanufacturing a printer cartridge requires that the printer cartridge be disassembled so that access to the various parts can be achieved, and further requires that the printer cartridge be reassembled for subsequent use.

Printer cartridges typically include organic photoconductive (OPC) drums that may be designed to be electrically charged to be able to attract toner. The OPC drum is typically one of the components that wears out from usage and gets replaced during remanufacturing. In some known printer cartridges, such as, for example, some known printer cartridges manufactured by Lexmark International, Inc. for use with Lexmark printer model numbers T650, T652, T654 and E260, E360, E460, the OPC drums may be attached to the printer cartridges in a manner that makes the OPC drums difficult to remove from the printer cartridges and may cause damage to the OPC drum, the OPC drum components, and/or other printer cartridges components during remanufacturing. For example, such known printer cartridges may include a hub assembly comprising a drive hub and a locking ring, where the hub assembly is attached to a drum axle of the OPC drum and helps to lock the OPC drum in place in the printer cartridge. During remanufacturing of such known printer cartridges, known hand tools, such as screwdrivers, pliers, spring hooks, and scraping tools, are typically used to rotate, pry off, and separate the locking ring and drive hub from the drum axle and are used to push out and remove, the locking ring and drive hub in order to remove the OPC drum. However, if not used carefully and properly, such known hand tools can damage the OPC drum, the hub assembly components, and/or other printer cartridge components. In particular, damage to the locking ring and drive hub of the hub assembly can affect or prevent their reuse with a replacement OPC drum.

It is thus desirable to be able to remove and replace an OPC drum from a printer cartridge without damage to the OPC drum, the hub assembly components, and/or other printer cartridge components. This helps preserve the appearance of the printer cartridge and minimizes remanufacturing steps.

Devices and methods for efficiently and quickly removing and replacing an OPC drum from a printer cartridge are desired.

Accordingly, there is a need for an improved device and method for remanufacturing printer cartridges, including replacing OPC drums, that overcomes the issues associated with known devices and methods.

SUMMARY

This need for an improved device and method for remanufacturing printer cartridges, including replacing OPC drums, is satisfied.

There is provided in one embodiment a device for remanufacturing a printer cartridge. The printer cartridge has an organic photoconductor (OPC) drum having a drum axle and a hub assembly attached to the drum axle. The hub assembly is in a locked position in the printer cartridge. The device has a first portion having an end configured to engage the hub assembly and unlock and lock the hub assembly. The device further has a second portion connected to the first portion, the second portion having an end configured to extract the hub assembly from the printer cartridge when the hub assembly is in an unlocked position.

There is provided in another embodiment a tool for replacing an OPC drum of a printer cartridge. The OPC drum has a drum axle and a hub assembly attached to the drum axle. The hub assembly is in a locked position in the printer cartridge. The tool has a first portion having a hub assembly engagement end configured to engage the hub assembly and rotatably unlock and lock the hub assembly. The tool further has a second portion connected to the first portion. The second portion has a hub assembly extraction end configured to extract the hub assembly from the printer cartridge when the hub assembly is in an unlocked position.

There is provided in another embodiment a method for remanufacturing a printer cartridge. The printer cartridge has an organic photoconductor (OPC) drum having a drum axle and having a hub assembly attached to the drum axle. The hub assembly is in a locked position in the printer cartridge. The method comprises providing a device with a first portion having an end configured to engage the hub assembly, and a second portion connected to the first portion, the second portion having an end configured to extract the hub assembly from the printer cartridge. The method further comprises unlocking the hub assembly with the end of the first portion. The method further comprises removing the hub assembly from the printer cartridge with the end of the second portion. The method further comprises removing the OPC drum from the printer cartridge. The method further comprises installing a replacement OPC drum in the printer cartridge. The method further comprises using the end of the first portion to attach the hub assembly that has been removed to a replacement OPC drum axle. The method further comprises coupling a drum axle stop element to an end of the replacement OPC drum axle opposite the hub assembly. The method further comprises locking the hub assembly with the end of the first portion.

There is provided in another embodiment a method for replacing an organic photoconductive (OPC) drum of a printer cartridge. The organic photoconductor (OPC) drum has a drum axle and has a hub assembly attached to the drum axle. The hub assembly is in a locked position in the printer cartridge. The method comprises providing a device with a first portion having a hub assembly engagement end, and a second portion connected to the first portion, the second portion having a hub assembly extraction end. The method further comprises coupling the hub assembly engagement end to the hub assembly and rotating the hub assembly to unlock the hub assembly. The method further comprises contacting the hub assembly with the hub assembly extraction end to remove the hub assembly from the printer cartridge. The method further comprises replacing the OPC drum with a replacement OPC drum having a replacement OPC drum axle. The method further comprises coupling the hub assembly engagement end to the hub assembly that has been removed and attaching the hub assembly to a first end of the replacement OPC drum axle. The method further comprises coupling a drum axle stop element to a second end of the replacement OPC drum axle opposite the hub assembly. The method further comprises rotating the hub assembly with the first portion to lock the hub assembly and hold the replacement OPC drum in place in the printer cartridge.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for remanufacturing printer cartridges, such as toner cartridges, and in particular, for removing and replacing an organic photoconductor ("OPC") drum in a printer cartridge and installing a replacement OPC drum in a printer cartridge. The disclosed embodiments of the devices and methods may be used with printer cartridges that can be used in laser printer models, such as Lexmark International Inc. T650, T652, T654 and E260, E360, E460 families of laser printers, and may also be used with other suitable printer cartridges.

Figure 1:
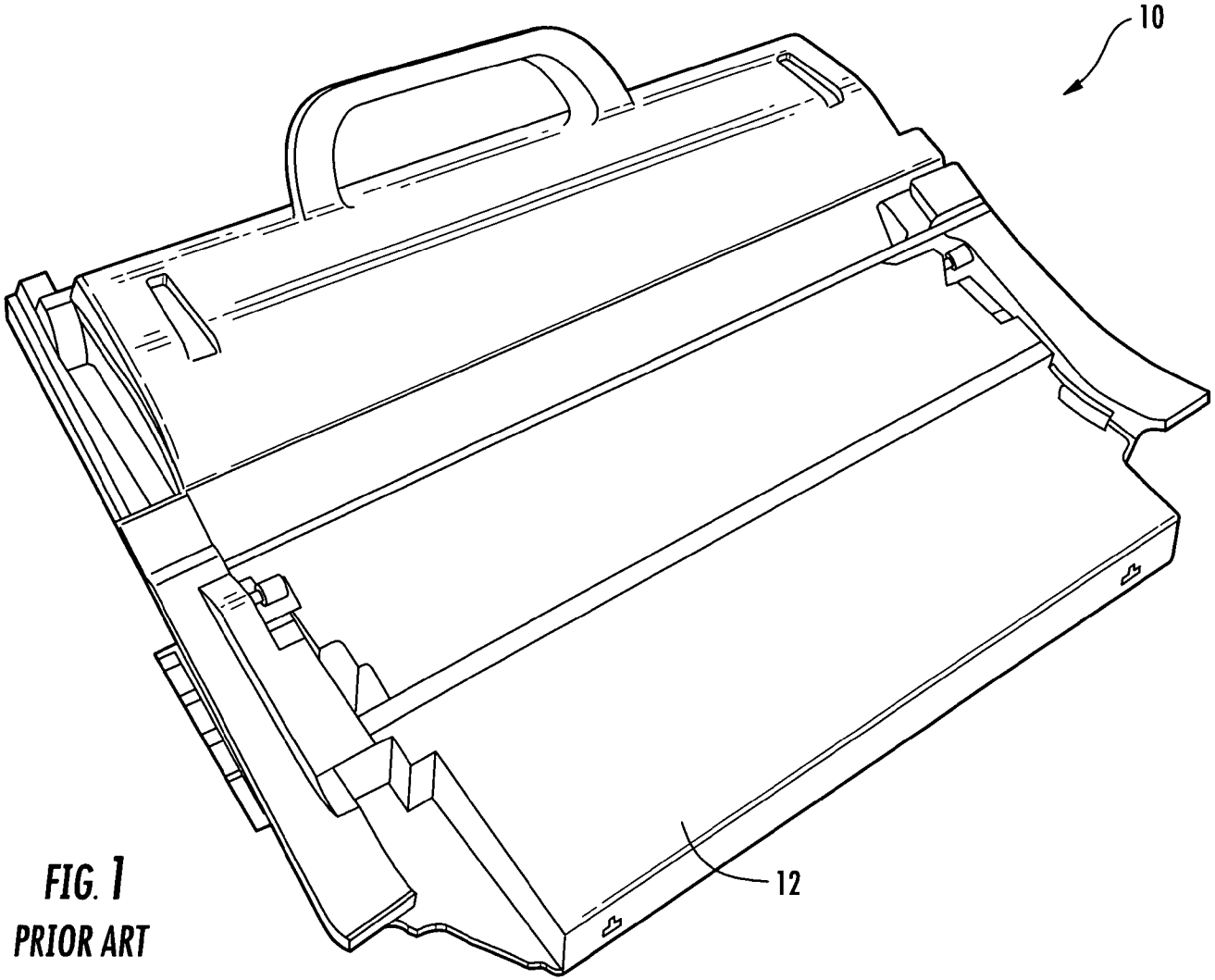
FIG. 1 PRIOR ART
FIG. 1 shows a front perspective view of a known printer cartridge for which disclosed embodiments of the device and printer remanufacturing method of the disclosure may be applied.
Figure 2:
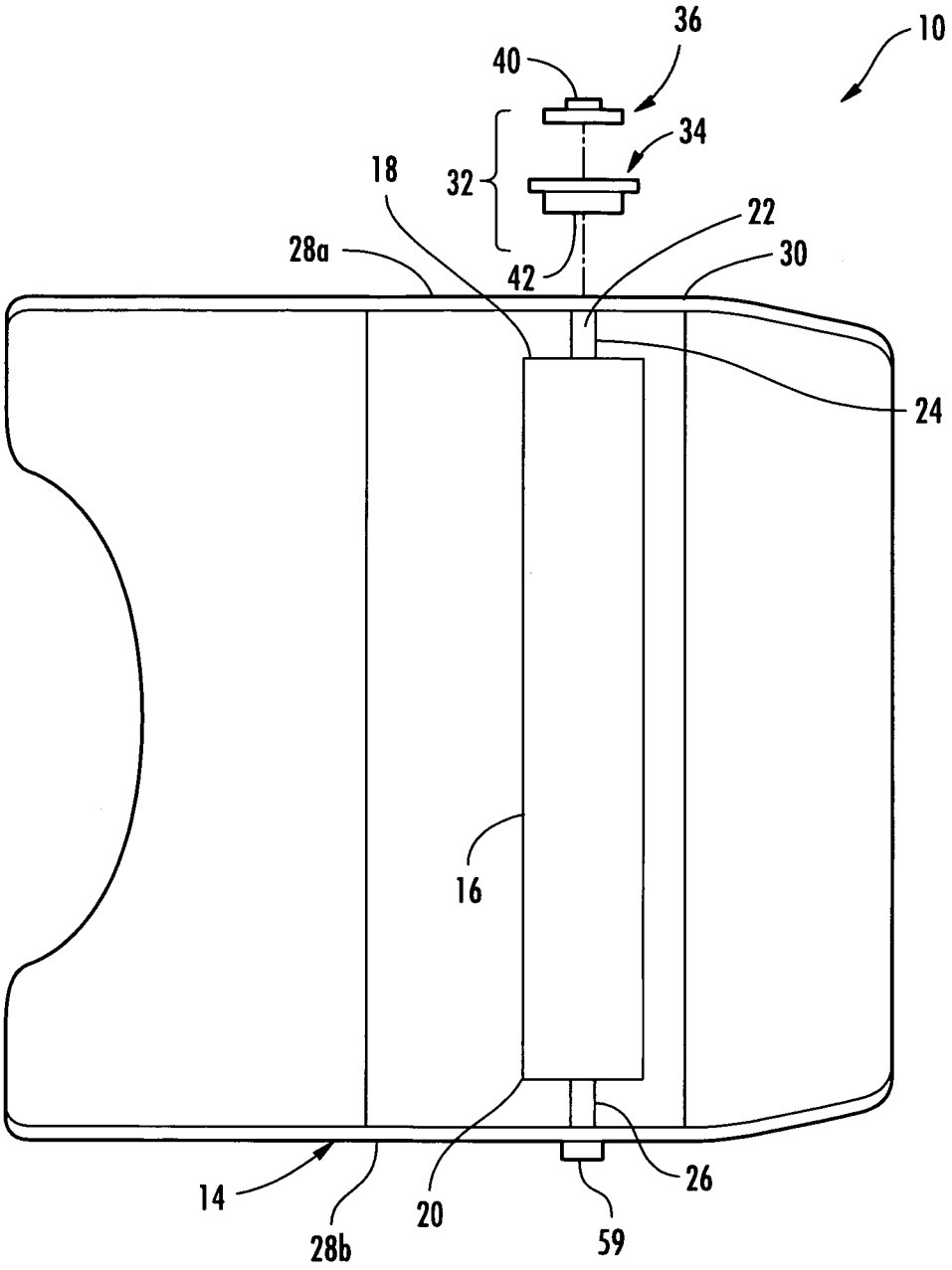
FIG. 2 PRIOR ART
FIG. 2 shows a top view of an interior portion of a known printer cartridge for which, disclosed embodiments of the device and printer remanufacturing method of the disclosure may be applied.
Figure 3:
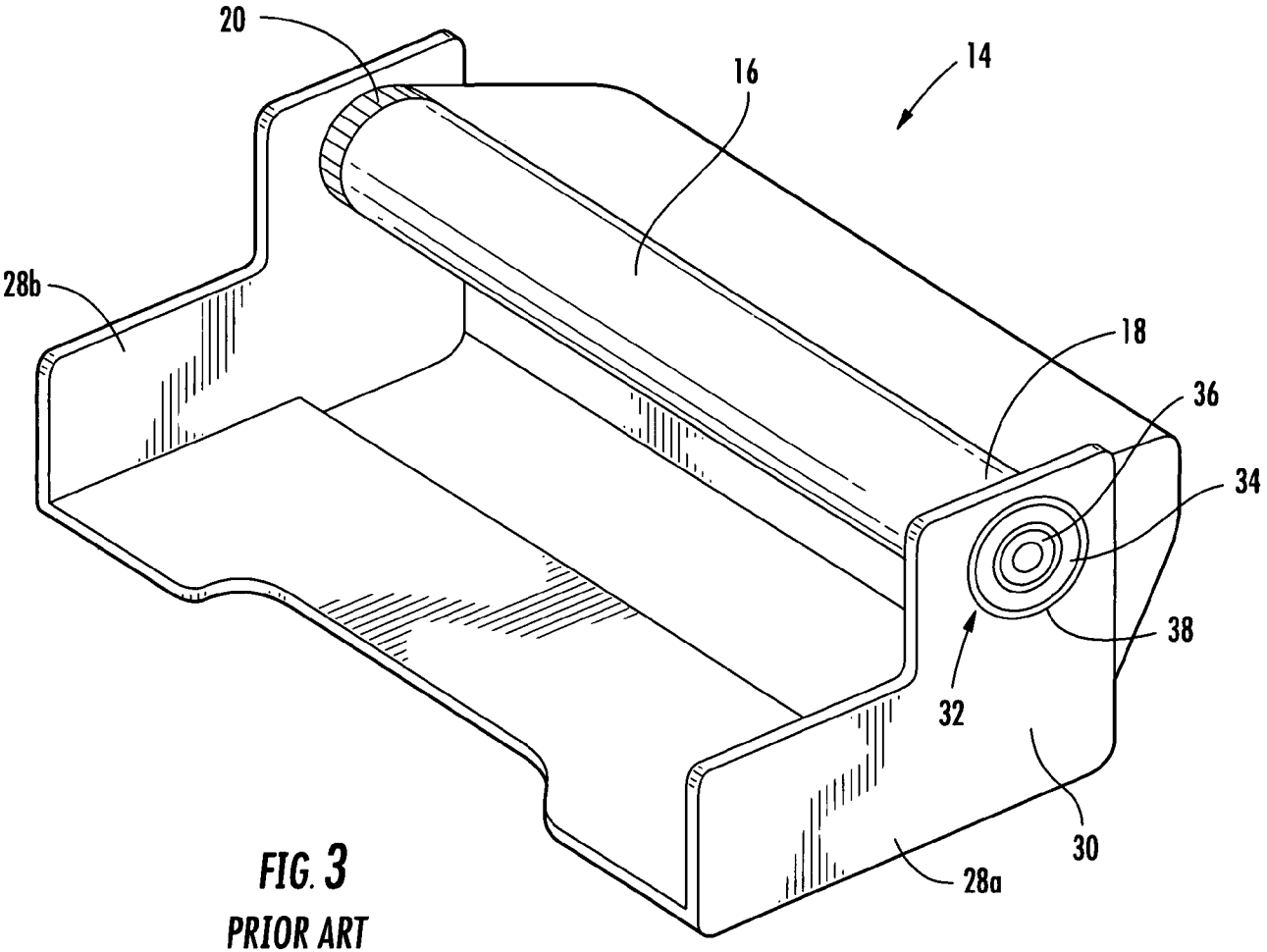
FIG. 3 PRIOR ART
FIG. 3 shows a perspective view of an interior portion of the known printer cartridge of FIG. 2.

Referring to the Figures, FIGS. 1-3 show a known printer cartridge 10 for which the devices and printer remanufacturing methods of the disclosed embodiments may be applied. FIG. 1 shows a front perspective view of a front exterior 12 of the known printer cartridge 10. FIG. 2 shows a top view of an interior portion 14 of the known printer cartridge 10, and FIG. 3 shows a perspective view of the interior portion 14 of the known printer cartridge 10. FIGS. 2 and 3 show an organic photoconductor (OPC) drum 16 having a first end 18 and a second end 20. As shown in FIG. 2, the OPC drum 16 has a drum axle 22 having a first end 24 and a second end 26. The drum axle 22 is positioned substantially within the interior of the OPC drum 16 and runs through the length of the OPC drum 16. The first end 24 of the drum axle 22 extends beyond the first end 18 of the OPC drum 16, and the second end 26 of the drum axle 22 extends beyond the second end 20 of the OPC drum 16. The OPC drum 16 is positioned between sides 28*a*, 28*b* of a waste hopper frame 30 of the printer cartridge 10. The first end 24 of the drum axle 22 is attached to a hub assembly 32. The hub assembly 32 comprises a locking ring 34 and a drive hub 36. The hub assembly 32 is configured to lock and fit snugly within an opening 38 (see FIG. 3) formed in the side 28*a* of the waste hopper frame 30 of the printer cartridge 10. The opening 38 has one or more locking notches 39 (see FIGS. 20E, 24A). As shown in FIG. 2, the hub assembly 32 has an exterior side 40 facing outwardly from the OPC drum 16 and an interior side 42 facing inwardly to the OPC drum 16. The drive hub 36 is configured to snugly press fit within a recessed interior 44 (see FIG. 20E) of the locking ring 34. The drive hub 36, as further shown in FIG. 20E, comprises a central raised portion 46 surrounded by a circular recessed portion 48, and further comprises a rim portion 50 having notched recessed portions 52. The locking ring 34, as further shown in FIG. 20E, comprises a hole 54 in the recessed interior 44 adapted to receive the first end 24 of the drum axle 22, and further comprises a rim portion 56 having opposed locking tabs 57 and notched recessed portions 58. The hub assembly 32 is locked into the opening 38 of the side 28*a* of the waste hopper frame 30 and pressed onto the drum axle 22 by a quarter turn locking mechanism that is formed between the opposed locking tabs 57 on the locking ring 34 and the corresponding locking notches 39 formed in the opening 38 of the side 28*a* of the waster hopper frame 30. The drive hub 36 is pressed onto the first end 24 of the drum axle 22. When the hub assembly 32 is locked and attached to the first end 24 of the drum axle 22, the hub assembly 32 locks the OPC drum 16 in place in the printer cartridge 10. The second end 26 of the drum axle 22 is attached to a bushing 59 (see FIG. 22E).

Figure 24A:
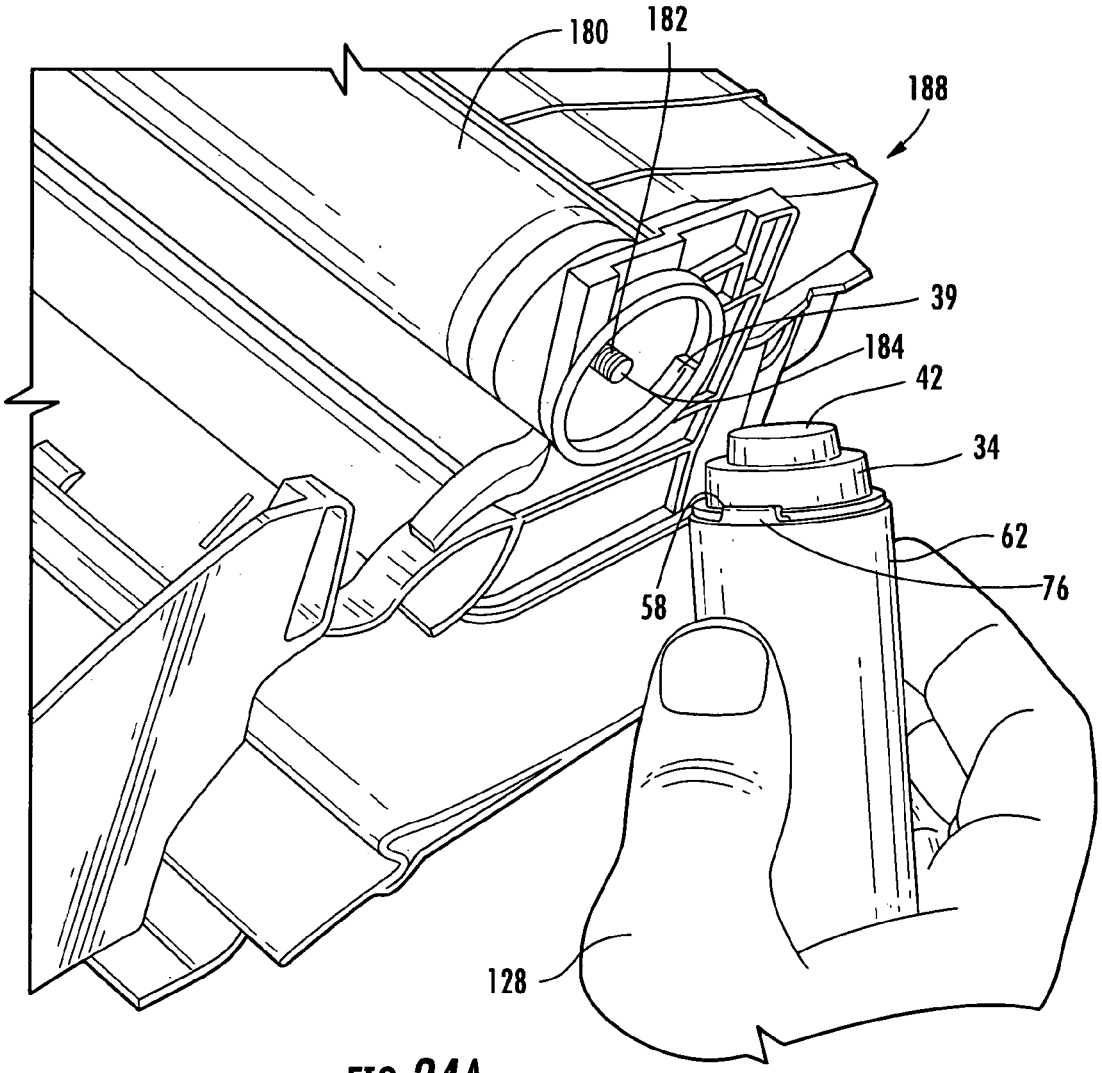
FIGS. 24A-24H are perspective views of a third embodiment of the device in use in another one of the embodiments of a method of installation of an OPC drum of a known printer cartridge.

As shown in FIGS. 4-8D, there is provided in a first embodiment a device 60 for remanufacturing a printer cartridge, and in particular, a device for removing and replacing an OPC drum 16 and installing a replacement OPC drum 180 (see FIG. 24A). Preferably, the device 60 is in the form of a tool 61. The device 60 or tool 61 may be made of a material comprising stainless steel, aluminum, brass, acrylic, resilient plastic, a mixture thereof, or another suitable metal or plastic material.

Figure 4:
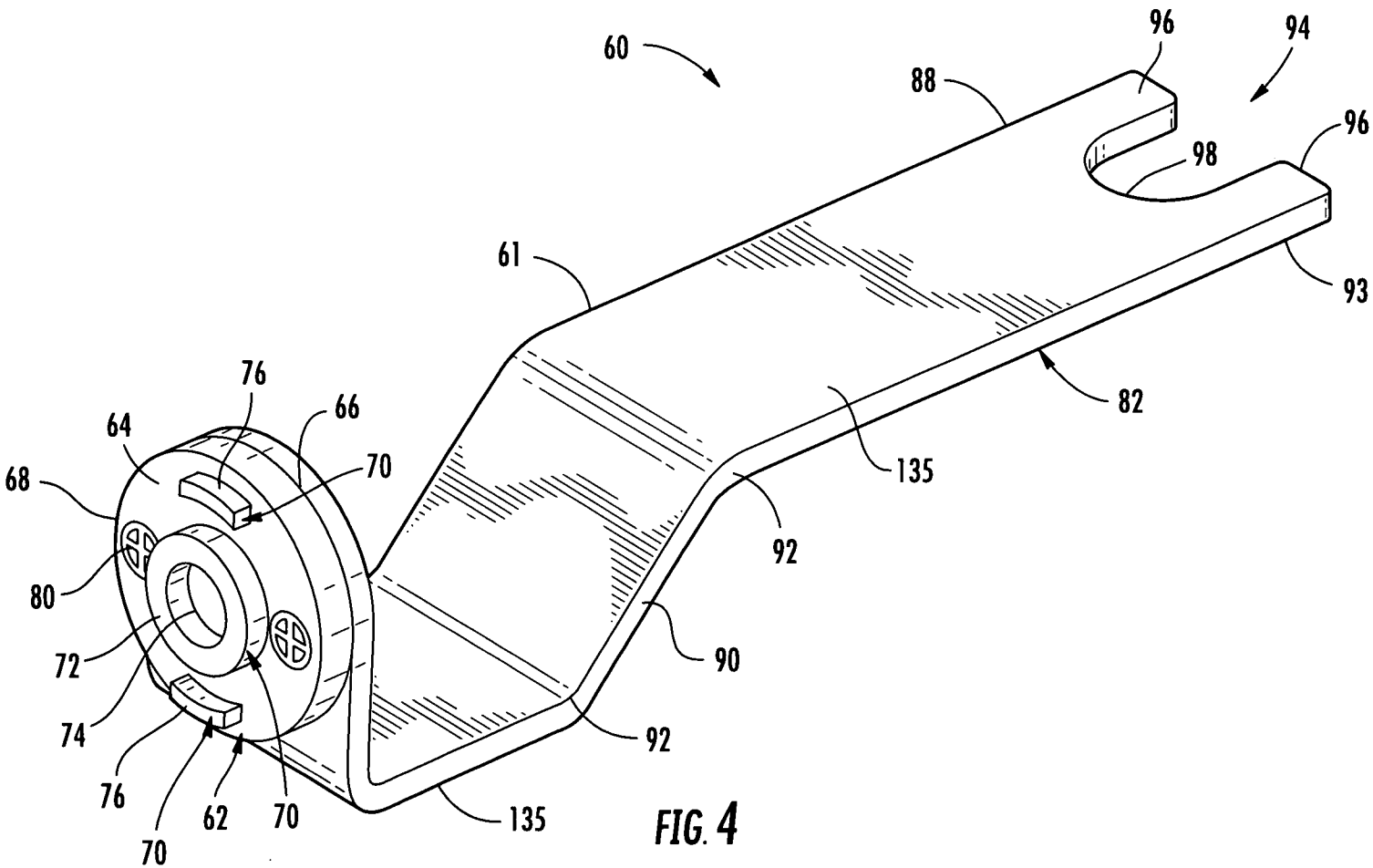
FIG. 4 is a top front perspective view of a first embodiment of a device of the disclosure.
Figure 5:
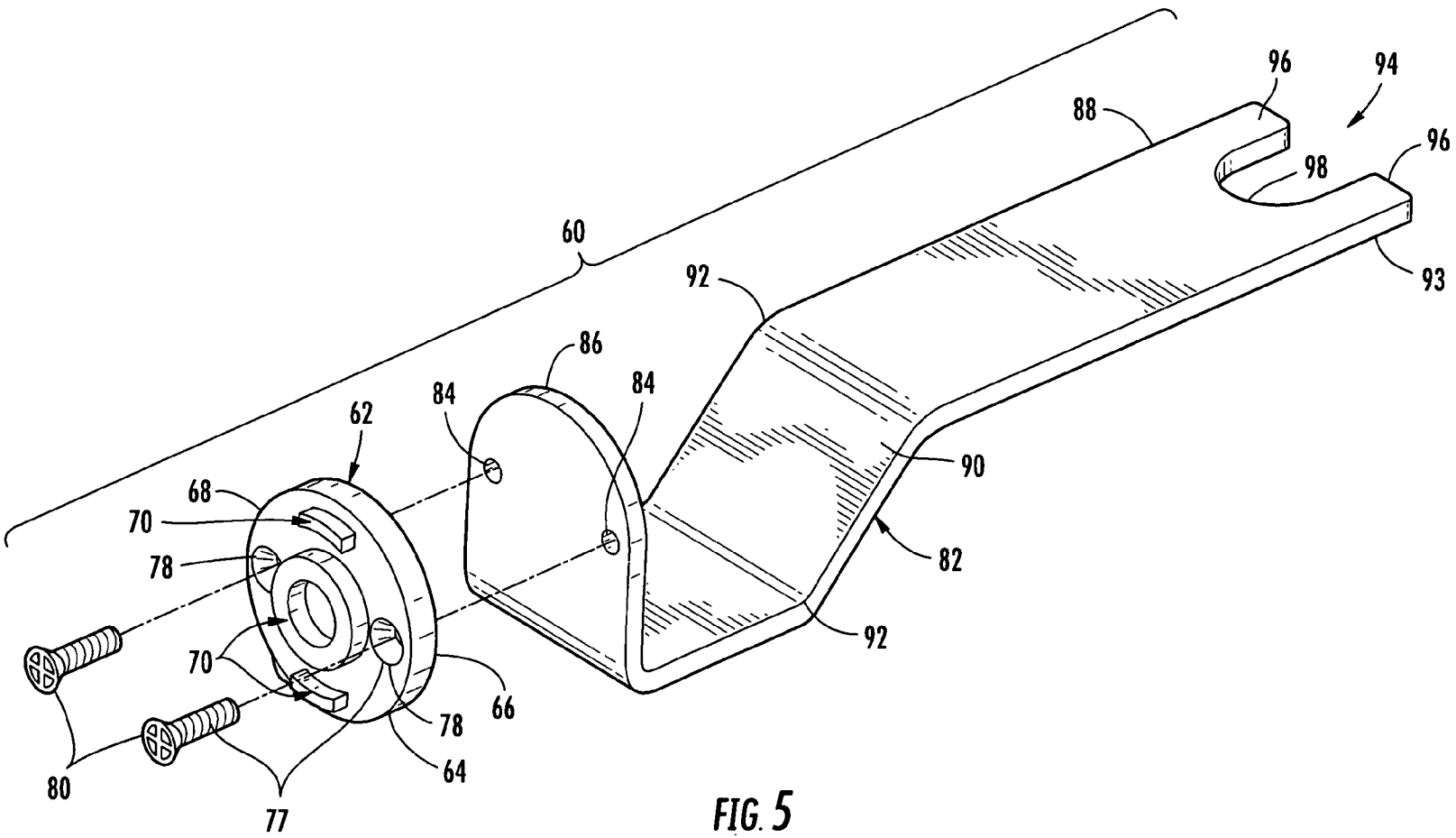
FIG. 5 is an exploded view of the device of FIG. 4.

The printer cartridge 10, as discussed above and shown in FIG. 2, has an organic photoconductor (OPC) drum 16 having a drum axle 22 and a hub assembly 32 attached to the drum axle 22. When the hub assembly 32 is in a locked position 192 (see FIG. 20A) in the printer cartridge 10, the hub assembly 32 holds the OPC drum 16 in place. The hub assembly 32 comprises the drive hub 36 and the locking ring 34. FIG. 4 is a top front perspective view of a first embodiment of the device 60 of the disclosure. FIG. 5 is an exploded view of the device 60 of FIG. 4. As shown in FIGS. 4-5, the device 60 preferably has a first portion 62 having a first, end 64 and a second end 66. Preferably, the first portion 62 in this embodiment is substantially circular or disc shaped. However, the first portion 62 may also have other suitable shapes. Preferably, the first end 64 is configured to engage the hub assembly 32 and rotatably unlock and lock the hub assembly 32. The first end 64 of the first portion 62 preferably comprises a hub assembly engagement end 68 having one or more raised flanges 70 configured for insertion into one or more corresponding recessed portions 48, 58 (see FIG. 20E) formed in the hub assembly 32.

Figure 6B:
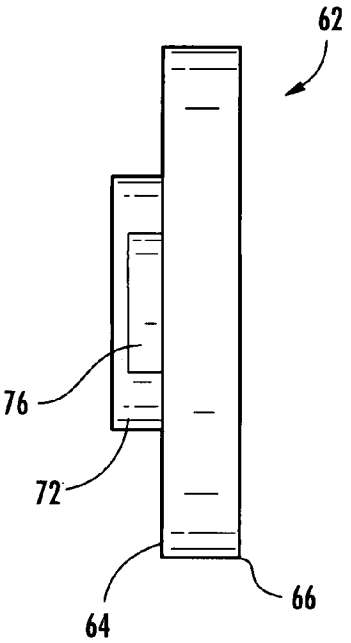
FIG. 6B is a top view of the first portion of the device of FIG. 6A.
Figure 6A:
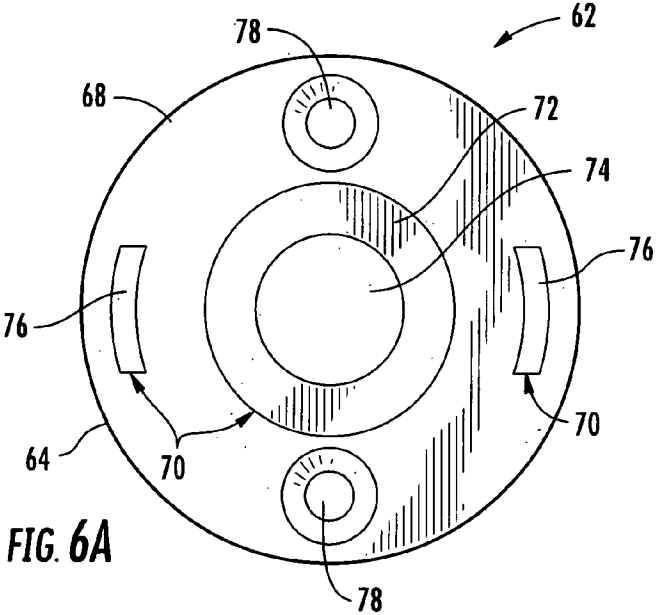
FIG. 6A is a front view of a first portion of the device of FIGS. 4-5.
Figure 6C:
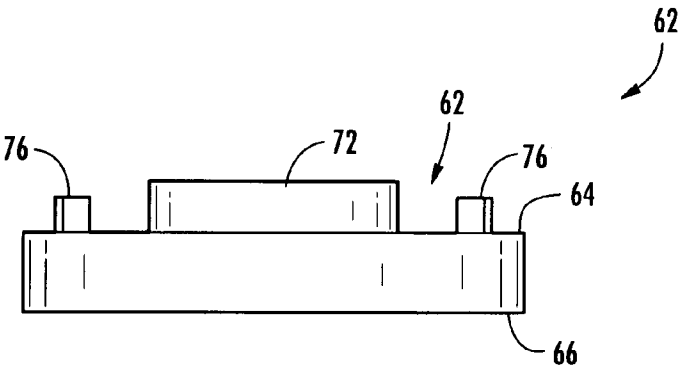
FIG. 6C is a right side view of the first portion of the device of FIG. 6A.

FIG. 6A is a front view of the first portion 62 of the device 60 of FIGS. 4-5. As shown in FIGS. 4 and 6A, the raised flanges 70 may comprise a circular raised flange 72 positioned in a central portion 74 of the first end 64. The circular raised flange 72 may preferably be inserted into, correspond to, and fit within the circular recessed portion 48 (see FIG. 20E) of the drive hub 36 when the first end 64 is engaged or coupled to the hub assembly 32. The circular raised flange 72 acts as a pressing element against the drive hub 36. The raised flanges 70 may further comprise one or more slightly curved raised flanges 76 on each side of the circular raised flange 72. The curved raised flanges 76 may preferably be inserted into, correspond to, and fit within the notched recessed portions 58 (see FIG. 20E) of the locking ring 34 when the first end 64 is engaged or coupled to the hub assembly 32. The curved raised flanges 76 act as a locking ring wrench to attach to the locking ring 34 and rotate the locking ring 34 in order to lock and unlock the hub assembly 32 in the printer cartridge 10. FIG. 6B is a top view of the first portion 62 of the device of FIG. 6A. FIG. 6B shows the first end 64 and second end 66 of the first portion 62, the curved raised flange 76 and the circular raised flange 72. FIG. 6C is a right side view of the first portion 62 of the device of FIG. 6A. FIG. 6C shows the first portion 62, the curved raised flanges 76 and the circular raised flange 72.

As shown in FIG. 5, the first portion 62 may be connected to a second portion 82 via a fastener and fastener receiving connector assembly 77. The fastener and fastener receiving connector assembly 77 may comprise one or more fasteners 80 adapted for insertion into one or more corresponding fastener receiving openings 78 located on the first portion 62 and adapted for insertion into one or more corresponding fastener receiving openings 84 on the second portion 82. The one or more fasteners 80 may comprise threaded screws or other suitable fasteners. The fastener receiving openings 78 may comprise threaded openings formed in the first portion 62 and formed in a first end 86 of the second portion 82.

As shown in FIGS. 4-5, the device 60 further comprises the second portion 82 having a first end 86 and a second end 88. The second portion 82 further comprises a handle portion 90 between angled portions 92. The second portion 82 further comprises a hub assembly extraction end 93 preferably in the form of a U-shaped fork portion 94 having preferably two tines 96 and a central U-shaped portion 98.

Figure 7C:
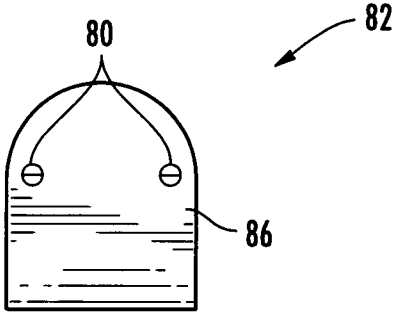
FIG. 7C is a front view of the second portion of the device of FIG. 7A.
Figure 7A:
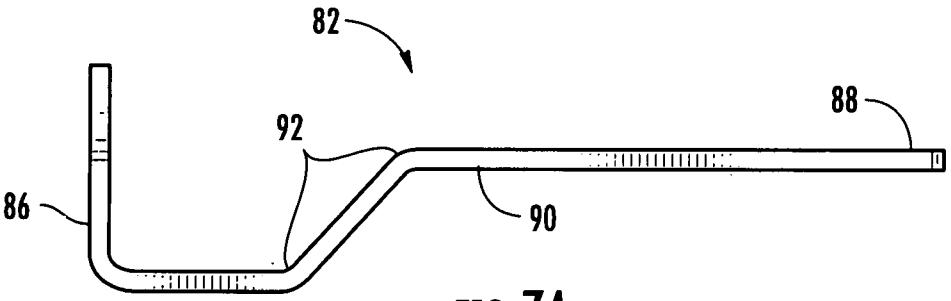
FIG. 7A is a right side view of a second portion of the device of FIG. 5.
Figure 7B:
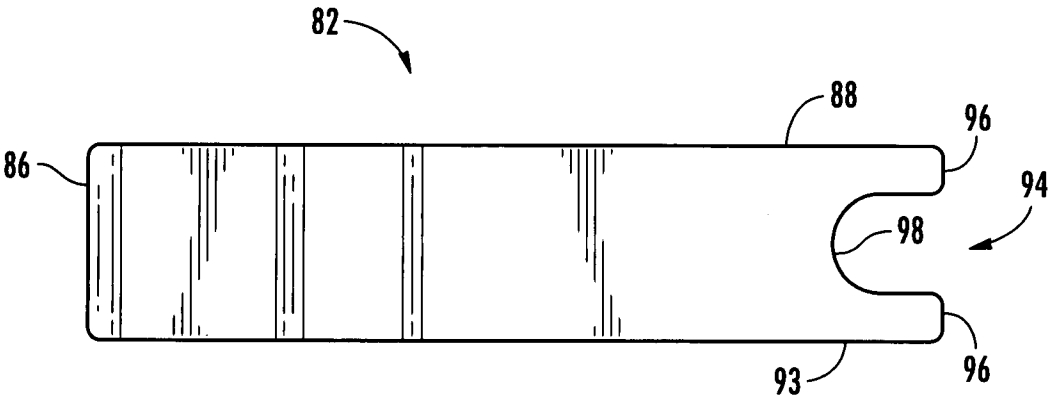
FIG. 7B is a top view of the second portion of the device of FIG. 7A.

FIG. 7A is a right side view of the second portion 82 of the device 60 of FIG. 5. FIG. 7B is a top view of the second portion 82 of the device of FIG. 7A. FIG. 7C is a front view of the second portion 82 of the device of FIG. 7A. As shown in FIG. 7C, the first end 86 may be substantially arch-shaped to correspond to the circular shape of the second end 66 of the first portion 62 and may be substantially flush with the second end 66 of the first portion 62, when the first portion 62 is attached to the second portion 82. As shown in FIG. 7A, the first end 86 may form a substantially 90 degree angle with an elongated handle portion 90. In this embodiment, the handle portion 90 may have one or more angled portions 92 to provide structure and stability to the device 60. However, the handle portion 90 may have other suitable configurations as well. The handle portion 90 is preferably designed to allow a user of the device 60 to grip the device 60 firmly and steadily when rotating the hub assembly 32 during removal of the OPC drum and installation of a replacement OPC drum. As shown in FIG. 7B, the second end 88 is preferably configured to extract and remove the hub assembly 32 from the first end 24 of the drum axle 22 and from the printer cartridge 10 when the hub assembly 32 is in an unlocked position 196 (see FIG. 20D). FIG. 7B shows the second end 88 of the second portion 82 with the hub assembly extraction end 93 configured to position or fit within an area 91 (see FIG. 20D) between, as shown in FIG. 2, the first end 18 of the OPC drum 16 and the interior of side 28*a* of the waste hopper frame 30 in order to push, extract, and remove the hub assembly 32 from the drum axle 22 and from the opening 38 on the side 28*a* of the waste hopper frame 30 of the printer cartridge 10 when the hub assembly 32 is in an unlocked position 196 (see FIG. 20D). FIG. 7B shows the hub assembly extraction end 93 with the U-shaped fork portion 94 having tines 96 and central U-shaped portion 98.

Figure 8A:
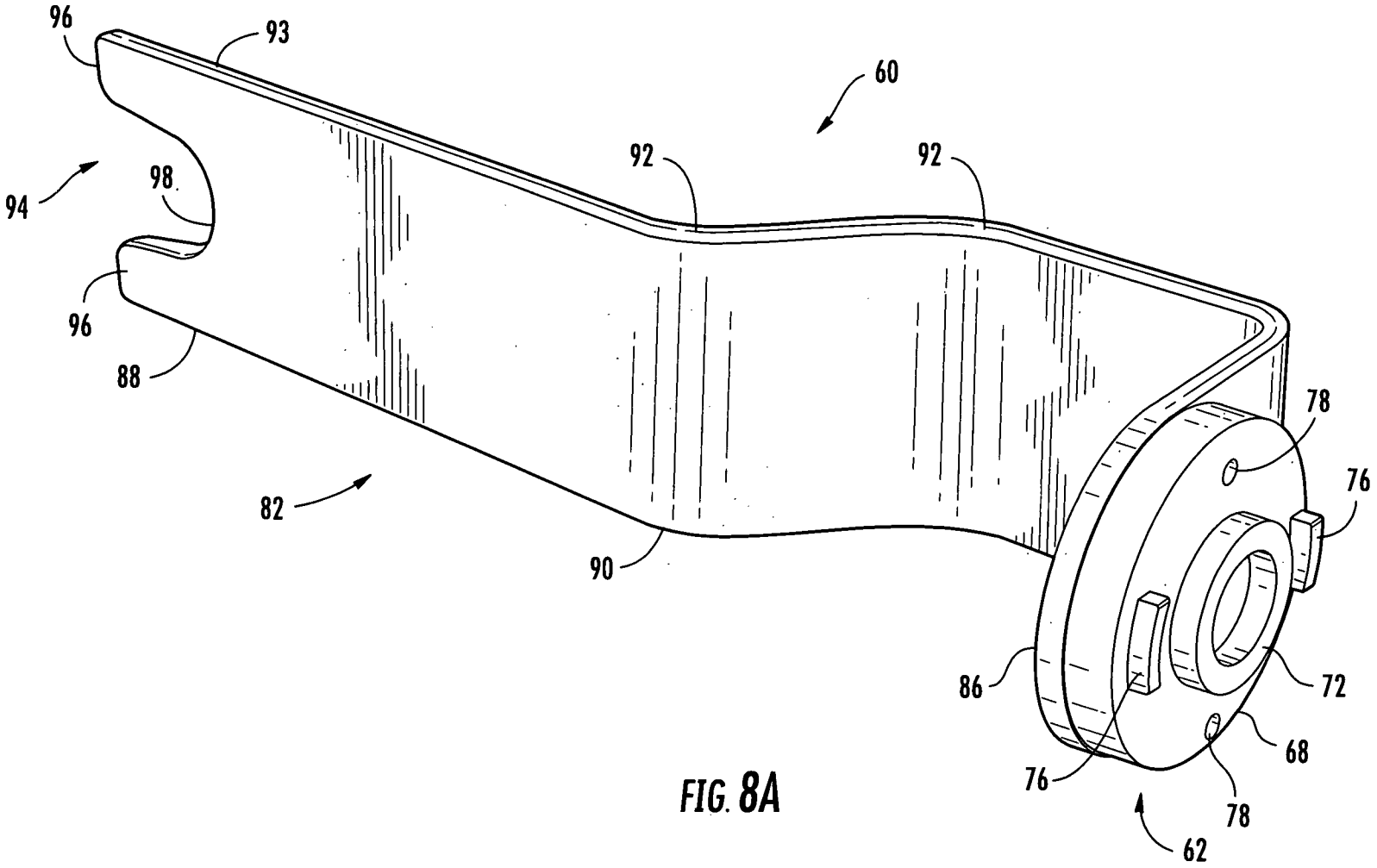
FIG. 8A is a top front perspective view of a first embodiment of the device of the disclosure.
Figure 8B:
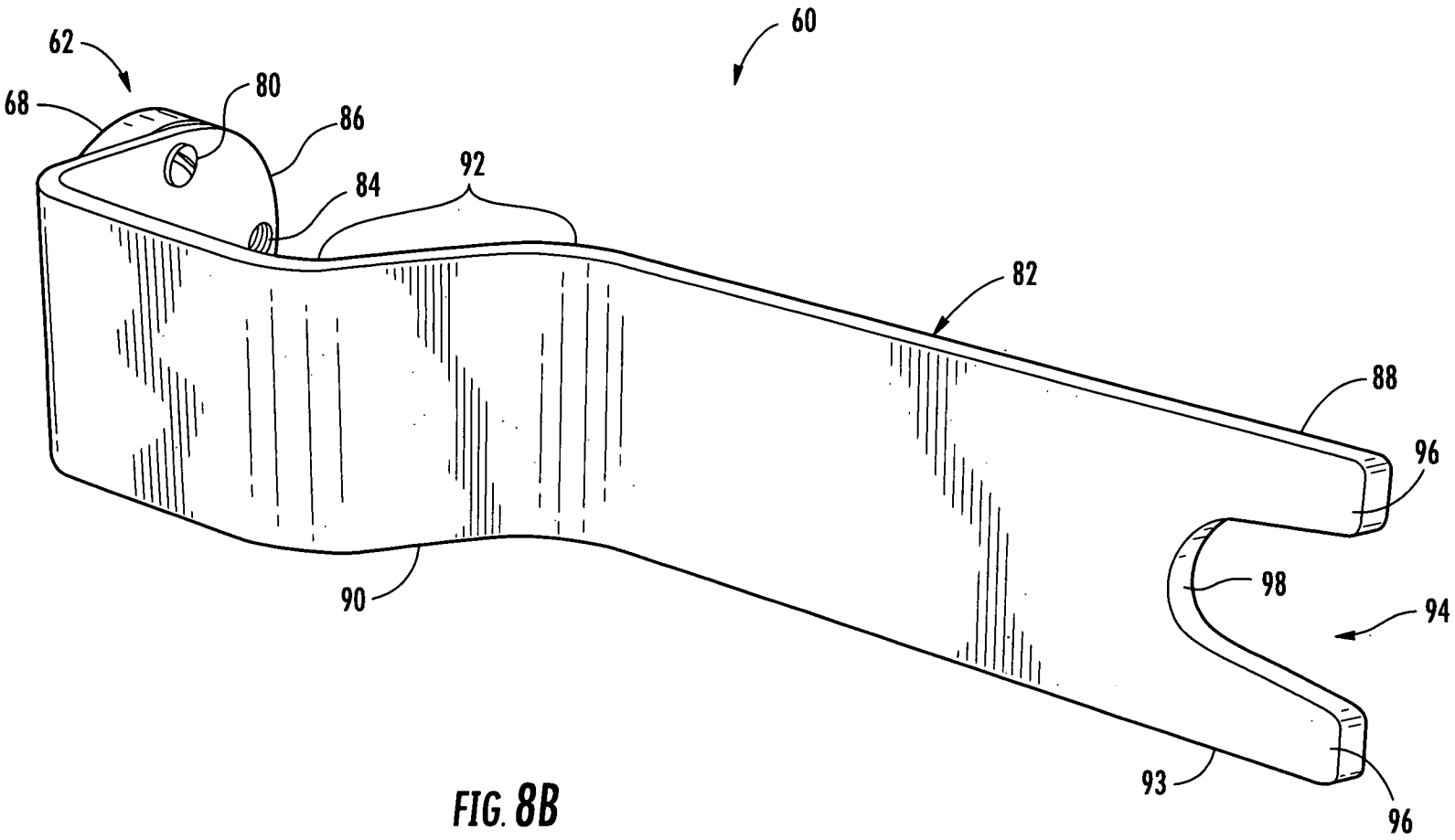
FIG. 8B is a bottom back perspective view of the device of FIG. 8A.
Figure 8C:
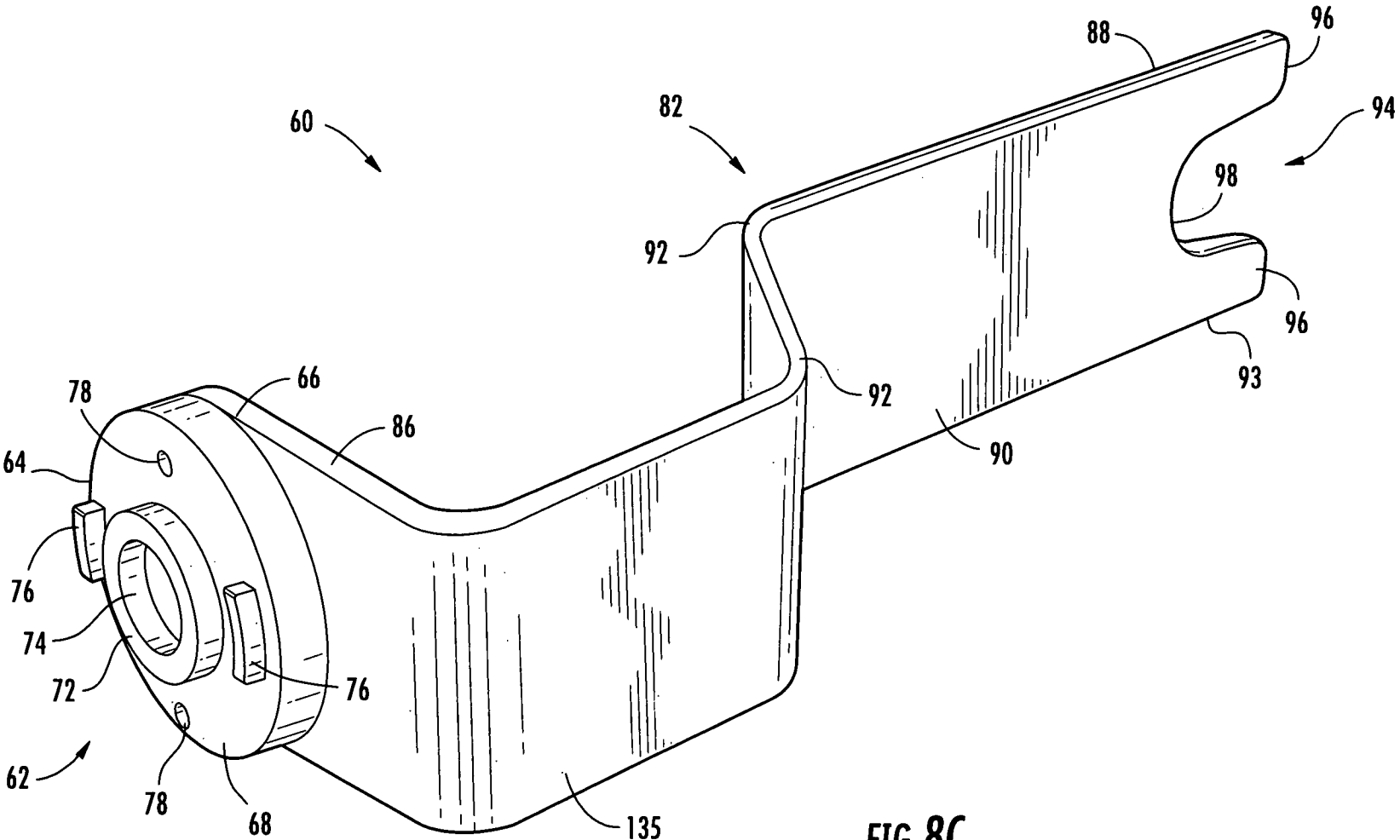
FIG. 8C is a front perspective view of the device of FIG. 8A.
Figure 8D:
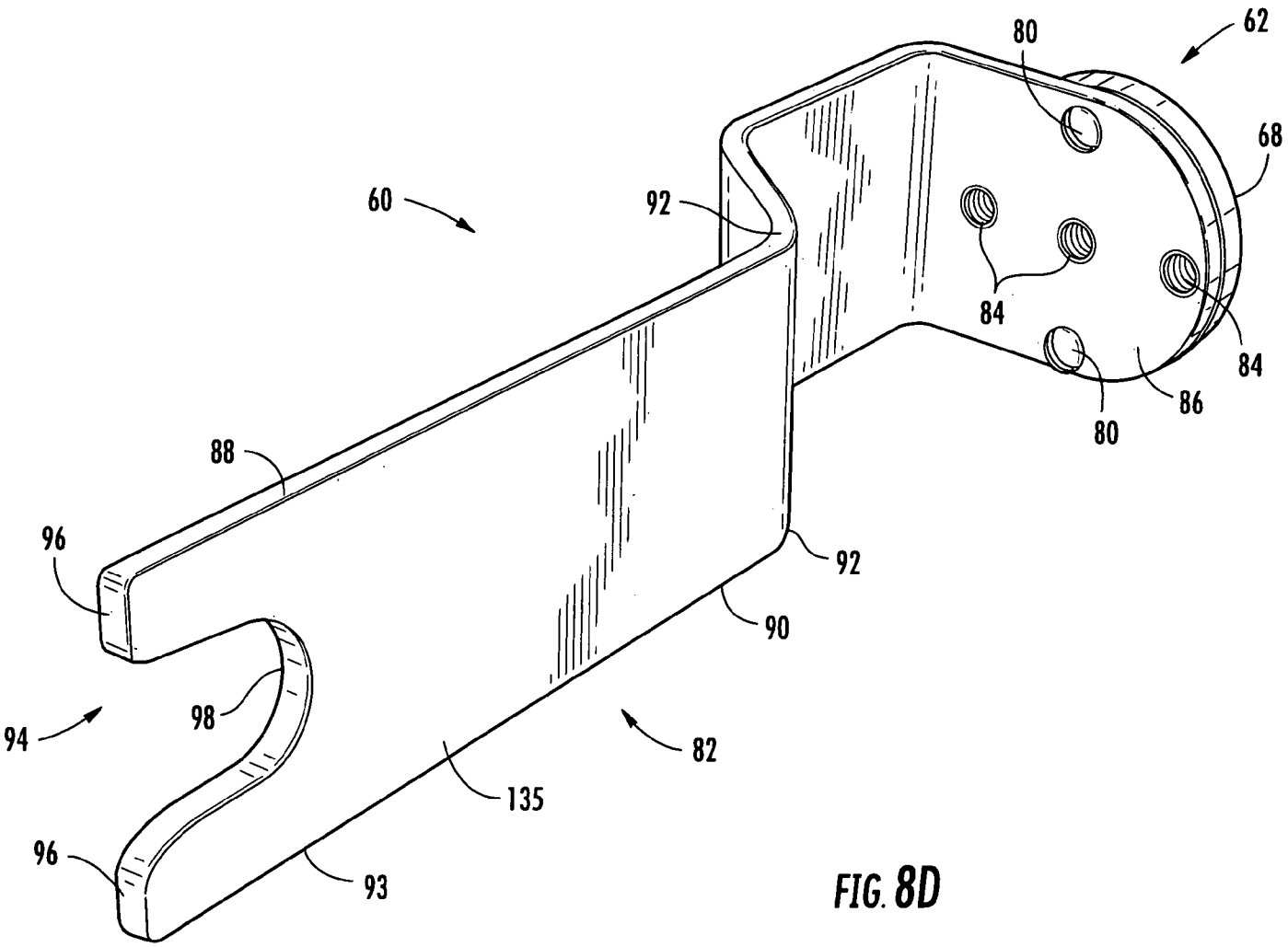
FIG. 8D is a back perspective view of the device of FIG. 8A.

FIGS. 8A-8D show various views of the first embodiment of the device 60. FIG. 8A is a top front perspective view of the first embodiment of the device 60. FIG. 8A shows the first portion 62 comprising the hub assembly engagement end 68, the circular raised flange 72, the curved raised flanges 76, and the fastener receiving openings 78. FIG. 8A further shows the second portion 82 comprising the first end 86 and the second end 88, the handle portion 90, the angled portions 92, and the hub assembly extraction end 93 comprising the U-shaped fork portion 94 with the tines 96 and the central U-shaped portion 98. FIG. 8B is a bottom back perspective view of the device 60 of FIG. 8A. FIG. 8B shows the first portion 62 comprising the hub assembly engagement end 68 and shows fastener 80 attaching the first portion 62 to the second portion 82. FIG. 8B further shows the second portion 82 comprising the first end 86 with the fastener receiving threaded opening 84, the second end 88, the handle portion 90, the angled portions 92, and the hub assembly extraction end 93 comprising the U-shaped fork portion 94 with the tines 96 and the central U-shaped portion 98. FIG. 8C is a front perspective view of the device 60 of FIG. 8A. FIG. 8C shows the first portion 62 with the first end 64 and the second end 66, the first portion 62 comprising the hub assembly engagement end 68, the circular raised flange 72, the curved raised flanges 76, and the fastener receiving openings 78. FIG. 8A further shows the second portion 82 comprising the first end 86 and the second end 88, the handle portion 90, the angled portions 92, and the hub assembly extraction end 93 comprising the U-shaped fork portion 94 with the tines 96 and the central U-shaped portion 98. FIG. 8D is a back perspective view of the device 60 of FIG. 8A. FIG. 8D shows the first portion 62 comprising the hub assembly engagement end 68 and shows fasteners 80 attaching the first portion 62 to the second portion 82. FIG. 8D further shows the second portion 82 comprising the first end 86 and the second end 88, the fastener receiving threaded openings 84, the handle portion 90, the angled portions 92, and the hub assembly extraction end 93 comprising the U-shaped fork portion 94 with the tines 96 and the central U-shaped portion 98.

Figure 9A:
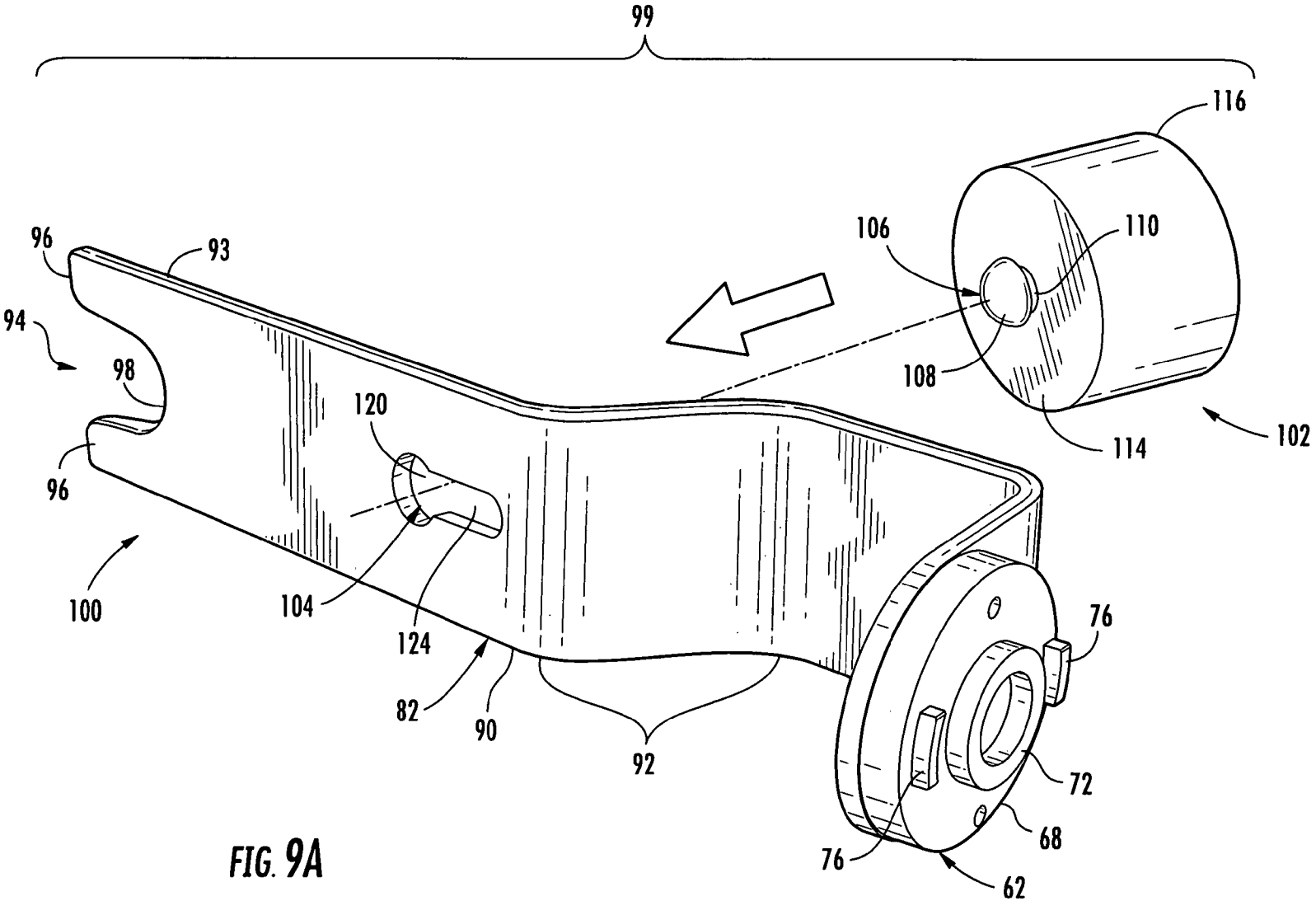
FIG. 9A is a top front perspective view of a second embodiment of a device of the disclosure having a slotted opening.
Figure 21A:
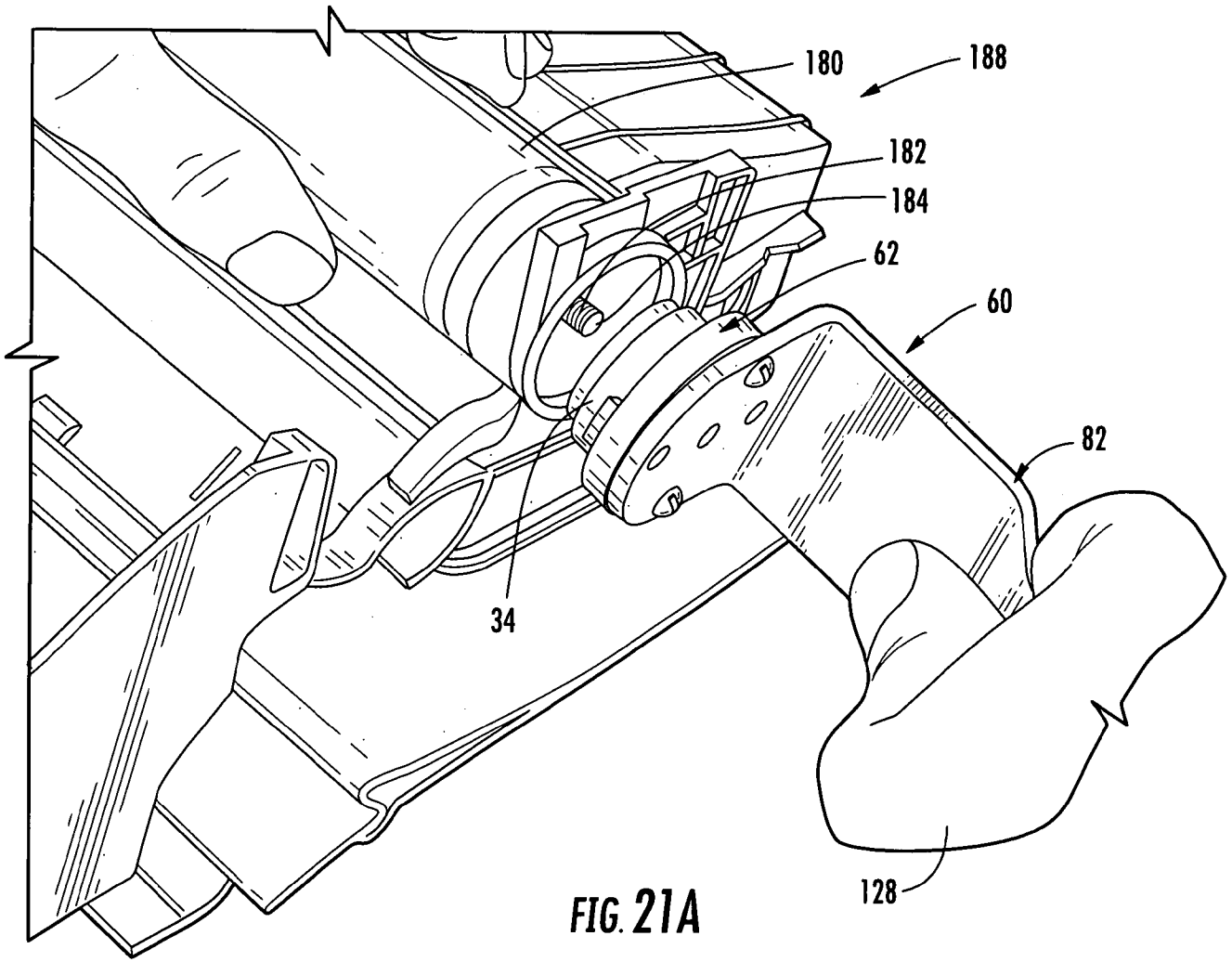
FIGS. 21A-21C are perspective views of the first embodiment of the device in use in one of the embodiments of a method of installation of an OPC drum of a known printer cartridge.
Figure 21B:
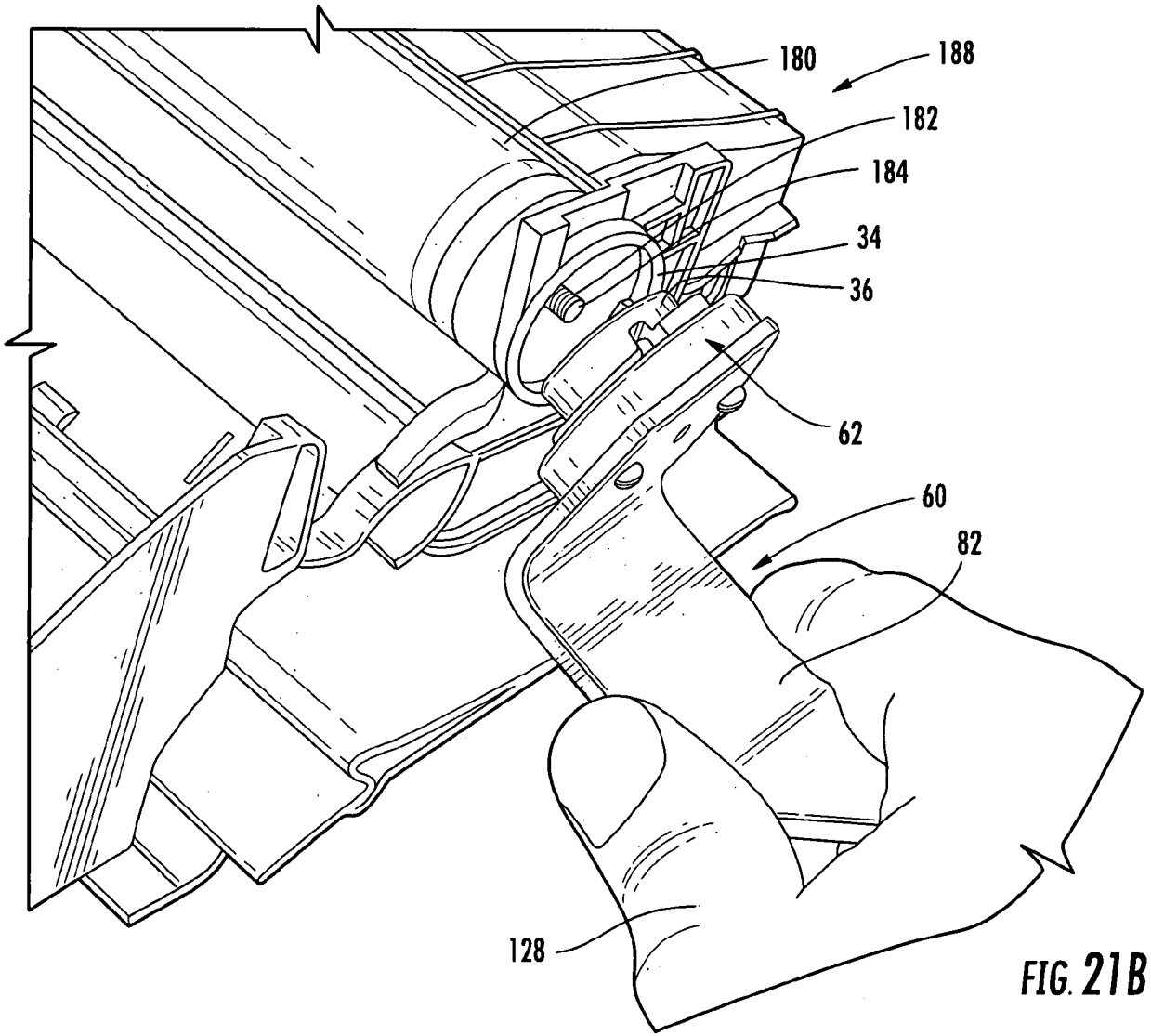
Figure 21C:
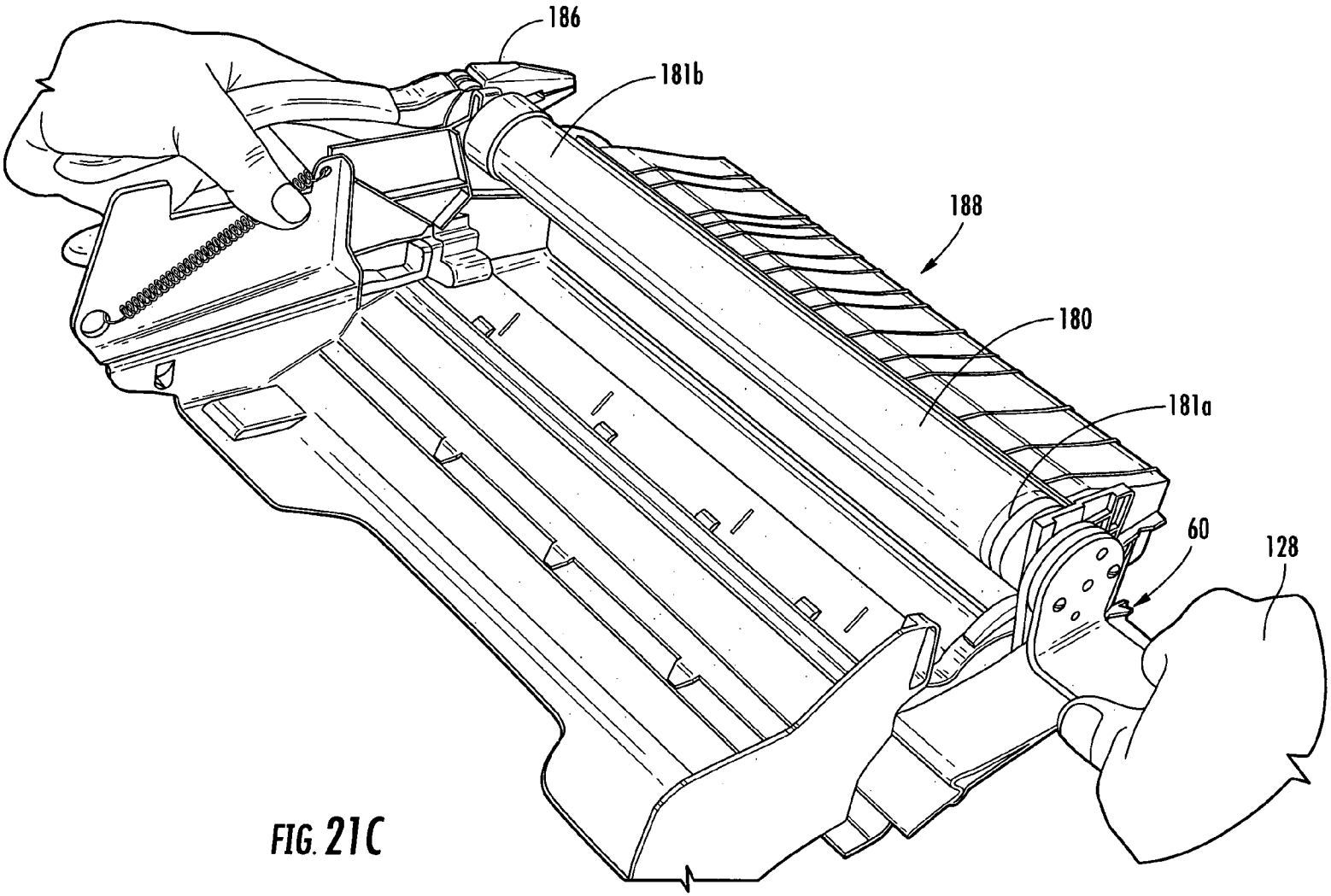

FIGS. 9A-10D show a second embodiment of an assembly 99 comprising a device 100 having a drum axle stop element 101 for use during installation of a replacement OPC drum 180 (see FIG. 21B). FIG. 9A is a top front perspective view of the second embodiment of the device 100. The drum axle stop element 101 is preferably in the form of a drum axle alignment adaptor 102 to assist during installation of the replacement OPC drum 180. The device 100 is identical to device 60 or tool 61, discussed above, except that the device 100 includes a slotted opening 104 formed in the handle portion 90 of the second portion 62. The slotted opening 104 comprises an enlarged portion 120 and a narrow portion 124. The device 100 comprises the first portion 62 comprising the hub assembly engagement end, the circular raised flange 72, and the curved raised flanges. The device 100 further comprises the second portion 82 comprising the handle portion 90, the angled portions 92, and the hub assembly extraction end 93 comprising the U-shaped fork portion 94 with the tines 96 and the central U-shaped portion 98. As shown in FIG. 9A, the adaptor 102 comprising a first end 114 and a second end 116. The adaptor 102 further comprises a retaining pin 106 having a head 108 and a shaft 110 and the retaining pin 106 is attached to the first end 114.

Figure 10B:
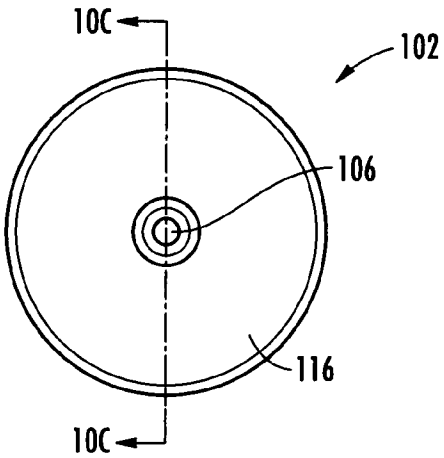
FIG. 10B is a bottom view of the adaptor of FIG. 10A.
Figure 10D:
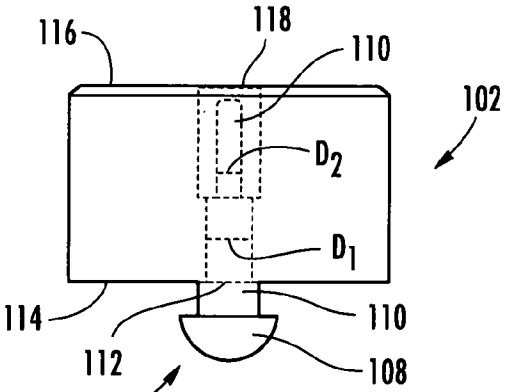
FIG. 10D is a side view of the adaptor of FIG. 10A.
Figure 10A:
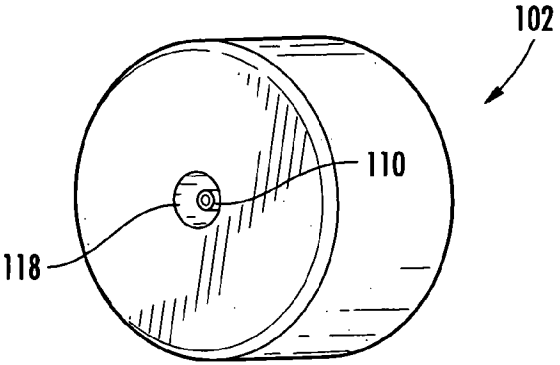
FIG. 10A is a bottom perspective view of an adaptor used with the device of FIG. 9A.
Figure 10C:
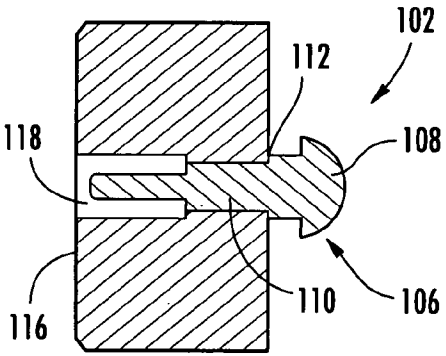
FIG. 10C is a cross-sectional view taken along lines 10C-10C of FIG. 10B.

The adaptor 102 is more particularly shown in FIGS. 10A-10D. FIG. 10D is a side view of the adaptor 102 of FIG. 10A. As shown in FIG. 10D, the adaptor 102 comprises a retaining pin 106 having a head 108 and a shaft 110 that may have a first larger diameter $D_1$ and a second smaller diameter $D_2$, as shown in FIG. 10D. In another embodiment, the shaft 110 may have a uniform diameter. The retaining pin 106 may be inserted into and retained in an interior opening 112 that runs from a first end 114 of the adaptor 102 through to a second end 116 of the adaptor 102. At the second end 116 there is preferably an internal spaced area 118 between the exterior shaft 110 of the retaining pin 106 having the second smaller diameter $D_2$ and the interior surface of the interior opening 112 of the retaining, pin 106, such that the interior opening 112 may be configured to receive a second end 190 (see FIG. 24G) of a replacement OPC drum axle 182 (see FIG. 24G) of the replacement OPC drum 180 (see FIG. 24G) during installation of the replacement OPC drum 180. FIG. 10A is a bottom perspective view of the adaptor 102 used with the device 100 of FIG. 9A. FIG. 10A shows the shaft 110 of the retaining pin and the internal spaced area 118 of the adaptor 102. FIG. 10B is a bottom view of the adaptor 102 of FIG. 10A. FIG. 10B shows the retaining pin 106 and the second end 116 of the adaptor. FIG. 10C is a cross-sectional view taken along lines 10C-10C of FIG. 10B. FIG. 10C shows the retaining pin 106 comprising the head 108 and the shaft 110 inserted into the interior opening 112 at the first end 114 of the adaptor 102 and through the interior of the adaptor 102 and within the internal space area 118 at the second end 116 of the adaptor 102.

Figure 9B:
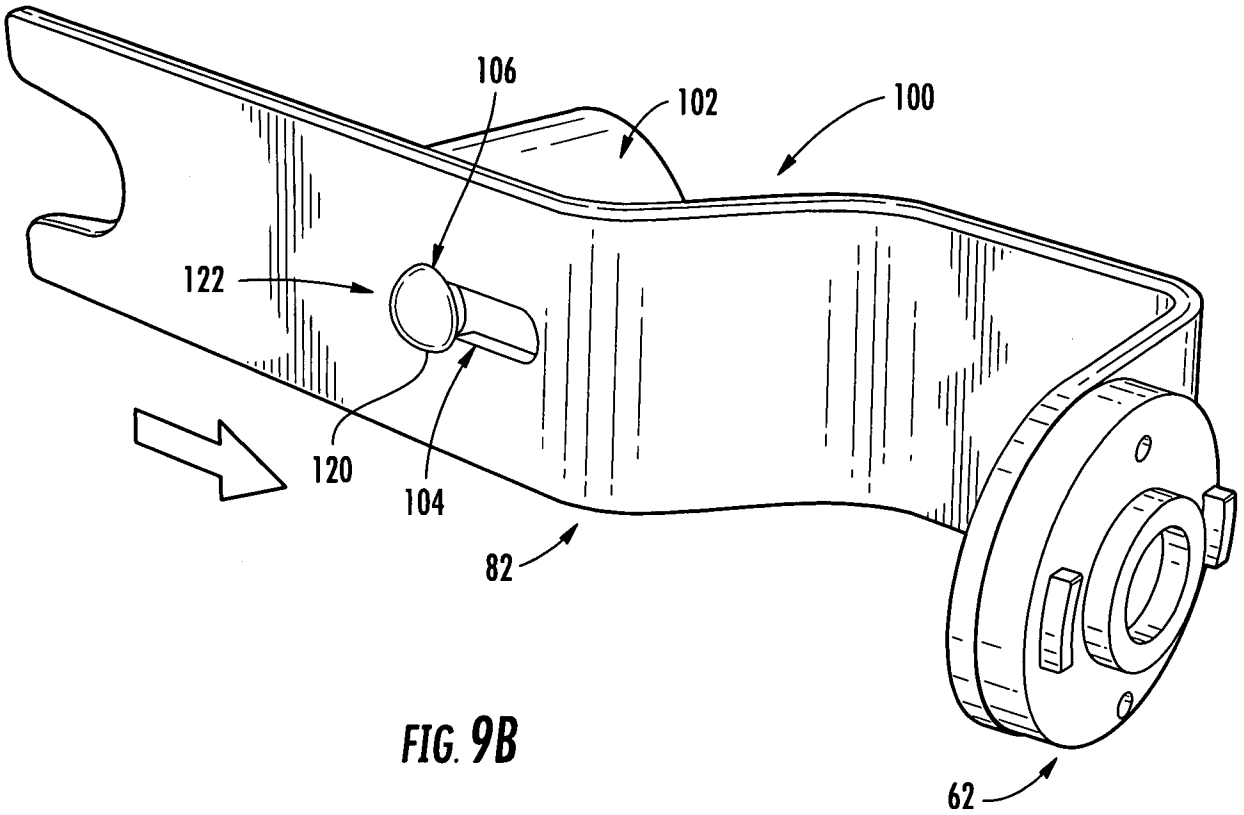
FIG. 9B is a top front perspective of the device of FIG. 9A in a first engagement position.
Figure 9C:
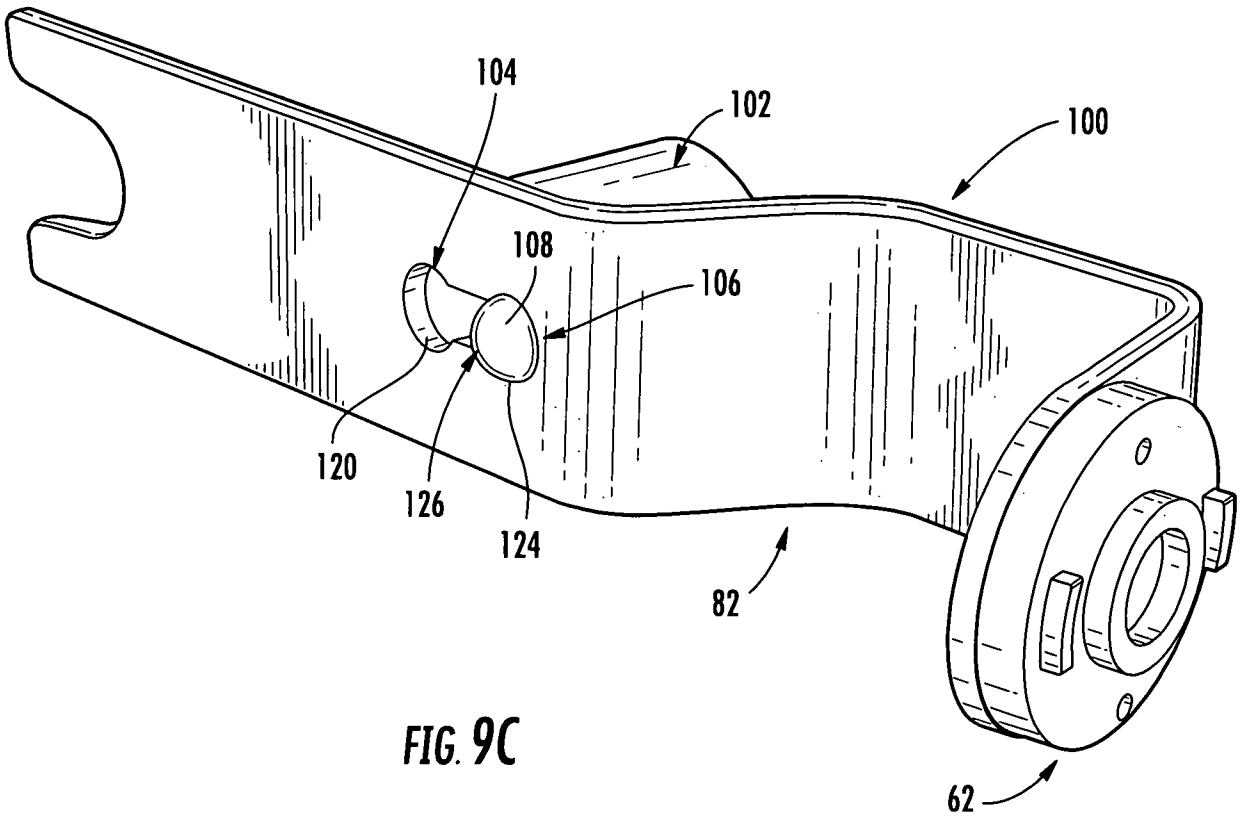
FIG. 9C is a top front perspective view of the device of FIG. 9A in a second locking position.
Figure 9D:
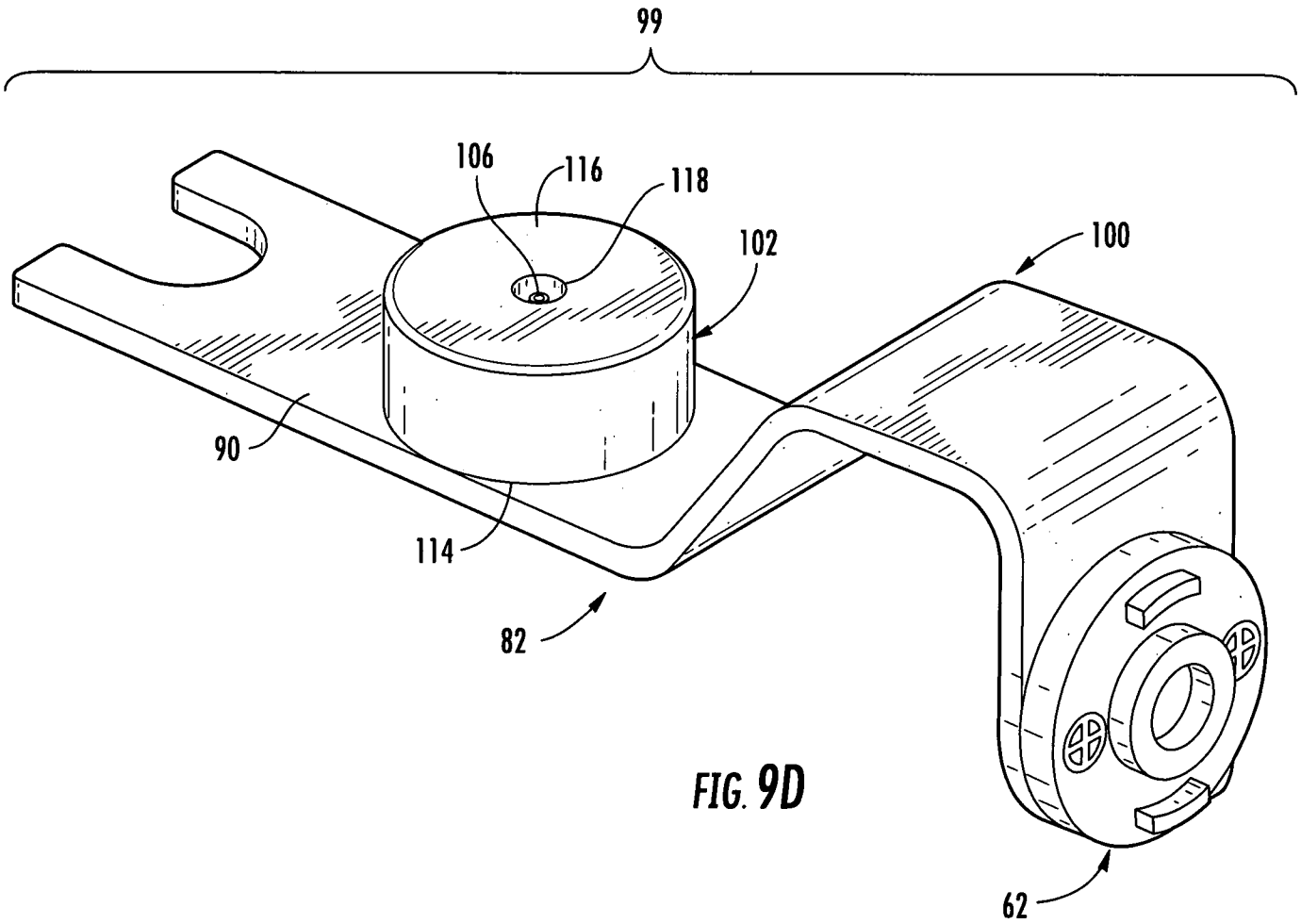
FIG. 9D is a bottom front perspective view of the device of FIG. 9C.

FIG. 9B is a top front perspective view of the device 100 of FIG. 9A in a first engagement position 122. When the adaptor 102 is attached to the second portion 82, the head 108 of the retaining pin 106 is first inserted into the enlarged portion 120 of the slotted opening 104 in the first engagement position 122. FIG. 9C is a top front perspective view of the device 100 of FIG. 9A in a second locking position 126. The shaft 110 and head 108 of the retaining pin 106 slides from the enlarged portion 120 along the narrow portion 124 of the slotted opening 104 to the second locking position 126. FIG. 9D is a bottom front perspective view of the assembly 99 comprising the device 100 and the adaptor 102 of FIG. 9C showing the retaining pin 106 within the internal spaced area 118 of the adaptor 102. The first end 114 of the adaptor 102 is adjacent the handle portion 90 of the second portion 82 of the device 100, and the second end 116 is away from the handle portion 90.

Figure 11:
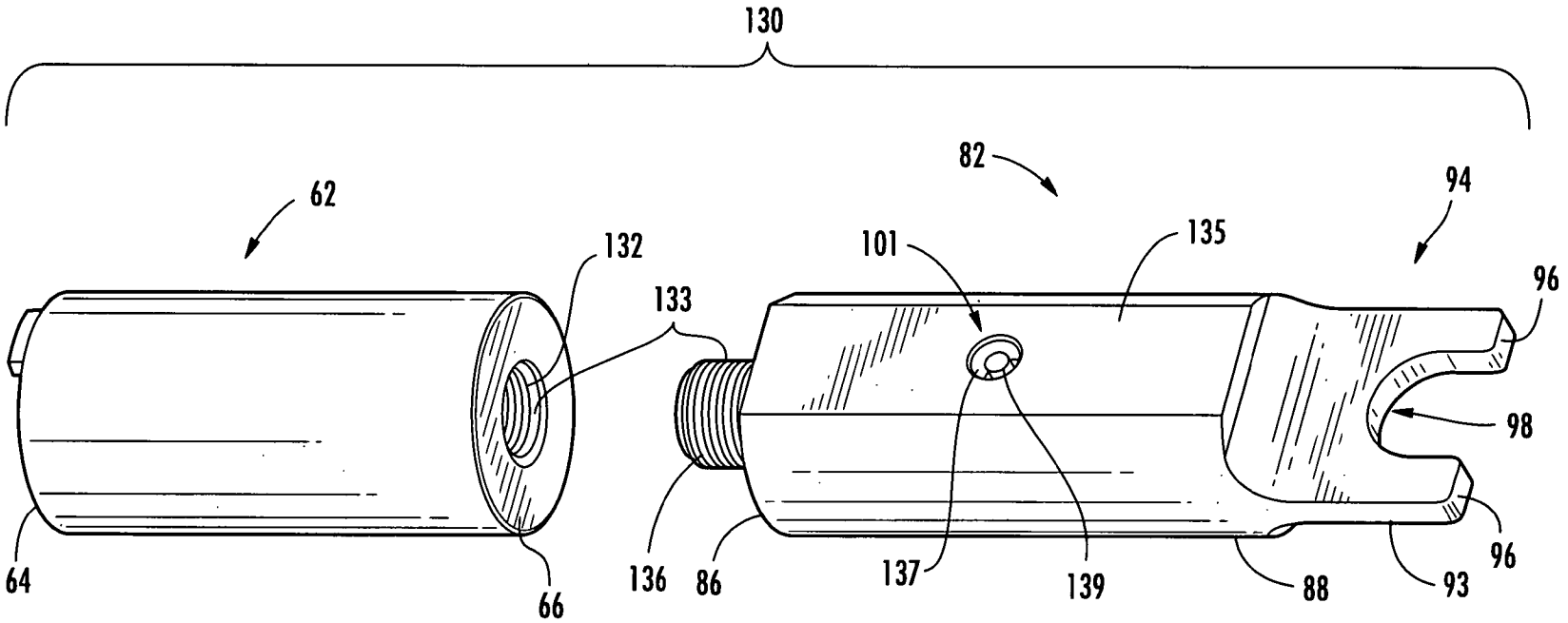
FIG. 11 is a top front perspective view of a third embodiment of a device of the disclosure showing a first portion and a second portion of the device separated and having a threaded shaft and threaded opening connector.
Figure 12:
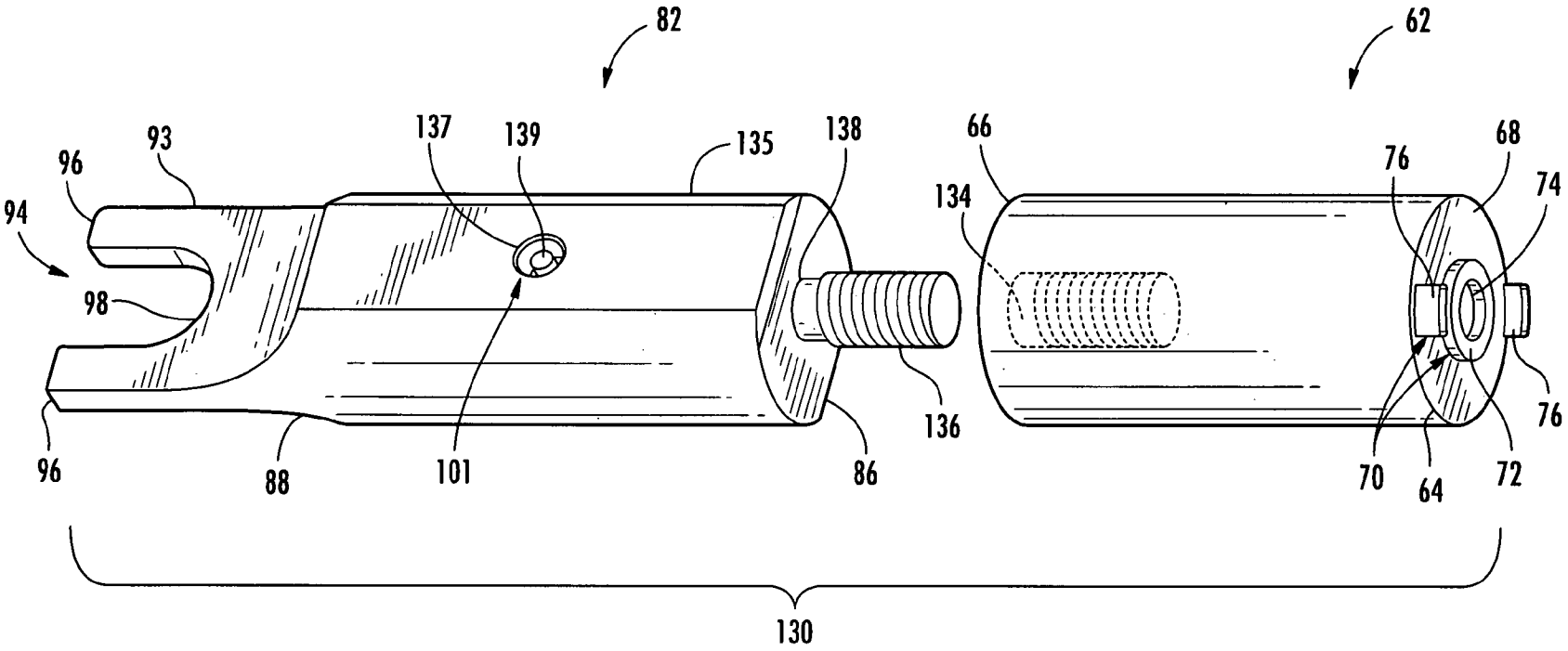
FIG. 12 is a top back perspective view of the device of FIG. 11.

FIG. 11 is a top front perspective view of a third embodiment of a device 130 of the disclosure. Preferably, the device 130 is in the form of a connected or unitary tool 131 (see FIG. 15A). The device 130 or tool 131 may be made of a material comprising stainless steel, aluminum, brass, acrylic, resilient plastic, a mixture thereof, or another suitable metal or plastic material. FIG. 12 is a top back perspective view of the device 130 of FIG. 11. As shown in FIGS. 11-12, the device 130 has a first portion 62 having a first end 64 and a second end 66. Preferably, the first portion 62 in this embodiment is cylindrically shaped. However, the first portion 62 may also have other suitable shapes. Preferably, the first end 64 is a hub assembly engagement end 68 having one or more raised flanges 70. The raised flanges 70 may comprise a circular raised flange 72 and one or more slightly curved raised flanges 76. In this embodiment the first portion 62 is preferably connected to the second portion 82 with a threaded shaft and threaded opening connector assembly 133 (see FIG. 11). The threaded shaft and threaded opening connector assembly 133 comprises a threaded shaft 136 extending from a central portion 138 (see FIG. 12) of the first end 86 and adapted for screw insertion into a corresponding threaded opening 132 (see FIG. 11) within an interior portion 134 (see FIG. 12) of the first portion 62.

Figure 13B:
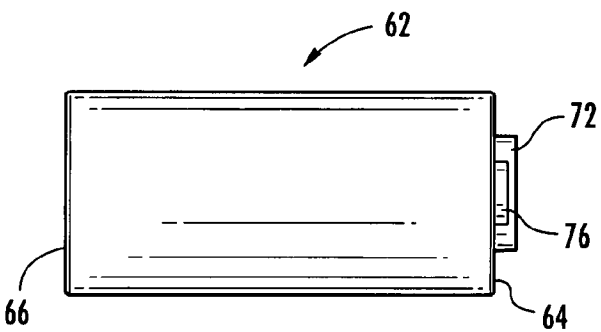
FIG. 13B is a top view of the first portion of FIG. 13A.
Figure 13A:
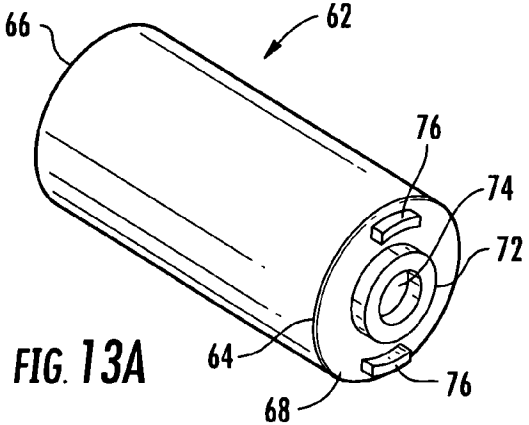
FIG. 13A is a top back perspective view of a first portion of the device of FIG. 12.
Figure 13E:
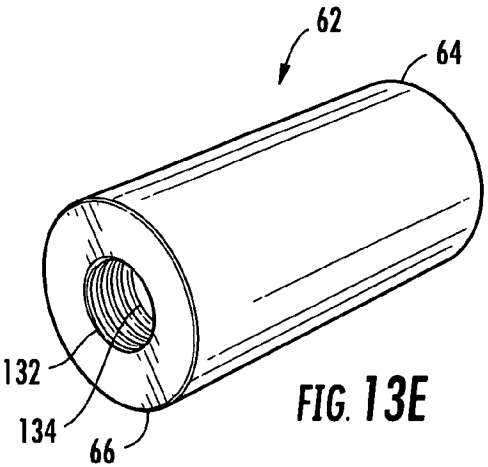
FIG. 13E is a top front perspective view of the first portion of FIG. 13A.
Figure 13D:
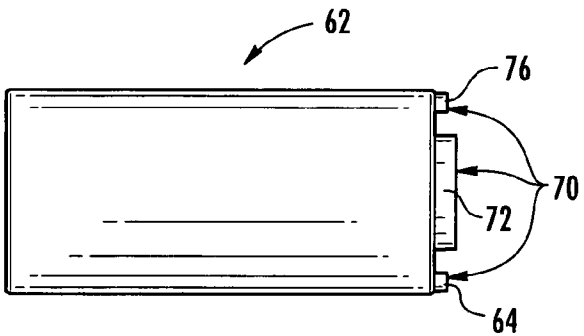
FIG. 13D is a side view of the first portion of FIG. 13A.
Figure 13C:
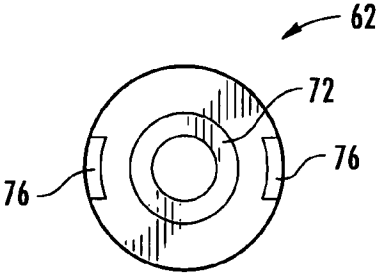
FIG. 13C is a back view of the first portion of FIG. 13A.

FIG. 13A is a top back perspective view of the first portion 62 of the device 130 of FIG. 12. FIG. 13A shows the first end 64 and the second end 66 of the first portion 62. The first end 64 comprises the hub assembly engagement end 68 with the circular raised flange 72, the central portion 74, and the curved raised flanges 76. FIG. 13B is a top view of the first portion 62 of FIG. 13A. FIG. 13B shows the first end 64 of the first portion 62 with the circular raised flange 72 and the curved raised flange 76, and shows the second end 66 of the first portion 62. FIG. 13C is a back view of the first portion 62 of FIG. 13A. FIG. 13C shows the circular raised flange 72 and the curved raised flanges 76. FIG. 13D is a side view of the first portion 62 of FIG. 13A. FIG. 13D shows the raised flanges 70 of the first end 64 of the first portion 62*a* where the raised flanges 70 comprise the circular raised flange 72 and the curved raised flanges 76. FIG. 13E is a top front perspective view of the first portion 62 of FIG. 13A. FIG. 13E shows the first end 64 and the second end 66 of the first portion 62. The second end 66 shows the threaded opening 132 and the interior portion 134 of the first portion 62.

The device 130 of FIGS. 11-12 further comprises a second portion 82 having a first end 86 and a second end 88. FIG. 14A is a top perspective view of the second portion 82 of the device 130 of FIG. 12. FIG. 14A shows the first end 86 of the second portion 82 with the threaded shaft 136 extending from the central portion 138. FIG. 14A further shows the second end 88 comprising the hub assembly extraction end 93. The hub assembly extraction end 93 comprises the U-shaped fork portion 94 with tines 96 and central U-shaped portion 98. FIG. 14A further shows the flat surface portion 135 having a drum axle stop element 101 (see also FIG. 12). Preferably, the drum axle stop element 101 comprises an opening 137 with a recessed pin 139 configured to engage the second end 190 (see FIG. 24G) of the replacement OPC drum axle 182 (see FIG. 24G) opposite the hub assembly 32 (see FIG. 22E). The second portion 82 may further comprise a drum axle stop element 101 (see FIG. 14C). The drum axle stop element 101 preferably comprises an opening 137 with a recessed pin 139 configured to engage the second end 190 of the replacement OPC drum axle 182 opposite the hub assembly 32 (see FIG. 11). The opening 137 with the recessed pin 139 may be formed in one of the flat surface portions 135.

Figure 14B:
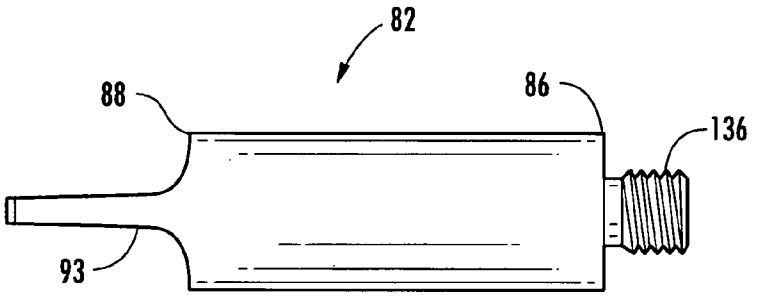
FIG. 14B is a side view of the second portion of FIG. 14A.
Figure 14E:
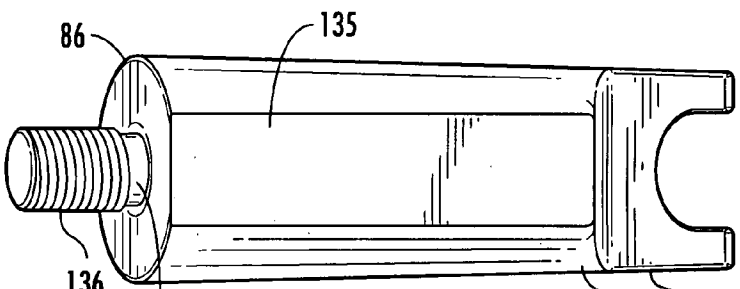
FIG. 14E is a bottom view of the second portion of FIG. 14A.
Figure 14D:
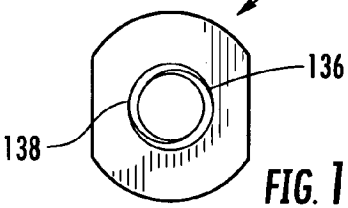
FIG. 14D is a back view of the second portion of FIG. 14A.
Figure 14A:
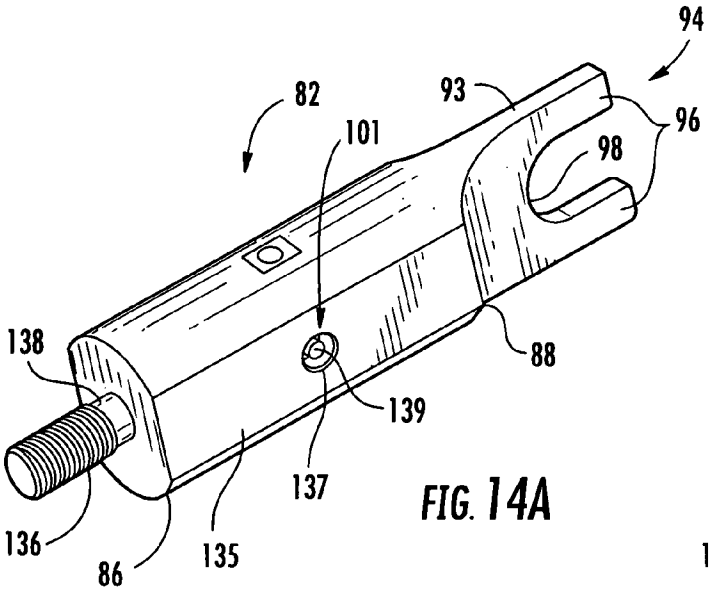
FIG. 14A is a top back perspective view of a second portion of the device of FIG. 12.
Figure 14C:
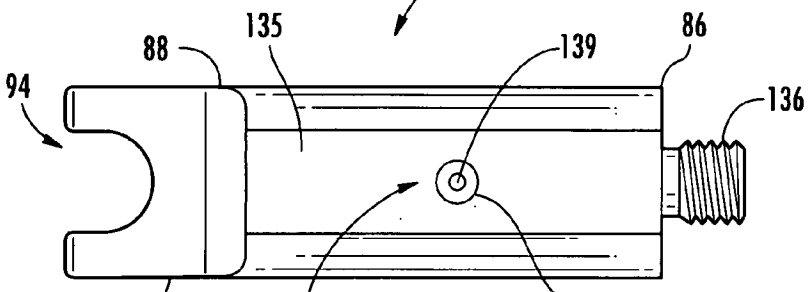
FIG. 14C is a top view of the second portion of FIG. 14A.

FIG. 14B is a side view of the second portion 82 of FIG. 14A. FIG. 14B shows the first end 86 of the second portion 82 with the threaded shaft 136 and shows the second end 88 comprising the hub assembly extraction end 93. FIG. 14C is a top view of the second portion 82 of FIG. 14A. FIG. 14C shows the first end 86 of the second portion 82 with the threaded shaft 136, shows the second end 88 comprising the hub assembly extraction end 93 having the U-shaped fork portion 94, and shows the flat surface portion 135 with opening 137 and recessed pin 139. FIG. 14D is a back view of the second portion 82 of FIG. 14A. FIG. 14D shows the threaded shaft 136 and opening 137 of the second portion 82. FIG. 14E is a bottom view of the second portion 82 of FIG. 14A. FIG. 14E shows the first end 86 of the second portion 82 with the threaded shaft 136 extending from the central portion 138, shows the second end 88 comprising the hub assembly extraction end 93, and shows flat surface portion 135.

Figure 20A:
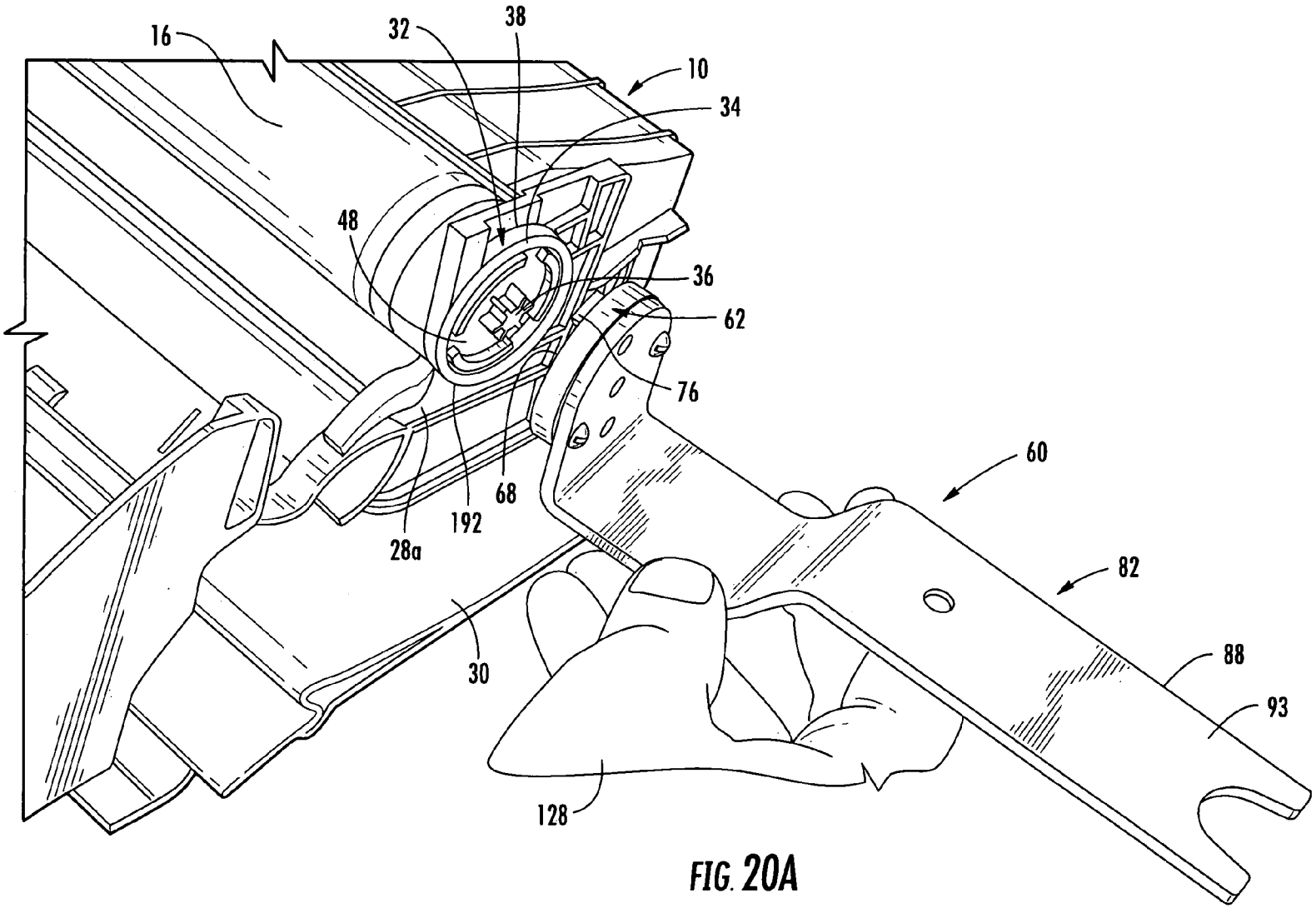
FIGS. 20A-20E are perspective views of a first embodiment of the device in use in one of the embodiments of a method of removal of an OPC drum of a printer cartridge.
Figure 20B:
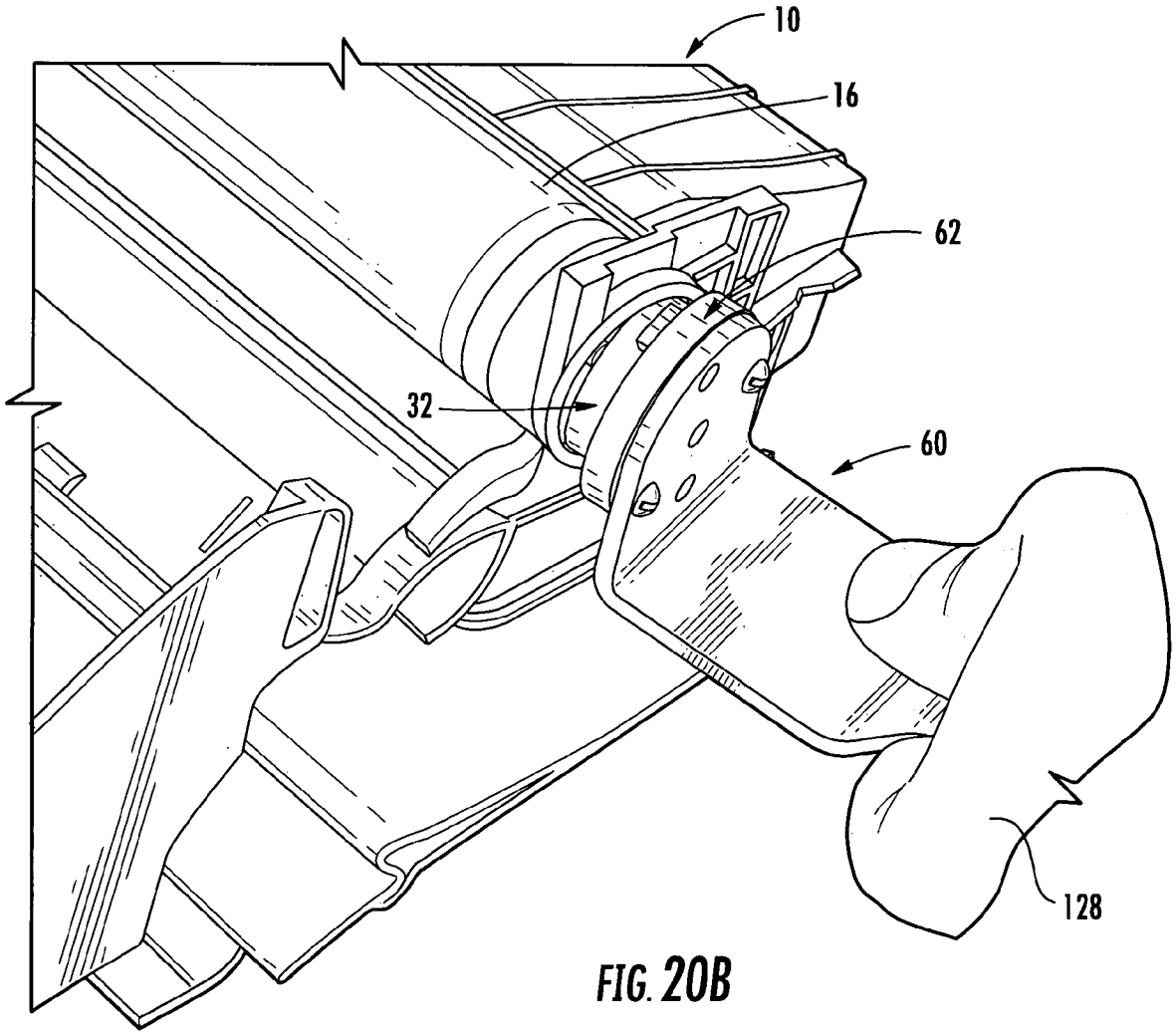
Figure 20C:
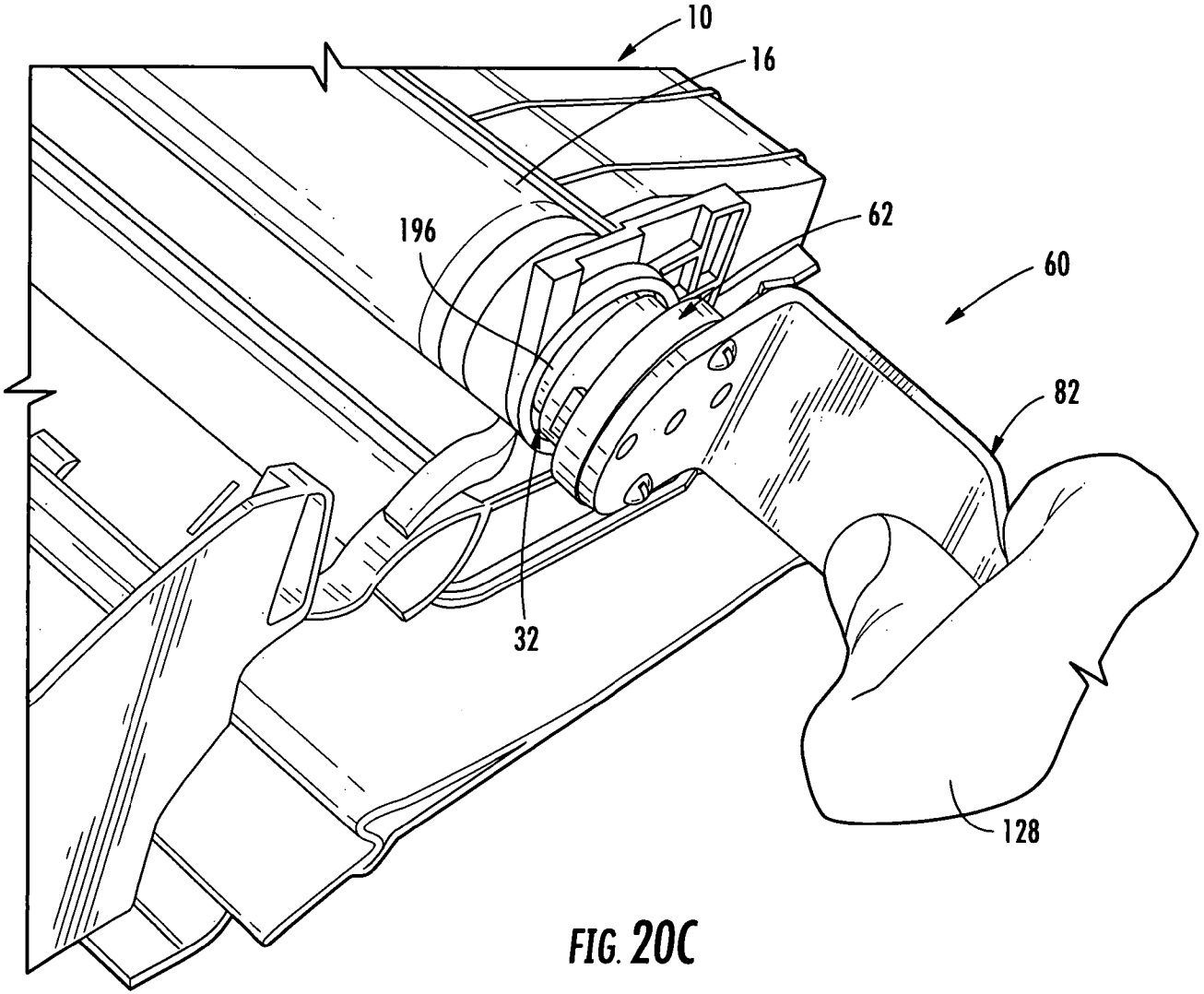
Figure 20D:
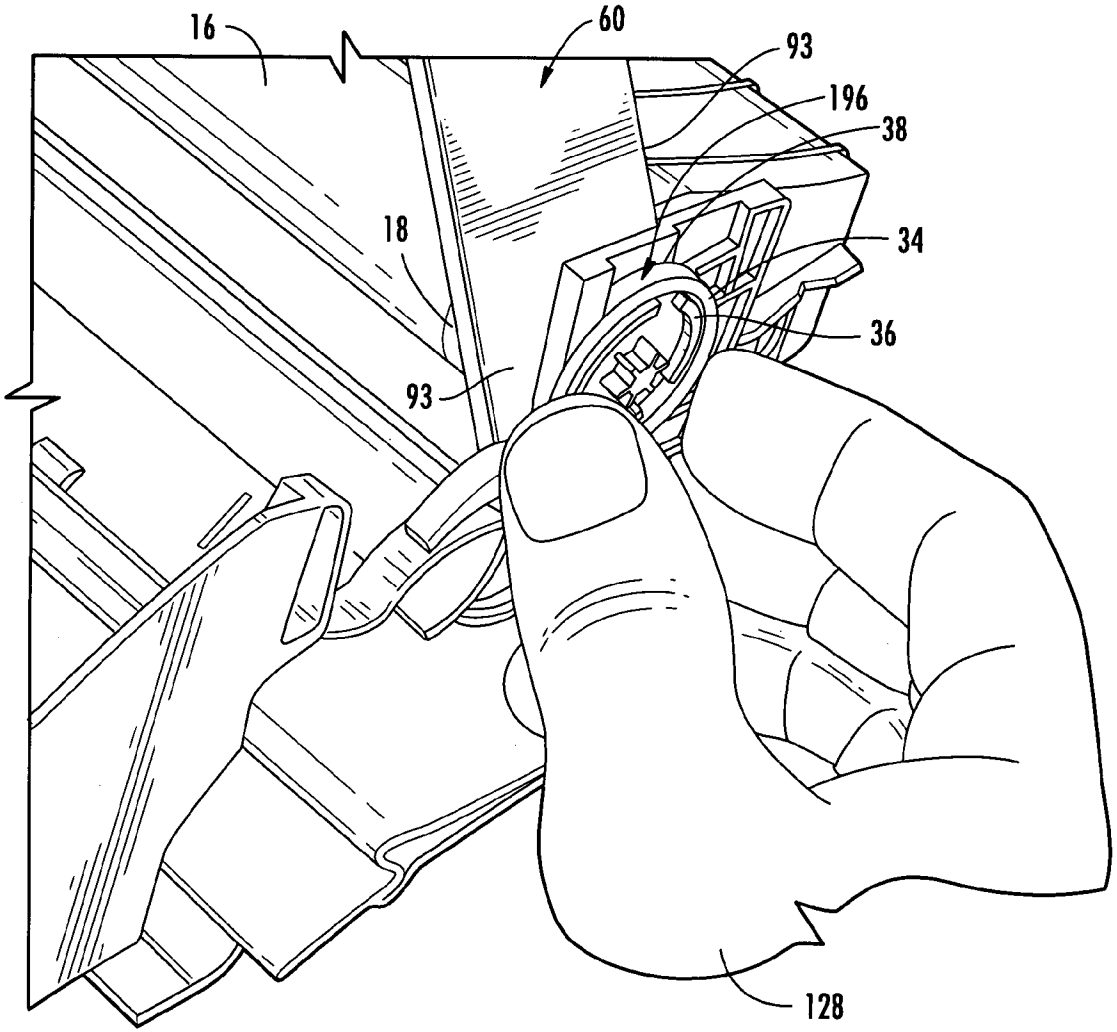

With embodiments of the device, for example, device 60 or device 130 or another suitable embodiment, the second end 88 is preferably configured to extract or remove the hub assembly 32 from the first end 24 of the drum axle 22 and from the printer cartridge 10 or remanufactured cartridge 91 when the hub assembly 32 is in an unlocked position 196 (see FIG. 20D). The second end 88 of the second portion 82 preferably comprises a hub assembly extraction end 93 comprising the U-shaped fork portion 94 having tines 96 and the central U-shaped portion 98. The U-shaped fork portion 94 of the second portion 82, preferably in the form of the hub assembly extraction end 93, is configured to fit or position within area 91 (see FIG. 20D and FIG. 22B) between the first end 18 of the OPC drum 16 and the interior of side 28*a* of the waste hopper frame 30, and during removal of the OPC drum 16, the second portion 82, preferably in the form of the hub assembly extraction end 93, acts as a hub assembly 32 extraction tool and is used to push off the hub assembly 32 from the first end 24 of the drum axle 22 and is used to push out the hub assembly 32 from the opening 38 (see FIG. 23B) in the side 28*a* of the waste hopper frame 30 of the printer cartridge 10. The second portion 82 may further comprise one or more flat surface portions 135 that allow the second portion 82, as well as the device 60 or 130 to sit flat on a surface without rolling when the second portion 82 is connected to the first portion 62. As discussed above, the second portion 82 may further comprise a drum axle stop element 101 (see FIG. 12) comprising opening 137 with recessed pin 139 configured to engage the second end 190 (see FIG. 24G) of the replacement OPC drum axle 182 (see FIG. 24G) opposite the hub assembly 32 (see FIG. 22E). The opening 137 with the recessed pin 139 may be formed in one of the flat surface portions 135.

With the device 130 shown in FIGS. 11-15C, the first portion 62 and the second portion 82 of the device 130 can be coupled or joined together by inserting the threaded shaft 136 of the second portion 82 into the threaded opening 132 of the first portion 62 and twisting and screwing the first portion 62 and the second portion 82 together until the first portion 62 and the second portion 82 are firmly connected.

Figure 15A:
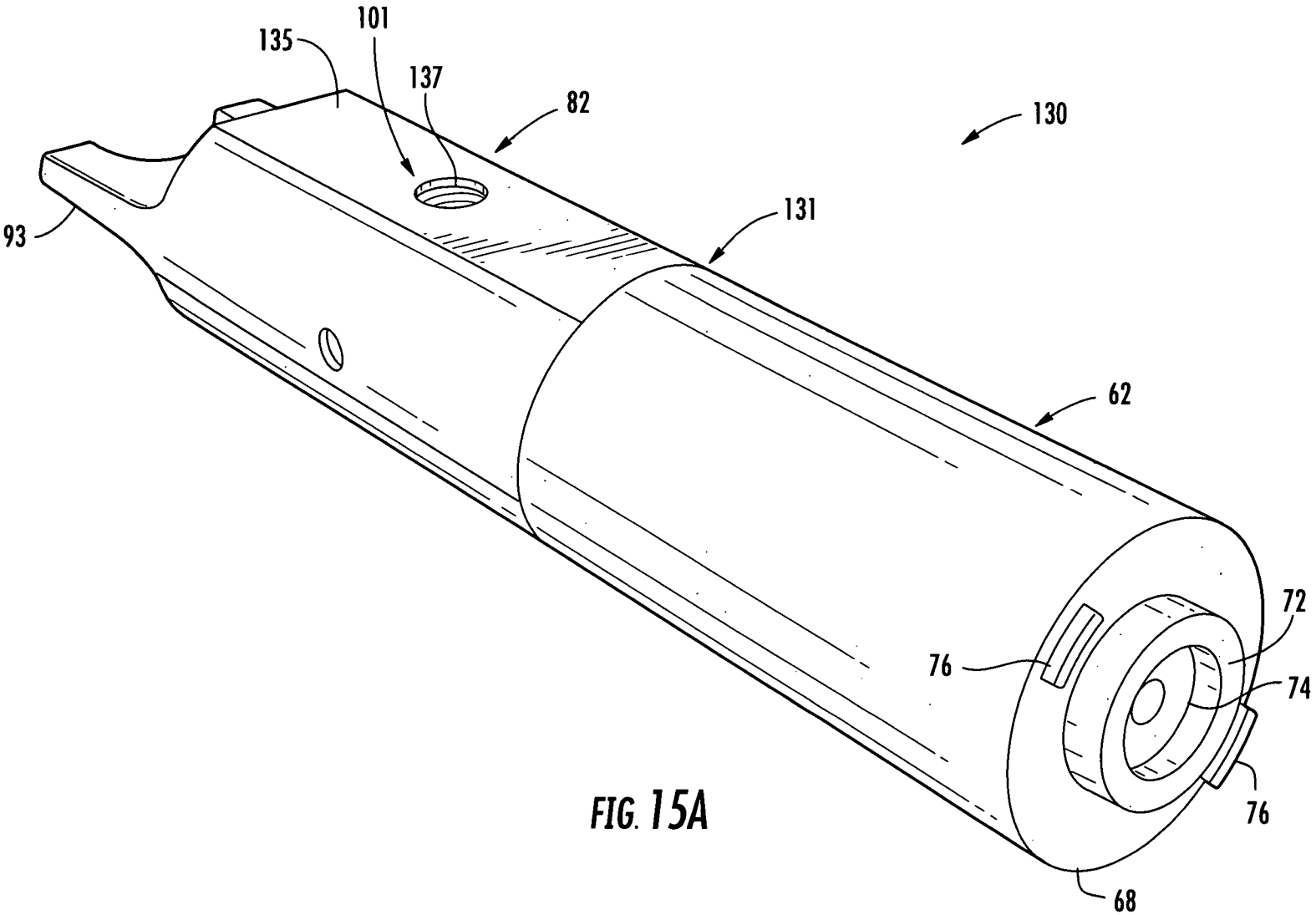
FIG. 15A is a top back perspective view of a third embodiment of a device showing a first portion and a second portion of the device connected together.
Figure 15B:
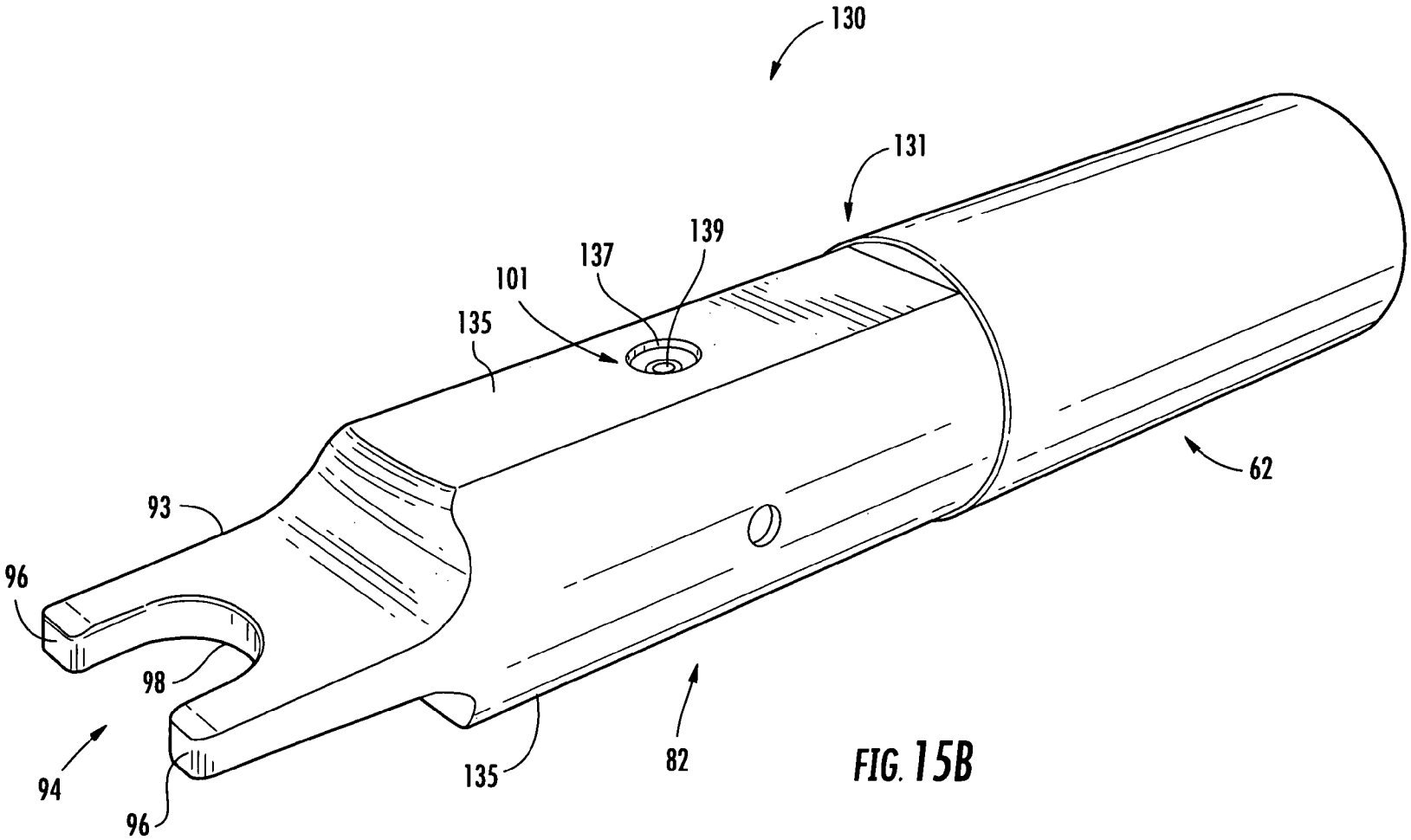
FIG. 15B is a top front perspective view of the device of FIG. 15A.
Figure 15C:
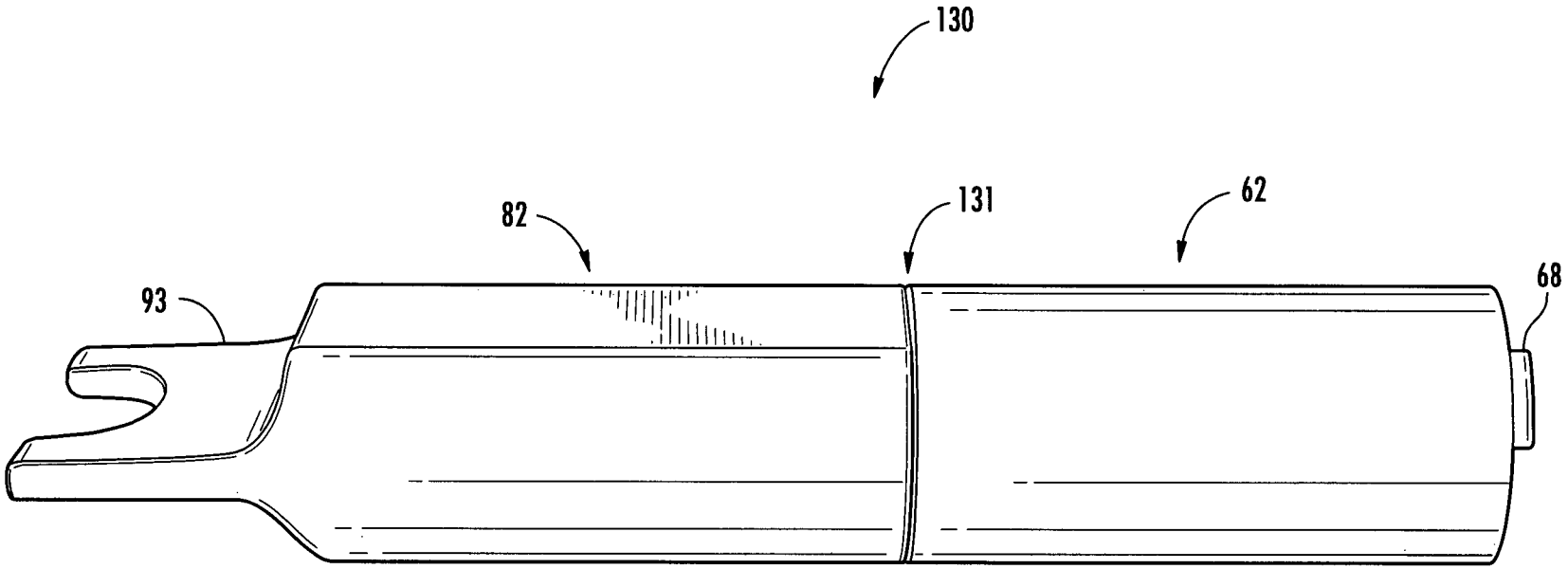
FIG. 15C is a left side perspective view of the device of FIG. 15A.

FIG. 15A is a top back perspective view of the third embodiment of the device 130 in the form of the connected or unitary tool 131 showing the first portion 62 and the second portion 82 of the device 130 connected together. FIG. 15A shows the first portion 62 with the hub assembly engagement end 68 comprising the circular raised flange 72, the central portion 74, and the curved raised flanges 76. FIG. 15A further shows the second portion 82 with the hub assembly extraction end 93 and the drum axle stop element 101 formed in the flat surface portion 135. FIG. 15B is a top front perspective view of the device 130 in the form of the connected or unitary tool 131 of FIG. 15A. FIG. 15B shows the first portion 62. FIG. 15B further shows the second portion 82 with the hub assembly extraction end 93 comprising the U-shaped fork portion 94 with tines 96 and central U-shaped portion 98. FIG. 15B further shows the drum axle stop element 101 comprising the opening 137 and recessed pin 139 formed in the flat surface portion 135. FIG. 15C is a left side perspective view of the device 130 in the form of the connected or unitary tool 131 of FIG. 15A. FIG. 15C shows the first portion 62 with the hub assembly engagement end 68. FIG. 15C further shows the second portion 82 with the hub assembly extraction end 93

Figure 16A:
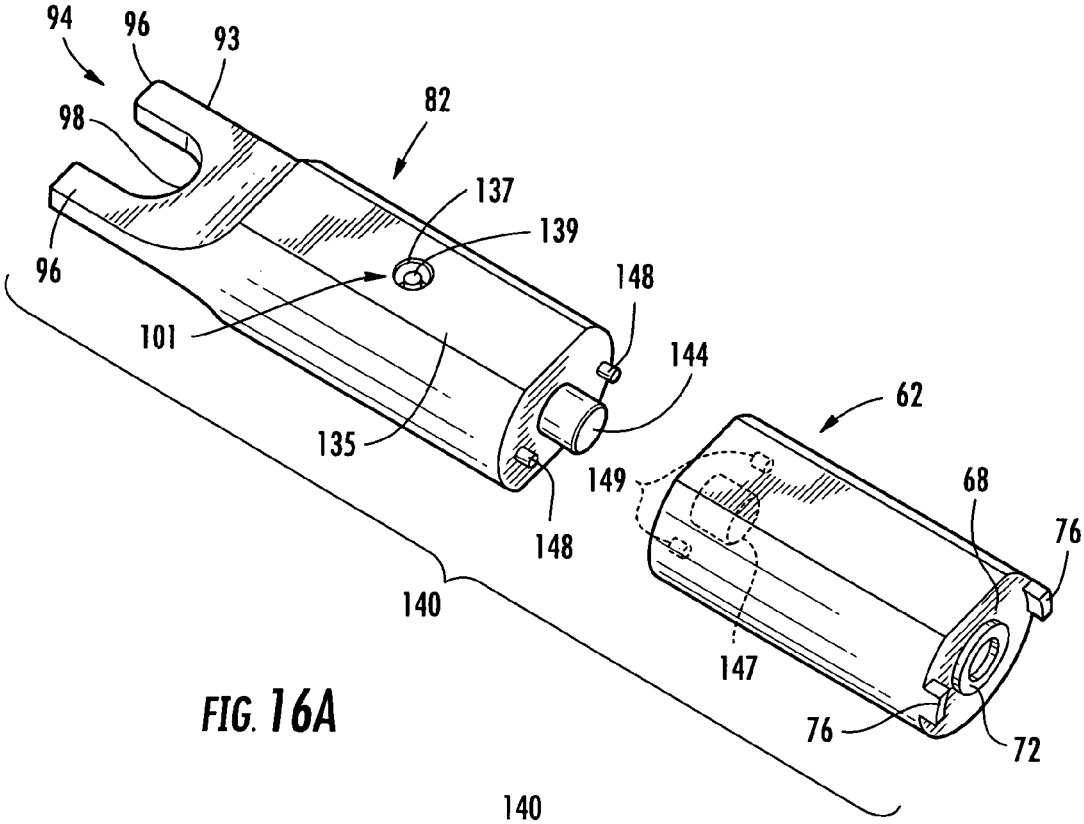
FIG. 16A is a top back perspective view of a fourth embodiment of a device having a magnet connector assembly.
Figure 16B:
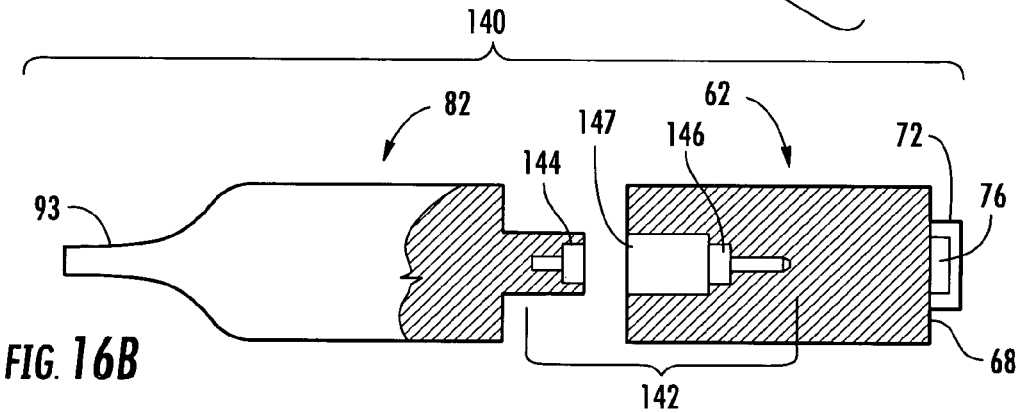
FIG. 16B is a left side view in partial cross-section of the device of FIG. 16A.
Figure 16C:
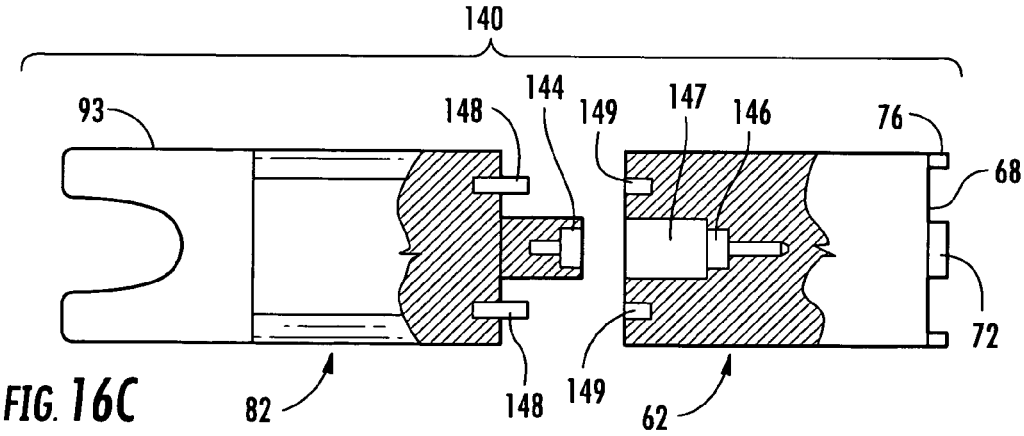
FIG. 16C is a top view in partial cross-section of the device of FIG. 16A.

FIG. 16A is a top back perspective view of a fourth embodiment of a device 140 having a magnet connector assembly 142 (see also FIG. 16B). The magnet connector assembly 142 comprises a first magnet portion 144 extending from second portion 82. The magnetic connector assembly 142 further comprises a second magnet portion 146 (see FIG. 16B) positioned within opening 147 in the first portion 62. The first magnet portion 144 is designed to attract and join together with the second magnet portion 146. The first magnet portion 144 has a magnetic pole that is opposite from a magnetic pole of the second magnet portion 146 so that the first magnet portion 144 and second magnet portion 146 may be attracted to each other and connect to each other. The second portion 82 may further comprise one or more pins 148 adapted for insertion into one or more corresponding pin holes 149 in the first portion 62. FIG. 16A further shows first portion 62 with hub assembly engagement end 68 comprising circular raised flange 72 and curved raised flanges 76. FIG. 16A further shows second portion 82 with hub assembly extraction end 93 comprising the U-shaped fork portion 94 with tines 96 and central U-shaped portion 98. FIG. 16A further shows second portion 82 with drum axle stop element 101 comprising the opening 137 and recessed pin 139 formed in the flat surface portion 135. FIG. 16B is a left side view in partial cross-section of the device 140 of FIG. 16A. FIG. 16B shows the first portion 62 with curved raised flange 76 and shows the second magnet portion 146 positioned within opening 147 in the first portion 62. FIG. 16B further shows second portion 82 with hub assembly extraction end 93 and first magnet portion 144. FIG. 16C is a top view in partial cross-section of the device 140 of FIG. 16A. FIG. 16C shows the first portion 62 with hub assembly engagement end 68 and shows the second magnet portion 146 positioned within opening 147 and corresponding pin holes 149 in the first portion 62. FIG. 16C further shows second portion 82 with hub assembly extraction end 93, first magnet portion 144, and pins 148.

In an alternate embodiment, the magnet connector assembly 142 may comprise a magnet and a metal member (not shown). Instead of two magnets, either the first magnet portion 144 or the second magnet portion 146 may be replaced with a metal member, such as a screw made of iron, steel or another suitable metal, and the one magnet forms a connection with the metal member.

Figure 17:
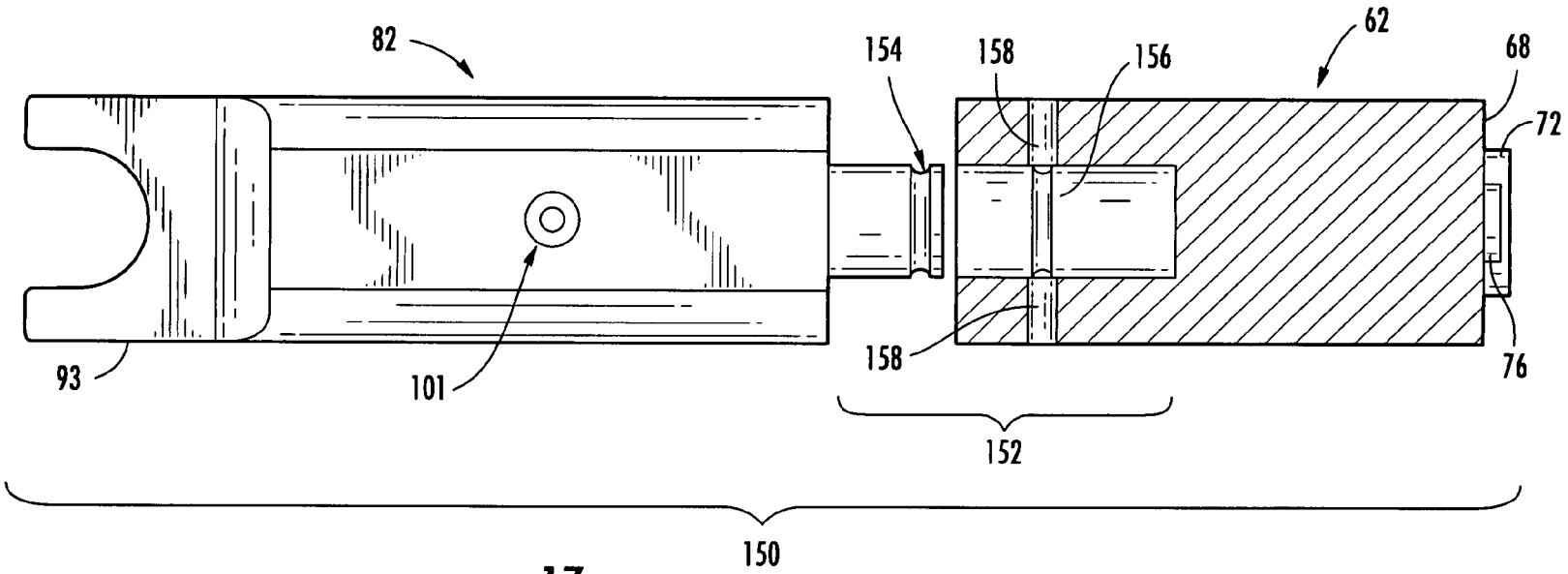
FIG. 17 is a top view in partial cross-section of a fifth embodiment of a device having a groove and spring plunger connector assembly.

FIG. 17 is a top view in partial cross-section of a fifth embodiment of a device 150 having a groove and spring plunger connector assembly 152 comprising a grooved portion 154 extending from the second portion 82 and adapted for connection to a spring plunger portion 156 positioned within the first portion 62. The spring plunger portion 156 has protruding plunger elements 158 that spring outwardly when the grooved portion 154 is inserted into the first portion 62 and that spring back inwardly and lock into the grooved portion 154 when the second portion 82 is connected to the first portion 62.

Figure 18:
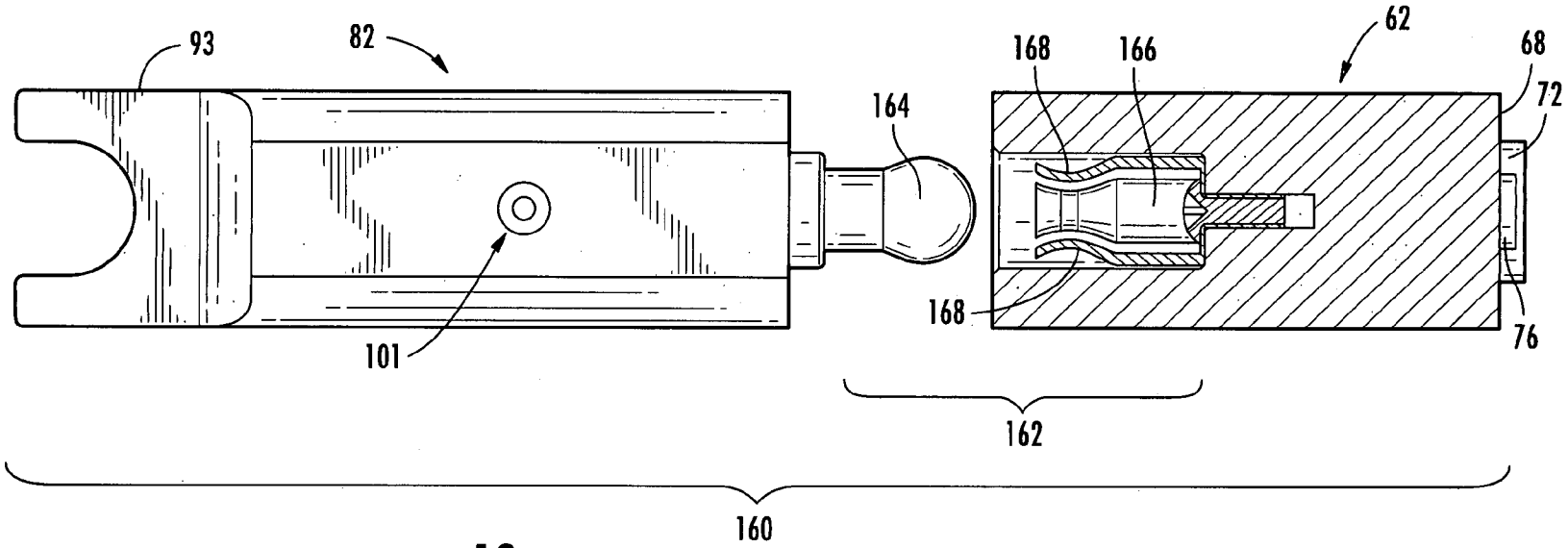
FIG. 18 is a top view in partial cross-section of a sixth embodiment of a device having a ball and clip socket connector assembly.

FIG. 18 is a top view in partial cross-section of a sixth embodiment of a device 160 having a ball and clip socket connector assembly 162. The ball and clip socket connector assembly 162 comprises a ball end portion 164 extending from the second portion 82 and adapted for connection to a clip socket portion 166 positioned within the first portion 62. The clip socket portion 166 has spring clips elements 168 that spring outwardly when the ball end portion 164 is inserted into the first portion 62 and that spring back inwardly and lock the ball end portion 164 into place when the second portion 82 is connected to the first portion 62.

Figure 19:
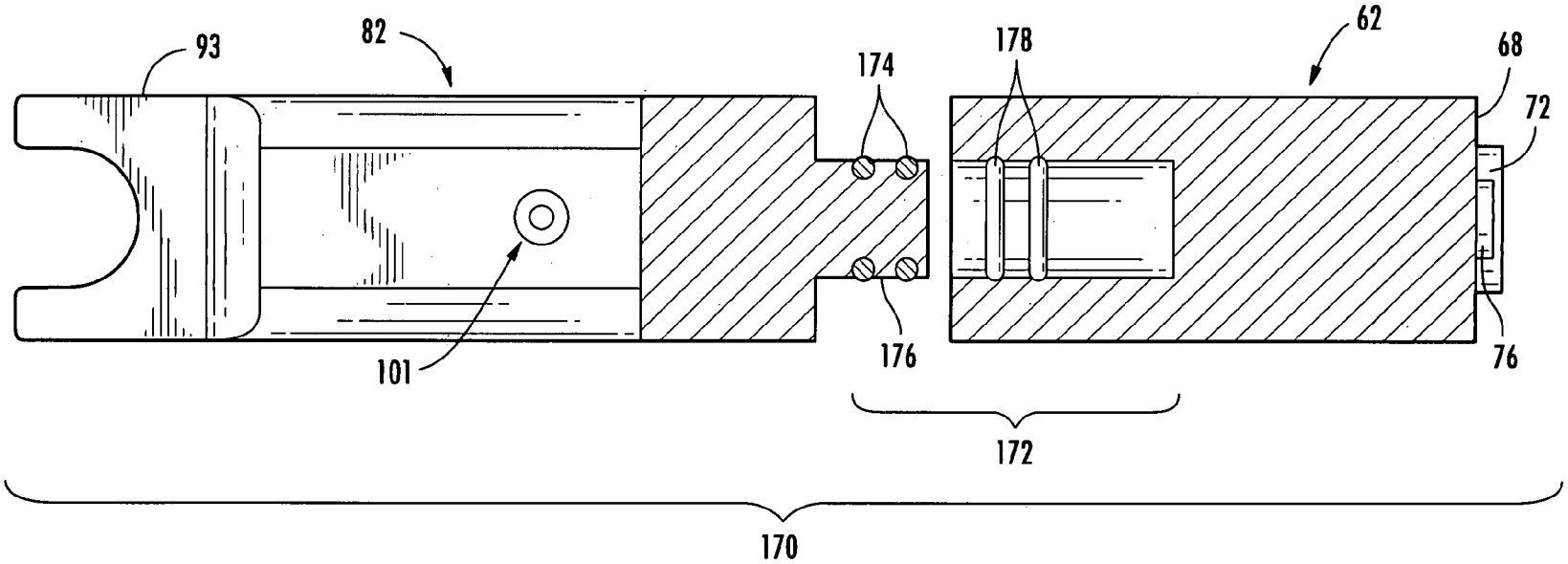
FIG. 19 is a top view in partial cross-section of a seventh embodiment of a device having an O-ring and groove connector assembly.

FIG. 19 is a top view in partial cross-section of a seventh embodiment of a device 170 having an O-ring and groove connector assembly 172. The O-ring and groove connector assembly 172 comprises one or more O-rings 174 attached to an extension 176 extending from the second portion 82 and adapted for connection to one or more corresponding grooves 178 positioned within the first portion 62. The O-rings 174 are designed to fit within the corresponding grooves 178 when the second portion 82 is connected to the first portion 62.

As discussed above and shown in the relevant Figures, embodiments of the disclosed device may have the first portion 62 connected to the second portion 82 via connector means comprising the fastener and fastener receiving connector assembly 77 (see FIG. 5), the threaded shaft and threaded opening connector assembly 133 (see FIG. 11), the magnetic connector assembly 142 (see FIG. 16A), the groove and spring plunger connector assembly 152 (see FIG. 17), the ball and clip socket connector assembly 162 (see FIG. 18), and the O-ring and corresponding groove connector assembly 172 (see FIG. 19). However, other suitable connectors and connector assemblies may be used to connect the first portion 62 to the second portion 82. The devices or tools of the disclosed embodiments may be made of a material comprising stainless steel, aluminum, brass, acrylic, resilient plastic, a mixture thereof, or another suitable metal or plastic material.

Figure 25:
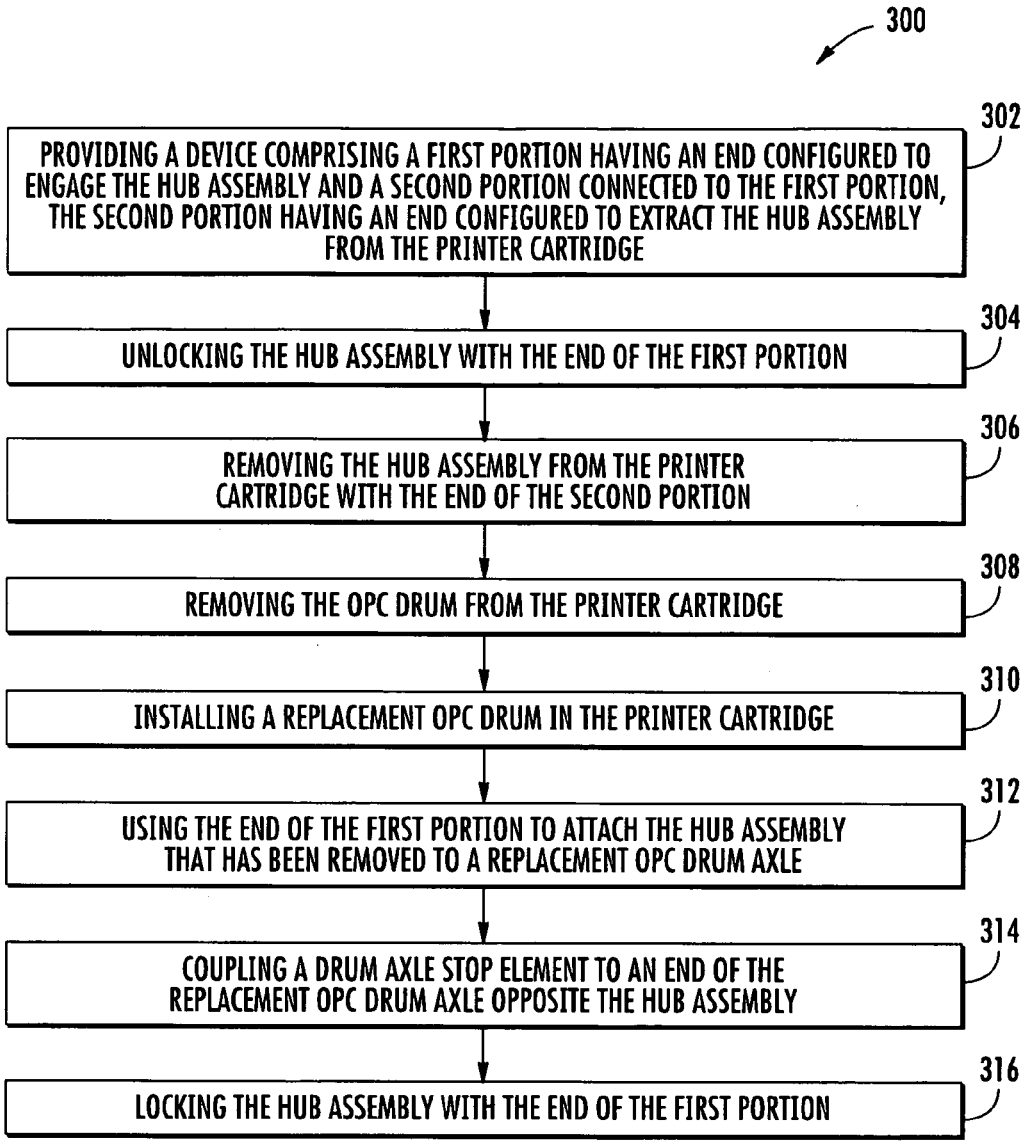
FIG. 25 a flow diagram of one of the embodiments of a method for remanufacturing a printer cartridge using one of the embodiments of a device of the disclosure; and, FIG. 26 a flow diagram of another one of the embodiments of a method for remanufacturing a printer cartridge using one of the embodiments of a device of the disclosure.

There is provided in another embodiment a method for remanufacturing a printer cartridge. FIG. 25 is a flow diagram of the method 300 for remanufacturing a printer cartridge using one of the embodiments of the device 60, 130, 140, 150, 160, 170, as discussed above. The method 300 involves removing the OPC drum 16 (see FIG. 20A) and replacing the OPC drum 16 with a replacement OPC drum 180 (see FIG. 21A) having a replacement OPC drum axle 182 (see FIG. 21A) to form or build a remanufactured printer cartridge 188 (see FIG. 21A).

FIGS. 20A-20E are perspective views of a first embodiment of the device 60 in one of the embodiments of a method of removal of the OPC drum 16 in a printer cartridge 10. FIG. 20A shows a user 128 holding the second portion 82 of the device 60 with the first portion 62 in the form of the hub assembly engagement end 68 in position for engagement to the drive hub 36 and locking ring 34 of the hub assembly 32. The circular recessed portion 48 faces the curved raised flange 76 of the second, portion 62 of the device 60. As shown in FIG. 20A, the printer cartridge 10 has an organic photoconductor (OPC) drum 16 having a drum axle 22 (see FIG. 20E) and having a hub assembly 32 attached to the drum axle 22. As shown in FIG. 20A, the hub assembly 32 is in a locked position 192 in the printer cartridge 10 to hold the OPC drum 16 in place. In particular, the hub assembly 32 is locked within the opening 38 of the side 28*a* of the waste hopper frame 30 (see FIG. 20E) of the printer cartridge 10.

The method 300 compriks step 302 of providing a device 60 (see FIG. 20A), 100 (see FIG. 9A), or 130 (see FIG. 11), or another embodiment of the device 99, 140, 150, 160, 170, comprising a first portion 62 having a first end 64 in the form of a hub assembly engagement end 68 configured to engage the hub assembly 32, and further having a second portion 82 connected to the first portion 62. The second portion 82 has a second end 88, in the form of a hub assembly extraction end 93, configured to extract the hub assembly 32 from the printer cartridge 10 (see FIG. 22D). In particular, the second end 88, in the form of the hub assembly extraction end 93, is configured to fit or position within the area 91 (see FIG. 22B) between the first end 18 of the OPC drum 16 and interior 27 (see FIG. 22D) of side 28*a* of the waste hopper frame 30 of the printer cartridge 10.

The method 300 further comprises step 304 of unlocking the hub assembly 32 with the end of the first portion 62, preferably the first end 64, in the form of the hub assembly engagement end 68, of the first portion 62. As shown in FIG. 20A, the circular raised flange 72 (see FIG. 8A) of the first end 64 of the first portion 62 engages and is inserted by a user 128 into the circular recessed portion 48 of the drive hub 36 of the hub assembly 32, and the curved raised flanges 76 engage and are inserted into the notched recessed portions 58 (see FIG. 20F) on the rim portion 56 (see FIG. 20F) of the locking ring 34, so as to fully engage the first end 64 of the first portion 62 with the hub assembly 32. As shown in FIGS. 20B and 20C, the engaged hub assembly 32 is then rotated counterclockwise a quarter turn or until the hub assembly 32 is in an unlocked position 196 (see FIG. 20C). The first portion 62 is used to rotate the hub assembly 32 in order to unlock it and separate or loosen it from the first end 24 of the drum axle 22. The first portion 62 may then be disengaged from the unlocked and loosened hub assembly 32. FIG. 20B shows the user 128 coupling the second end 62 of the device 60, in the form of the hub assembly engagement end 68, to the hub assembly 32 attached to the OPC drum 16 in the printer cartridge 10. FIG. 20C shows the user 128 holding the second portion 82 of the device 60 and rotating the hub assembly 32 with the second end 62 of the device 60, in the form of the hub assembly engagement end 68, to unlock the hub assembly 32 from the OPC drum 16 in the printer cartridge 10. The hub assembly 32 is in unlocked position 196.

The method 300 further comprises step 306 of removing the hub assembly 32 from the printer cartridge 10 with the end of the second portion 82, preferably the second end 88, in the form of the hub assembly extraction end 93, of the second portion 82. FIG. 20D shows the user 128 using and contacting the hub assembly extraction end 93 of the device 60 to the hub assembly 32 which is in the unlocked position 192 in order to push out and remove the locking ring 34 and the drive hub 36 of the hub assembly 32 from the first end 18 of the OPC drum 16 in the printer cartridge 10 and out of the opening 38.

Figure 22A:
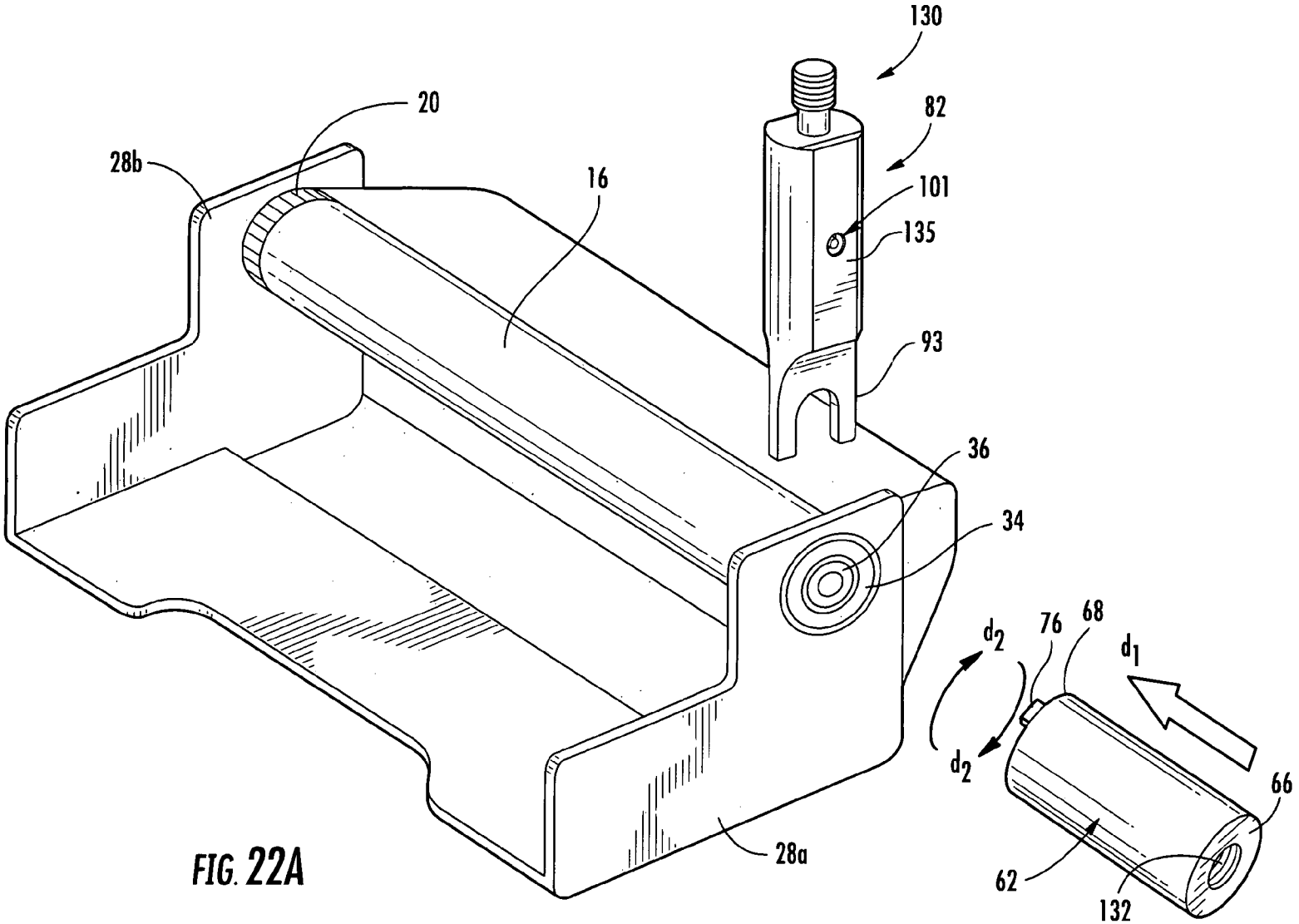
FIG. 22A is a top front perspective view showing relative positions of the first portion and the second portion of the third embodiment of the device in use during removal of an OPC drum in a printer cartridge.
Figure 22B:
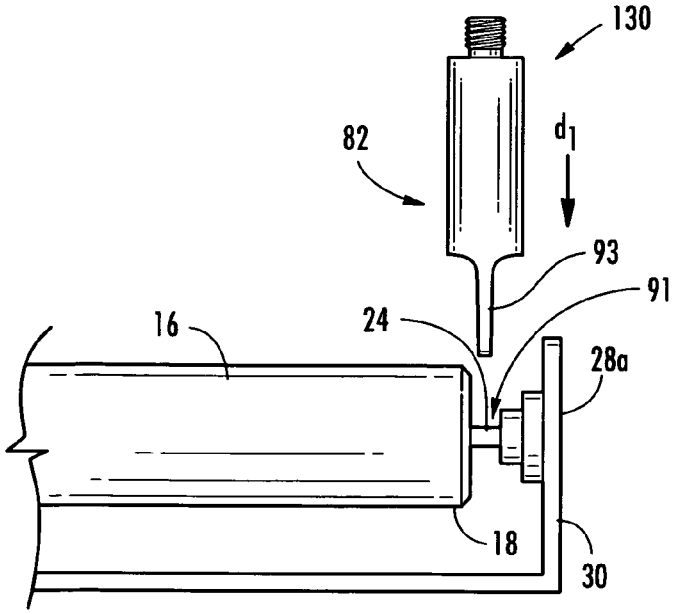
FIGS. 22B-22D are perspective views of the second portion of the third embodiment of the device in use in another one of the embodiments of a method of removal of an OPC drum of a known printer cartridge.
Figure 22C:
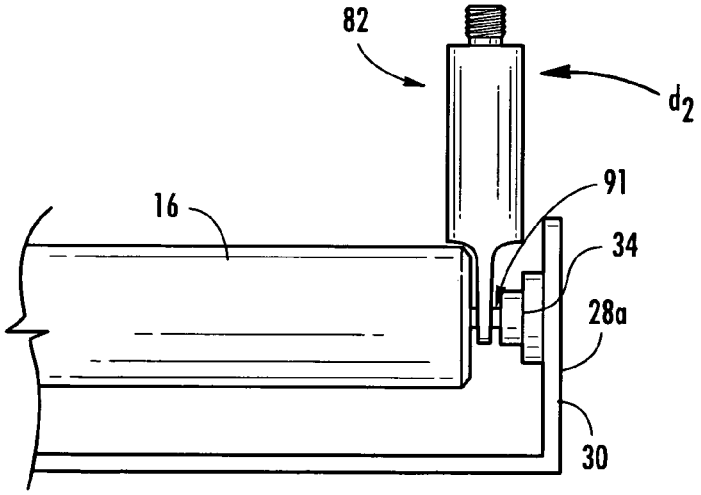
Figure 22D:
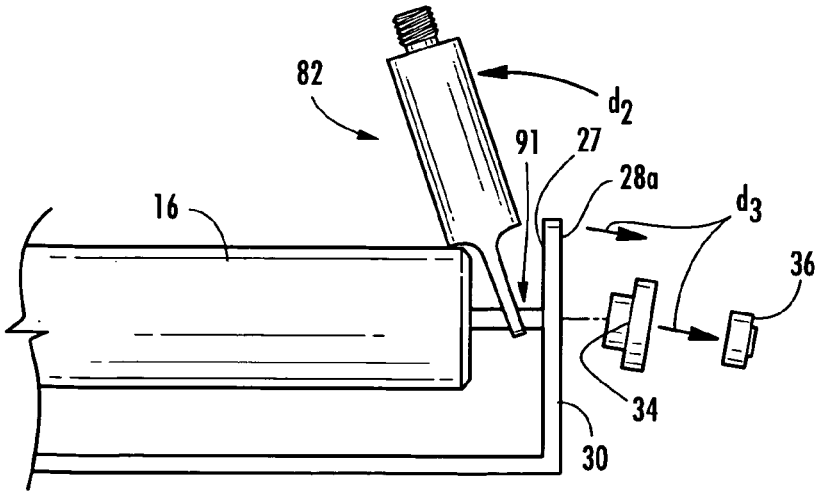

As more particularly shown in FIGS. 22A-22D, the second portion 82 of device 130 having the hub assembly extraction end 93 comprising the U-shaped fork portion 94 with tines 96 and central U-shaped portion 98 (see FIG. 4) is configured to fit or position within area 91 between the first end 18 of the OPC drum 16 and interior 27 (see FIG. 22D) of the side 28*a* of the waste hopper frame 30. FIG. 22A shows the second portion 82 of device 130 with the hub assembly extraction end 93 in position above the OPC drum 16 and above side 28*a* of the waste hopper 30. The hub assembly engagement end 68 of the device 130 is shown in position opposite the locking ring 34 and drive hub 36 of the hub assembly 32. When in use, the first portion 62 is first moved in direction $d_1$ and then rotated in direction $d_2$. FIG. 22B shows the second portion 82 of device 130 with the hub assembly extraction end 93 configured to fit or position on the first end 24 of the drum axle 22 within area 91 between the first end 18 of the OPC drum 16 and interior 27 (see FIG. 22D) of the side 28*a* of the waste hopper frame 30. The second portion 82 is moved downwardly in direction $d_1$. FIG. 22C shows the second portion 82 of device 130 with the hub assembly extraction end 93 contacting the first end 24 of the drum axle 22 within area 91 between the first end 18 of the OPC drum 16 and interior 27 (see FIG. 22D) of the side 28*a* of the waste hopper frame 30. The second portion 82 can be moved by sliding and tilting the second portion 82 in direction $d_2$ within the area 91 to contact the locking ring 34 of the hub assembly 32 and extract the locking ring 34 and drive hub 36 of the hub assembly 32 off the first end 24 of the drum axle 22. FIG. 22D shows the second portion 82 of device 130 with the hub assembly extraction end 93 sliding along the first end 24 of the drum axle 22 and pushing the locking ring 34 and drive hub 36 of the hub assembly 32 in direction $d_3$ out of the opening 38 (see FIG. 20E) of the side 28*a* of the waste hopper frame 30, and out of the printer cartridge 10.

Figure 20E:
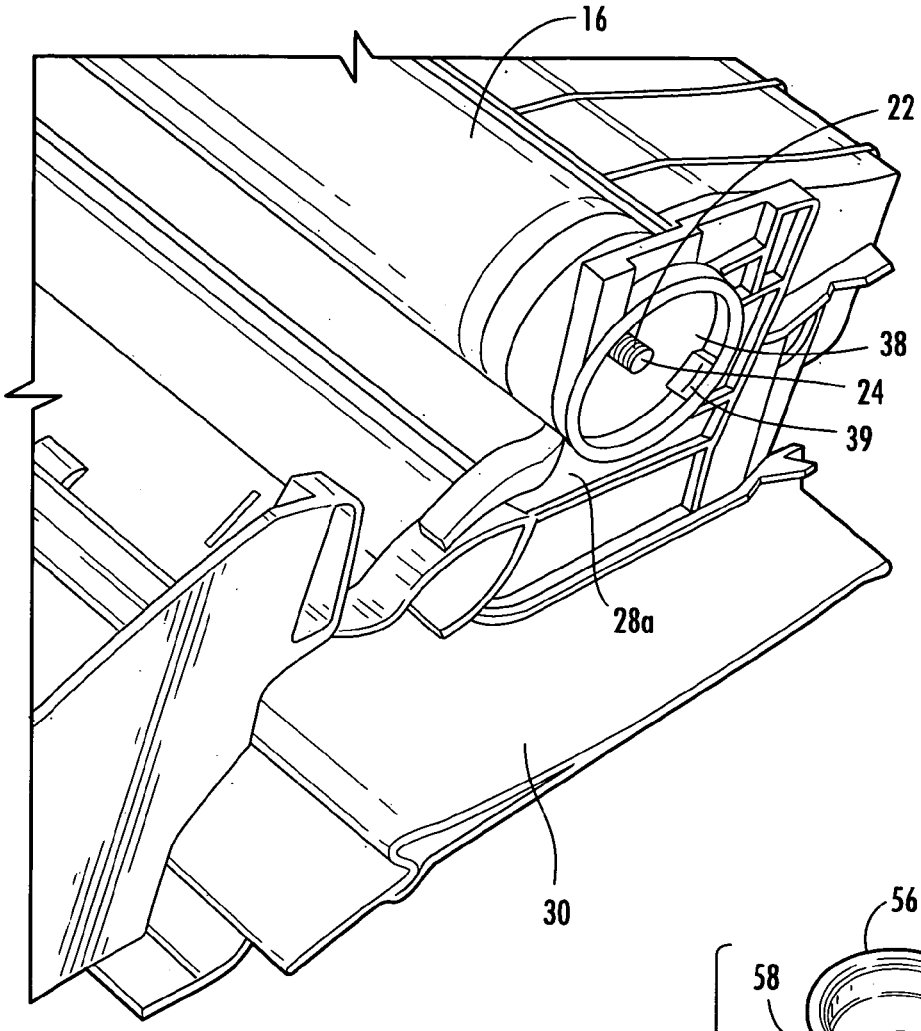
Figure 20F:
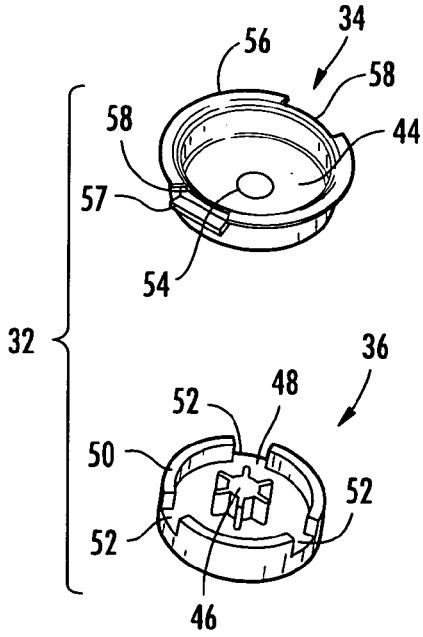
FIG. 20F is a perspective view of one of the embodiments of the hub assembly.

FIGS. 20E and 20F show the hub assembly 32 removed from the printer cartridge 10 and FIG. 20F shows the locking ring 34 and drive hub 36 undamaged and intact. FIG. 20E shows the first end 24 of the drum axle 22 of the OPC drum 16 and the opposed locking notches 39 within the opening 38 on the side 28*a* of the waste hopper frame 30. FIG. 20F is a perspective view of one of the embodiments of the hub assembly 32. The hub assembly 32 comprises the locking ring 34 and the drive hub 36. The locking ring 34 has a recessed interior 44, a hole 54, a rim portion 56 with notched recessed portions 58, and opposed locking tabs 57 in the locking ring 34. The drive hub 36 comprises a central raised portion 46, a substantially circular recessed portion 48, and a rim portion 50 with notched recessed portions 52.

The method 300 further comprises step 308 of removing the OPC drum 16 from the printer cartridge 10. Once the hub assembly 32 is removed, the OPC drum 16 may be manually removed and lifted out of the printer cartridge 10.

The method 300 further comprises step 310 of installing a replacement OPC drum 180 having a replacement OPC drum axle 182 in the printer cartridge 10 to build or form a remanufactured printer cartridge 188. The OPC drum 16 may be removed and replaced with the replacement OPC drum 180 (see FIGS. 21A and 24A).

Figure 24B:
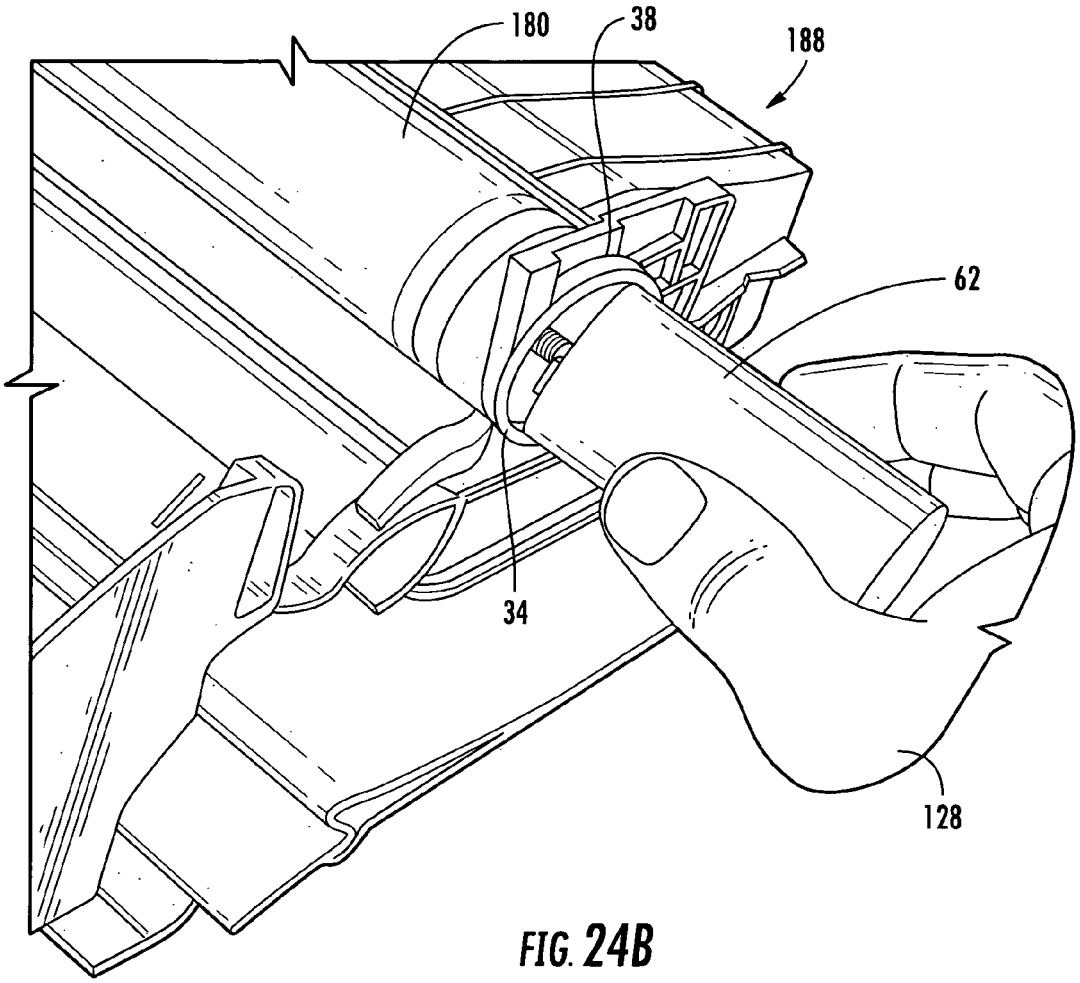
Figure 24C:
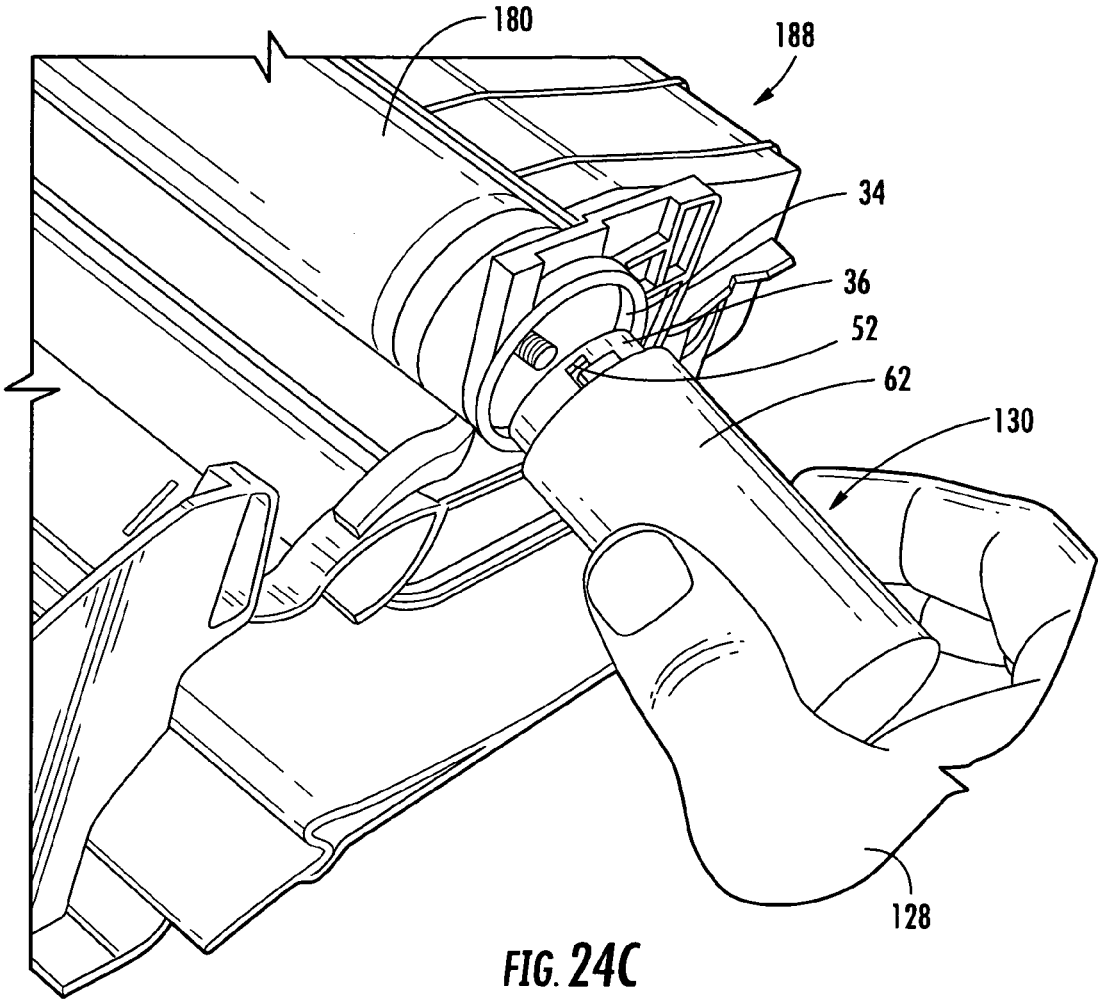
Figure 24D:
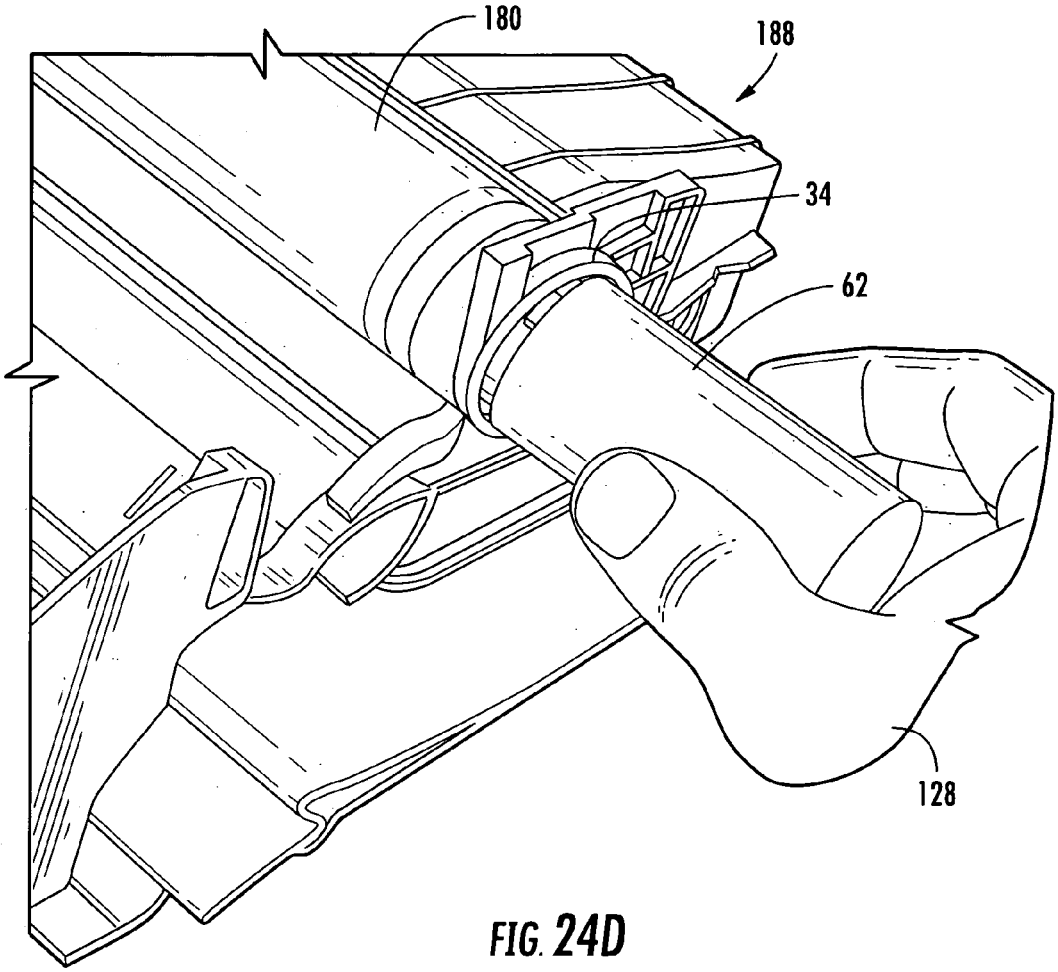
Figure 24E:
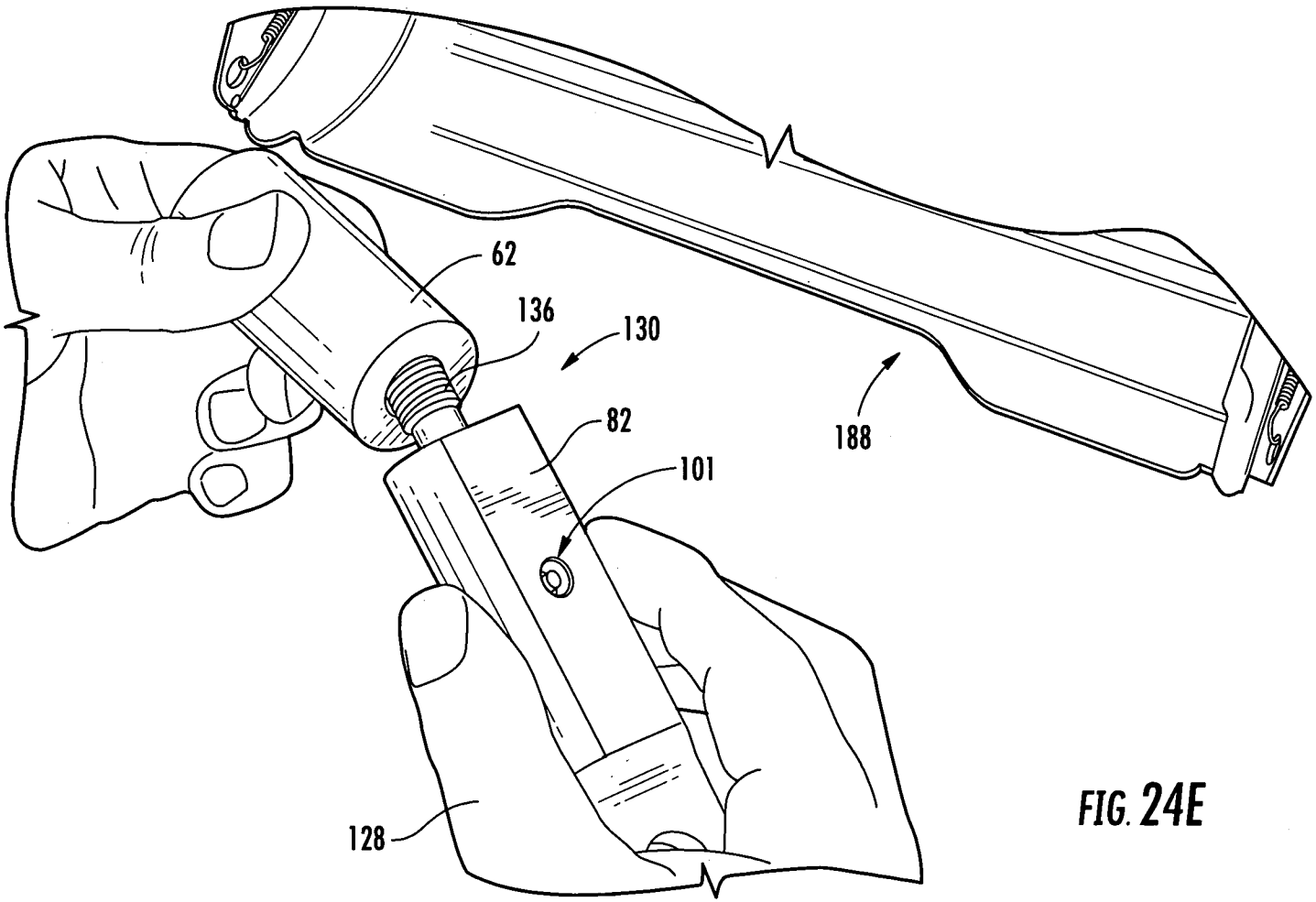
Figure 24F:
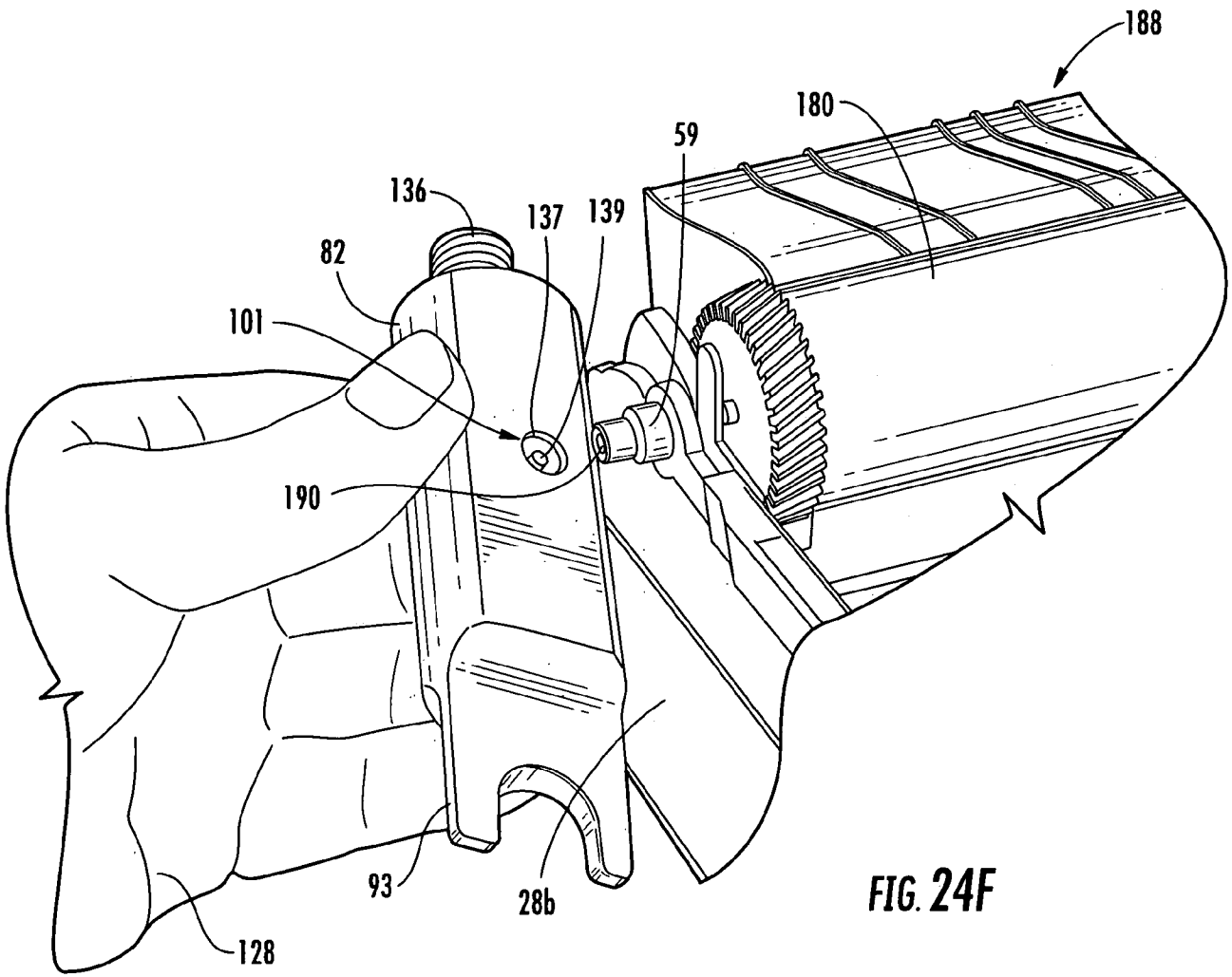
Figure 24G:
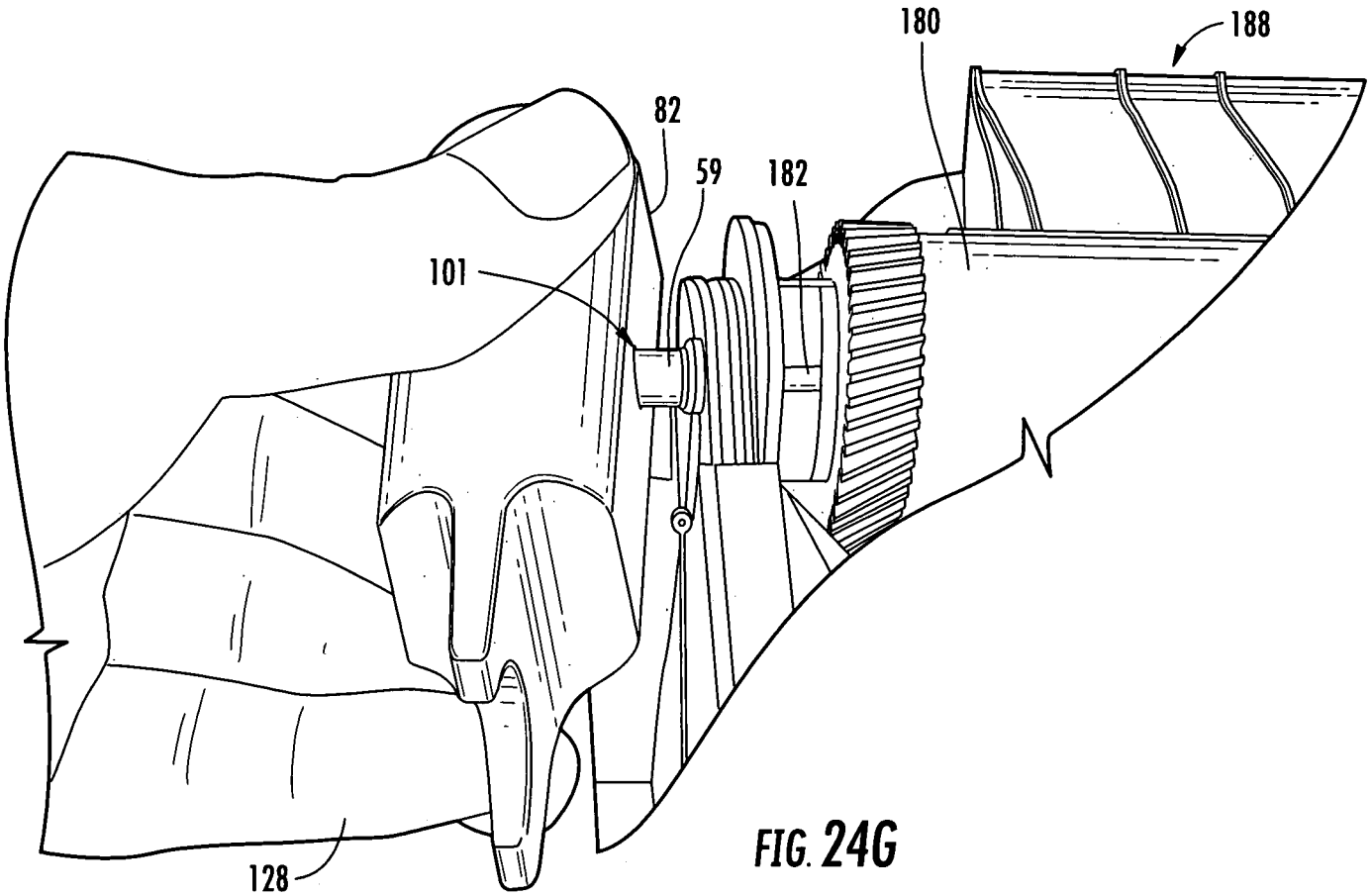
Figure 24H:
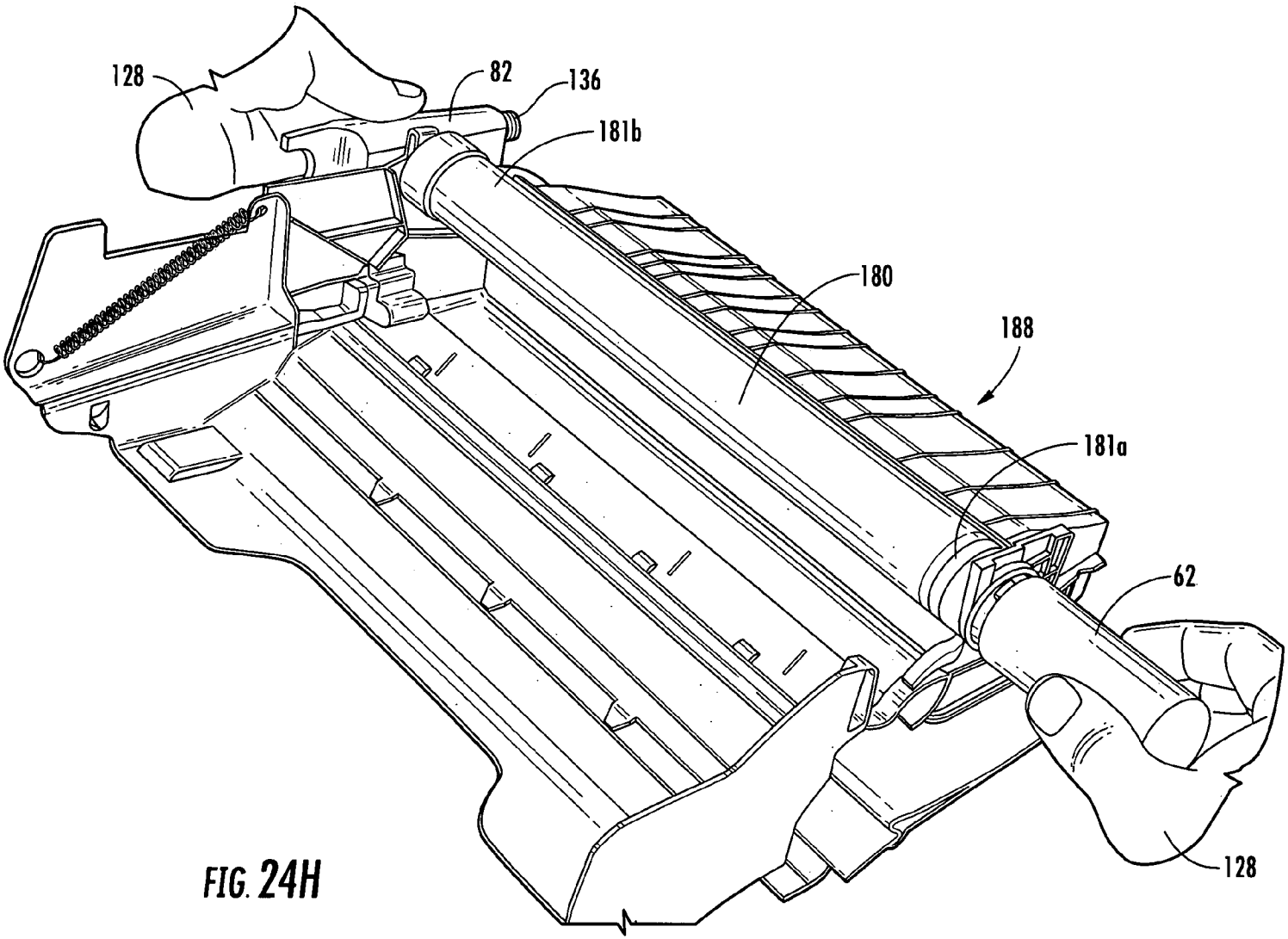

The method 300 further comprises step 312 of attaching with the end using the first end 64, in the form of the hub assembly engagement end 68, of the first portion 62 to attach or install the hub assembly 32 that has been removed to a first end 184 of the replacement OPC drum axle 182. FIGS. 21A-21C and FIGS. 24A-24H show installation of the replacement OPC drum 180 with the first portion 62 of device 60. As shown in FIGS. 24F-24H, the method 300 may further comprise optional step 314 of coupling a drum axle stop element 101 to a second end 190 of the replacement OPC drum axle 182 opposite the hub assembly 32. For the device 130, the drum axle stop element 101 comprises an opening 137 with a recessed pin 139 formed in the second portion 82 configured to stop movement of the second end 190 of the replacement OPC drum axle 182 in order to align and hold the replacement OPC drum 180 in place. The recessed pin 139 of the second portion 82 of device 130 acts as a support when installing the hub assembly 32 with the first portion 62. The recessed pin 139 stops the replacement OPC drum axle 182 from moving horizontally when the first portion 62 is used to push the hub assembly 32 onto the first end 184 of the replacement OPC drum axle 182. The second portion 82 holds the replacement OPC drum axle 182 in position at the second end 190 of the replacement OPC drum axle 182 while the first portion 62 pushes the hub assembly 32 into place at the first end 184. For the device 60, 100 or 130, the drum axle stop element 101 may comprise in one embodiment the adaptor 102 (see FIG. 9A), in another embodiment a tool such as pliers 186 (see FIG. 21C), or another suitable drum axle stop element, to hold the second end 190 of the replacement OPC drum axle 182 while the first portion 62 pushes the hub assembly 32 into place. The method 300 further comprises step 316 of locking the hub assembly 32 with the first portion 62, and in particular, with the first end 64, in the form of the hub assembly engagement end 68, of the first portion 62 to hold the replacement OPC drum 180 in place in the remanufactured printer cartridge 188. The first portion 62 rotates the hub assembly 32 clockwise a quarter turn to lock the hub assembly 32 into the locked position 192 within the opening 38 of the side 28*a* of the waste hopper frame 30.

Figure 26:
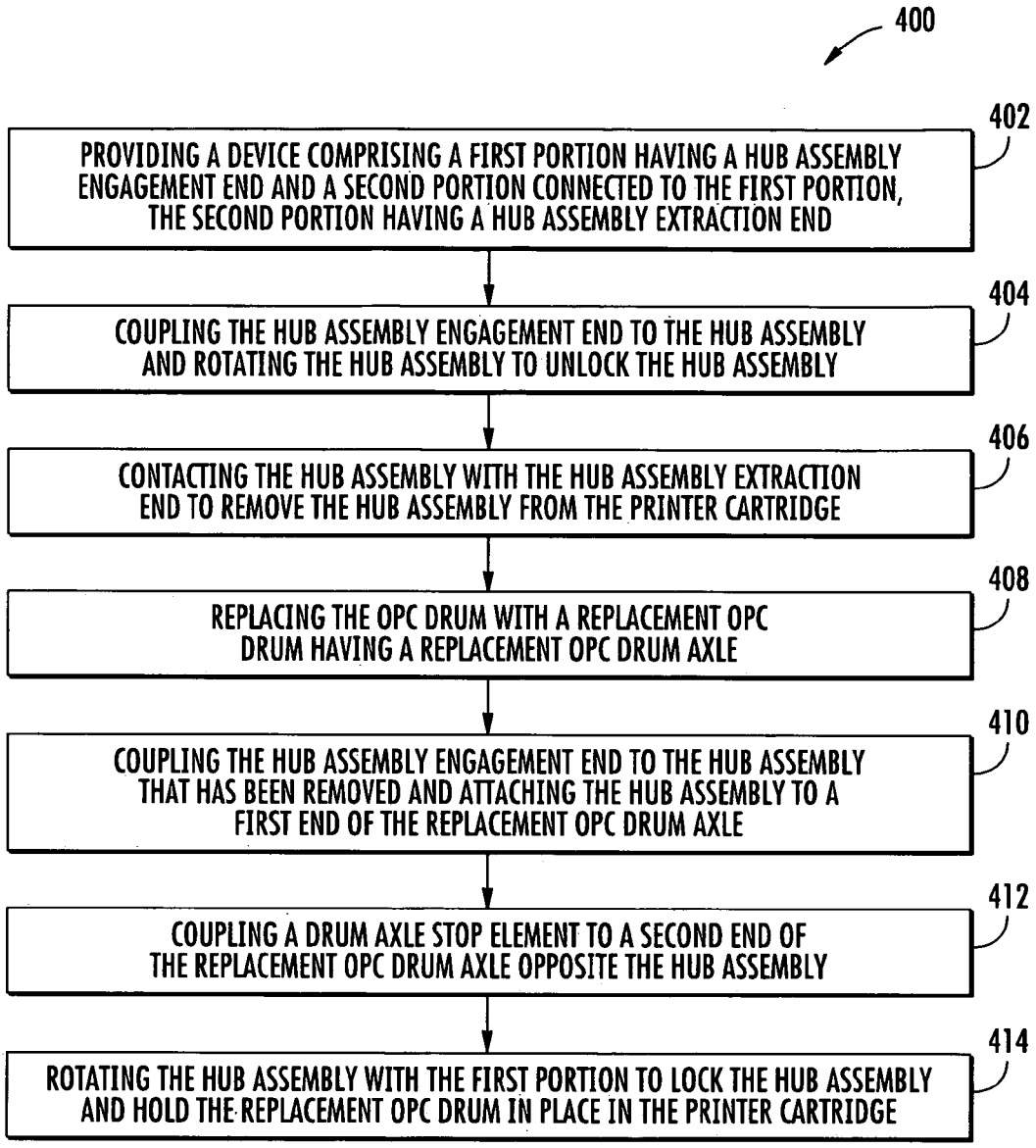

In another embodiment there is provided a method 400 for replacing an organic photoconductive (OPC) drum 16 of a printer cartridge. FIG. 26 is a flow diagram of method 400 for remanufacturing a printer cartridge using one of the embodiments of a device of the disclosure. The organic photoconductor (OPC) drum 16 has a drum axle 22 and has a hub assembly 32 attached to the drum axle 22. The hub assembly 32 is in a locked position 192 (FIG. 20A) in the printer cartridge to hold the OPC drum 16 in place. The method 400 comprises step 402 of providing a device 60 (see FIG. 4), 100 (see FIG. 9*a*), or 130 (see FIG. 11), or another embodiment of the device, comprising a first portion 62 having a first end 64, in the form of a hub assembly engagement end 68, configured to engage the hub assembly 32, and comprising a second portion 82 connected to the first portion 62. The second portion 82 has a second end 88, in the form of a hub assembly extraction end 93, configured to extract the hub assembly 32 from the first end 24 of the drum axle 22 and from the printer cartridge 10. In particular, the second end 88, in the form of the hub assembly extraction end 93, is configured to fit or position within the area 91 between the first end 18 of the OPC drum 16 and the interior of side 28*a* of the waste hopper frame 30 of the printer cartridge 10.

The method 400 further comprises step 404 of coupling the hub assembly engagement end 68 of the first portion 62 to the hub assembly 32 and further comprises step 406 of rotating the hub assembly 32 to unlock the hub assembly 32, so that the hub assembly 32 is in an unlocked position 196. As shown in FIGS. 20B-20C, 22A and 23B, the circular raised flange 72 of the first end 64 of the first portion 62, in the form of the hub assembly engagement end 68, engages and is inserted into the circular recessed portion 48 of the drive hub 36 of the hub assembly 32, and the curved raised flanges 76 engage and are inserted into the notched recessed portions 58 on the rim portion 56 of the locking ring 34, so as to fully engage the first end 64 of the first portion 62 with the hub assembly 32. The engaged hub assembly 32 is then rotated counterclockwise a quarter turn or until the hub assembly 32 is in an unlocked position 196. The first portion 62 is used to rotate the hub assembly 32 in order to unlock it and separate or loosen it from the drum axle 22. The first portion 62 may then be disengaged from the unlocked and loosened hub assembly 32.

The method 400 further comprises step 406 of contacting the hub assembly 32 with the hub assembly extraction end 93 to remove the hub assembly 32 from the printer cartridge. As shown in FIGS. 22B-22D, the central U-shaped portion 98 of the U-shaped fork portion 94 of the second end 88, in the form of the hub assembly extraction end 93, is configured to fit or position within the area 91 between the first end 18 of the OPC drum 16 and the interior of the side 28*a* of the waste hopper frame 30. The hub assembly extraction end 93 can be moved by sliding and tilting the second portion 82 and the hub assembly extraction end 93 within the area 91 to contact the hub assembly 32 and extract the hub assembly 32 off the drum axle 22, and push the hub assembly 32 out of the opening 38 of the side 28*a* of the waste hopper frame 30, and out of the printer cartridge 10.

The method further comprises step 408 of replacing the OPC drum 16 with a replacement OPC drum 180 having a replacement OPC drum axle 182. The method 400 further comprises step 410 of coupling the hub assembly engagement end 68 of the first portion 62 to the hub assembly 32 that has now been removed and attaching the hub assembly 32 to a first end 184 of the replacement OPC drum axle 182. The method 400 further comprises step 412 of coupling a drum axle stop element 101 to a second end 190 of the replacement OPC drum axle 182 opposite the hub assembly 32. For the device 130, the drum axle stop element 101 comprises an opening 137 with a recessed pin 139 formed in the second portion 82 configured to stop movement of the second end 190 of the replacement OPC drum axle 182 in order to align and hold the replacement OPC drum 180 in place. The recessed pin 139 of the second portion 82 of device 130 acts as a support when installing the hub assembly 32 with the first portion 62. The recessed pin 139 stops the replacement OPC drum axle 182 from moving horizontally when the first portion 62 is used to push the hub assembly 32 onto the first end 184 of the replacement OPC drum axle 182. The second portion 82 holds the replacement OPC drum axle 182 in position at the second end 190 while the first portion 62 pushes the hub assembly 32 into place at the first end 184. For the device 60 or 100, the drum axle stop element 101 may comprise in one embodiment the adaptor 102 (see FIG. 9A), in another embodiment a tool such as pliers 186 (see FIG. 21C), or another suitable drum axle stop element, to hold the second end 190 of the replacement OPC drum axle 182 while the first portion 62 pushes the hub assembly 32 into place (see FIG. 21C). The method 400 further comprises step 414 of rotating the hub assembly 32 with the first portion 62 to lock the hub assembly 32 in the locked position 192 and to hold the replacement OPC drum 180 in place in the remanufactured printer cartridge 188.

Figure 22E:
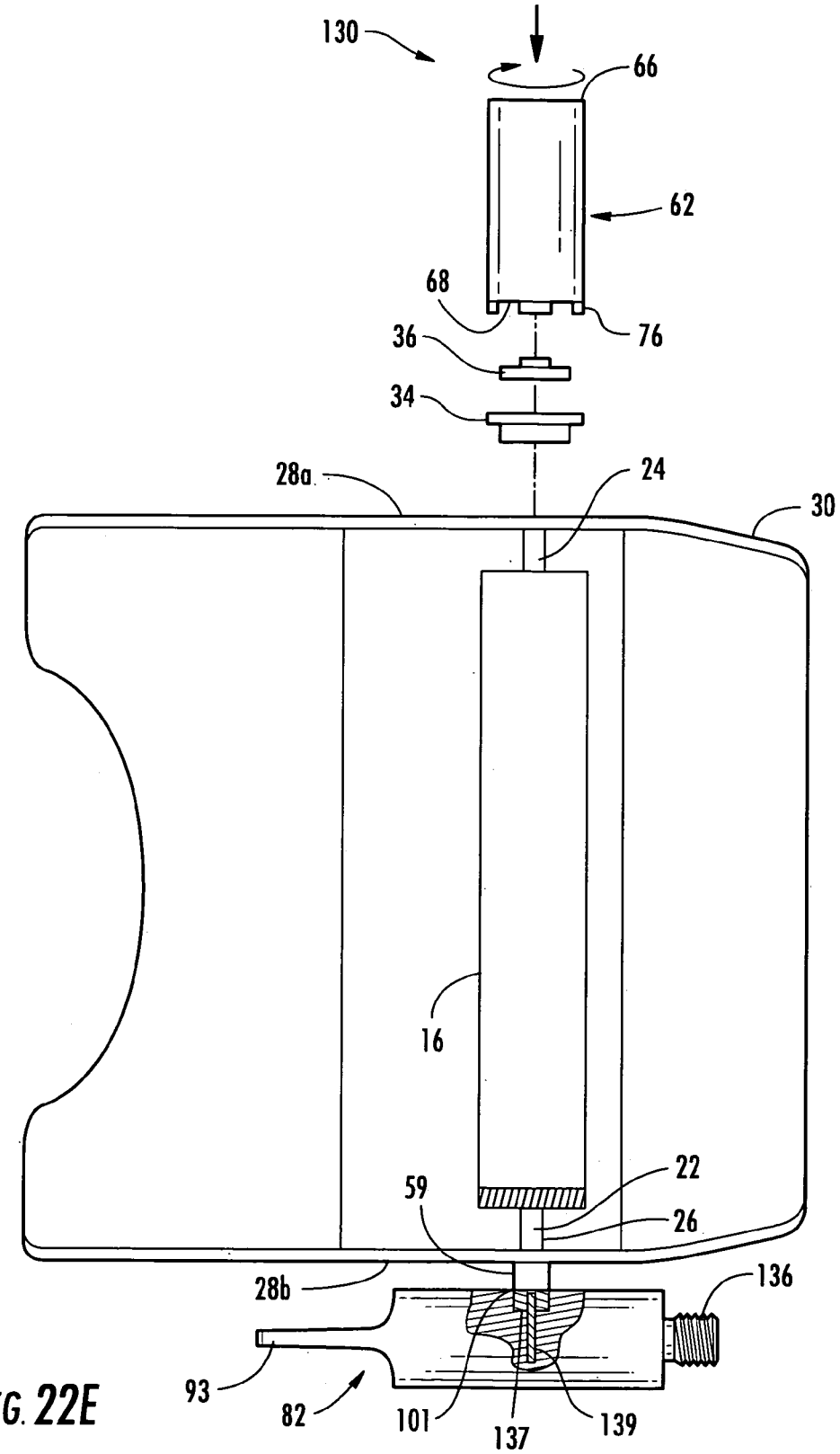
FIG. 22E is a top view showing relative positions of the first portion and the second portion of the third embodiment of the device in use during installation of an OPC drum in a printer cartridge.

FIGS. 21A-21D are perspective views of a first embodiment of the device 60 in one of the embodiments of a method of installation of a replacement OPC drum 180 of a remanufactured cartridge 188. FIG. 22A is a top front perspective view showing relative positions of the first portion 62 and the second portion 82 of the third embodiment of the device 130 during removal of an OPC drum 16 in printer cartridge 10. FIGS. 22A-22E are perspective views of the second portion 82 of the third embodiment 130 of the device in use in another one of the embodiments of a method of removal of the OPC drum 16 of the known printer cartridge 10. FIG. 22E is a top view showing relative positions of the first portion 62 and the second portion 82 of the third embodiment of the device 130 during installation of the replacement OPC drum 180 in the remanufactured printer cartridge 188. FIG. 22E shows the second portion 82 in partial cross-section in use during installation of the replacement OPC drum 180. The drum axle stop element 101 of the second portion 82 engages the second end 26 of the drum axle 22 of the OPC drum 16 on the side 28*b* of the waste hopper frame 30, and a drum bushing 59 may be used between the second portion 82 and the drum 16.

Figure 23A:
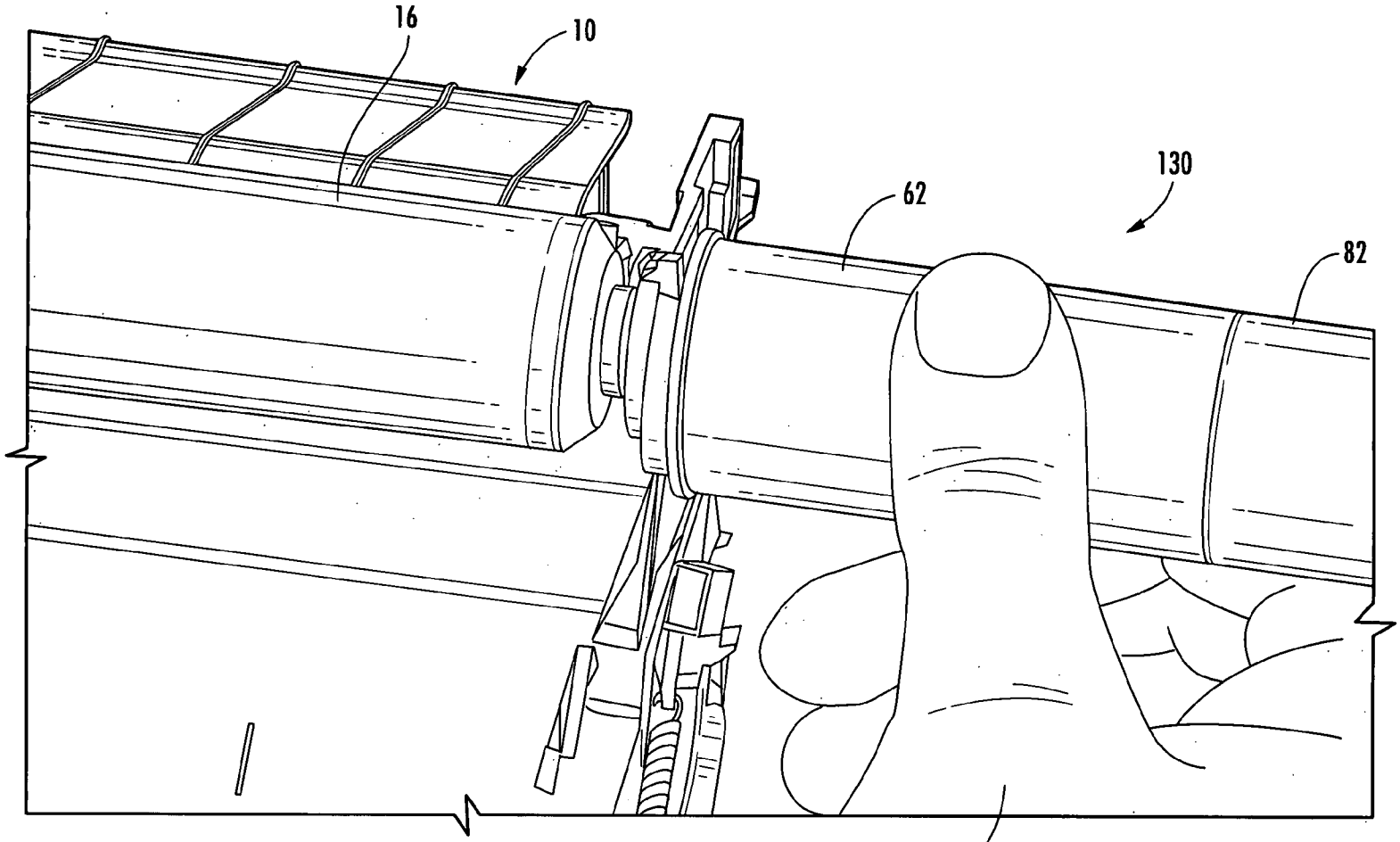
FIGS. 23A-23B are perspective views of the third embodiment of the device in use in another one of the embodiments of a method of removal of an OPC drum of a known printer cartridge.
Figure 23B:
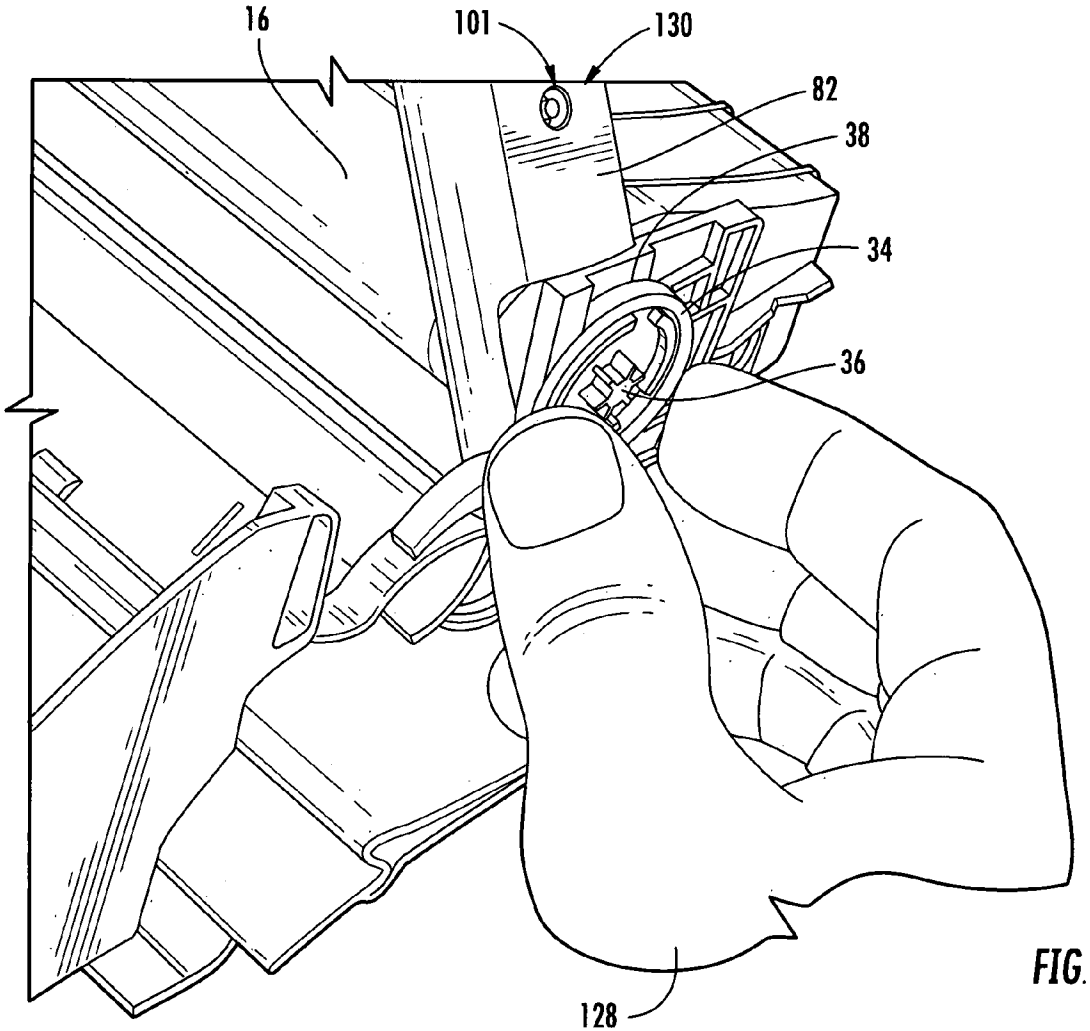

FIGS. 23A-23B are perspective views of a third embodiment of the device 130 in yet another one of the embodiments of a method of removal of the OPC drum 16 of printer cartridge 10. FIG. 23A shows the user 128 coupling the first portion 62 of the device 130 to the hub assembly 32 attached to the OPC drum 16 of the printer cartridge 10. FIG. 23B shows the user 128 using the second portion 82 of the device 130 to push out the locking ring 34 and drive hub 36 of the hub assembly 32 from the OPC drum 16 in the printer cartridge 10. FIGS. 24A-24H are perspective views of the third embodiment of the device 130 in another one of the embodiments of a method of installation of a replacement OPC drum 180 of a remanufactured printer cartridge 188. FIG. 24A shows the user 128 installing the replacement OPC drum 180 and using the first portion 62 of the device 130 to attach the locking ring 34 of the hub assembly 32 that has been removed to the first end 184 of the replacement OPC drum axle 182 of the remanufactured printer cartridge 188. FIG. 24B shows the user 128 using the second portion 62 to attach the locking ring 34 within opening 38 of the remanufactured printer cartridge 188. FIG. 24C shows the user 128 using the second portion 62 of the device 130 to attach the hub drive 36 of the hub assembly 32 to the locking ring 34 to the replacement OPC drum 180 of the remanufactured printer cartridge 188. FIG. 24D shows the user 128 attaching the hub assembly 32 to the replacement OPC drum 180 of the remanufactured printer cartridge 188. FIG. 24E shows the user 128 twisting off the second portion 82 of the device 130 from the first portion 62 of the device 130. FIG. 24F shows the user 128 coupling the drum axle stop element 101 to the second end 190 of the replacement OPC drum axle 182 of the replacement OPC drum 180 of the remanufactured printer cartridge 188. FIG. 24G shows the user 128 locking the replacement OPC drum axle 182 of the replacement OPC drum 180 of the remanufactured printer cartridge 188 in place with the drum axle stop element 101. FIG. 24H shows the user 128 using both the first portion 62 and the second portion 82 to lock the hub assembly 32 and the replacement OPC drum 180 of the remanufactured printer cartridge 188 in place.

It can now be realized that embodiments of the disclosed devices and methods for removing and replacing an OPC drum in a printer cartridge facilitate the removal of the OPC drum without damage to the OPC drum, the hub assembly, or other components of the printer cartridge. This advantage is highly beneficial in the remanufacturing of cartridges, as the appearance of the cartridge is preserved. Additionally, since the removal of the OPC drum with embodiments of the device and method disclosed herein reduces or avoids having to break any portion of the printer cartridge, the disclosed devices and methods avoid extraneous steps of having to repair or replace broken cartridges or cartridge components. It can further be realized that embodiments of the disclosed devices and methods provide for a novel tool and technique for efficiently removing and replacing an OPC drum, which may be practiced when remanufacturing a previously used toner cartridge. The disclosed devices and methods remove the hub assembly without damage to other components and fully install the hub assembly onto the OPC drum axle.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A device for remanufacturing a printer cartridge, the printer cartridge comprising an organic photoconductor (OPC) drum having a drum axle and a hub assembly attached to the drum axle, the hub assembly being in a locked position in the printer cartridge, the device comprising:

a first portion having an end configured to engage the hub assembly and unlock and lock the hub assembly; and, a second portion connected to the first portion, the second portion having an end configured to extract the hub assembly from the printer cartridge when the hub assembly is in an unlocked position.

2. The device of claim 1, wherein the hub assembly comprises a drive hub and a locking ring.

3. The device of claim 1, wherein the end of the first portion comprises one or more raised flanges configured for insertion into one or more corresponding recessed portions formed in the hub assembly.

4. The device of claim 1, wherein the end of the second portion comprises a U-shaped fork portion.

5. The device of claim 1, wherein the first portion is connected to the second portion via a connector means selected from the group consisting of a fastener and fastener receiving connector assembly, a threaded shaft and threaded opening connector assembly, a magnetic connector assembly, a groove and spring plunger connector assembly, a ball and clip socket connector assembly, and an O-ring and corresponding groove connector assembly.

6. The device of claim 1, wherein the device is comprised of a material selected from the group consisting of stainless steel, aluminum, brass, acrylic, resilient plastic, and a mixture thereof.

7. The device of claim 1, wherein the second portion further comprises a drum axle stop element configured to engage an end of a replacement OPC drum axle opposite the hub assembly.

8. The device of claim 1, wherein the first portion is removably connected to the second portion.

9. A tool for replacing an organic photoconductive (OPC) drum of a printer cartridge, the OPC drum having a drum axle and a hub assembly attached to the drum axle, the hub assembly being in a locked position in the printer cartridge, the tool comprising:

a first portion having a hub assembly engagement end configured to engage the hub assembly and rotatably unlock and lock the hub assembly; and, a second portion connected to the first portion, the second portion having a hub assembly extraction end configured to extract the hub assembly from the printer cartridge when the hub assembly is in an unlocked position.

10. The tool of claim 9, wherein the hub assembly engagement end comprises one or more raised flanges configured for insertion into one or more corresponding recessed portions formed in the hub assembly.

11. The tool of claim 9, wherein the hub assembly extraction end comprises a U-shaped fork portion.

12. The tool of claim 9, wherein the first portion has a threaded opening end opposite the hub assembly engagement end.

13. The tool of claim 9, wherein the second portion has a threaded screw shaft end opposite the hub assembly extraction end.

14. The tool of claim 9, wherein the first portion is connected to the second portion via a connector means selected from the group consisting of a fastener and fastener receiving connector assembly, a threaded shaft and threaded opening connector assembly, a magnetic connector assembly, a groove and spring plunger connector assembly, a ball and clip socket connector assembly, and an O-ring and corresponding groove connector assembly.

15. The tool of claim 9, wherein the tool is comprised of a material selected from the group consisting of stainless steel, aluminum, brass, acrylic, resilient plastic, and a mixture thereof.

16. The tool of claim 9, wherein the second portion further comprises a drum axle stop element configured to engage an end of a replacement OPC drum axle opposite the hub assembly.

17. A method for remanufacturing a printer cartridge, the printer cartridge comprising an organic photoconductor (OPC) drum having a drum axle and having a hub assembly attached to the drum axle, the hub assembly being in a locked position in the printer cartridge, the method comprising:

providing a device comprising:

a first portion having an end configured to engage the hub assembly; and, a second portion connected to the first portion, the second portion having an end configured to extract the hub assembly from the printer cartridge;

unlocking the hub assembly with the end of the first portion;

removing the hub assembly from the printer cartridge with the end of the second portion;

removing the OPC drum from the printer cartridge;

installing a replacement OPC drum in the printer cartridge;

using the end of the first portion to attach the hub assembly that has been removed to a replacement OPC drum axle;

coupling a drum axle stop element to an end of the replacement OPC drum axle opposite the hub assembly; and, locking the hub assembly with the end of the first portion.

18. The method of claim 17, wherein the drum axle stop element comprises an opening having a recessed pin in the second portion and configured to stop movement of the second end of the replacement OPC drum axle in order to align and hold the replacement OPC drum in place.

19. The method of claim 17, wherein the end of the first portion comprises one or more raised flanges configured for insertion into one or more corresponding recessed portions formed in the hub assembly.

20. The method of claim 17, wherein the end of the second portion comprises a U-shaped fork portion.

* * * * *